US007329992B2

(12) United States Patent
Minamihata et al.

(10) Patent No.: US 7,329,992 B2
(45) Date of Patent: Feb. 12, 2008

(54) DISCHARGE LAMP, METHOD FOR FABRICATING THE SAME AND LAMP UNIT

(75) Inventors: Ryo Minamihata, Hyogo (JP); Kazuhisa Tanaka, Osaka (JP); Tsuyoshi Nagakura, Osaka (JP); Yoshitaka Kurimoto, Osaka (JP); Makoto Horiuchi, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 222 days.

(21) Appl. No.: 10/491,250

(22) PCT Filed: Mar. 28, 2003

(86) PCT No.: PCT/JP03/04051

§ 371 (c)(1),
(2), (4) Date: Mar. 30, 2004

(87) PCT Pub. No.: WO03/083897

PCT Pub. Date: Oct. 9, 2003

(65) Prior Publication Data

US 2004/0256991 A1 Dec. 23, 2004

(30) Foreign Application Priority Data

Mar. 29, 2002 (JP) ..... 2002-096606
Mar. 29, 2002 (JP) ..... 2002-096607
Mar. 29, 2002 (JP) ..... 2002-096859

(51) Int. Cl.
*H01J 61/06* (2006.01)

(52) U.S. Cl. ..... 313/607; 313/626; 313/604

(58) Field of Classification Search ..... 313/607, 313/626, 623

See application file for complete search history.

(56) References Cited

U.S. PATENT DOCUMENTS 5,004,951 A * 4/1991 Honda et al. ..... 313/631

(Continued)

FOREIGN PATENT DOCUMENTS

| | | | | |
|---|---|---|---|---|
| EP | 1143485 | A2 | * | 10/2001 |
| EP | 1193735 | A1 | * | 4/2002 |
| EP | 1225614 | A1 | * | 7/2002 |
| JP | 2-142053 | A | | 5/1990 |
| JP | 3-210753 | A | | 9/1991 |
| JP | 3-261066 | A | | 11/1991 |
| JP | 2000-348680 | A | | 12/2000 |
| JP | 2001189146 | A | * | 7/2001 |
| JP | 2001-266794 | A | | 9/2001 |
| JP | 2001-351577 | A | | 12/2001 |
| WO | WO 97/48116 | A | | 12/1997 |
| WO | WO 00/77826 | A1 | | 12/2000 |
| WO | WO 200077826 | A1 | * | 12/2000 |

OTHER PUBLICATIONS

International Search Report for PCT/JP03/04051 mailed Jul. 8, 2003; ISA/JPO.

*Primary Examiner*—Joseph L. Williams
*Assistant Examiner*—Hana A. Sanei
(74) *Attorney, Agent, or Firm*—Harness, Dickey & Pierce, P.L.C.

(57) ABSTRACT

A discharge lamp 50 comprises a luminous bulb 10 in which a luminous material 18 is encapsulated and a pair of electrodes 12 are arranged to be opposed to each other, and sealing parts (11*a*, 11*b*) that are formed at both ends of the luminous bulb 10 and in which metal foil structures 13 electrically connected to the pair of electrodes 12, respectively, are sealed. At least one of the metal foil structures 13 is composed of a first metal foil 13*a*, a second metal foil 13*b* and a metal bar 21 coupling both of them. At least one sealing part 11*b* of the sealing parts includes a cavity 20 around the position where in the sealing part the metal bar 21 is located, and at least a rare gas is encapsulated in the cavity 20.

30 Claims, 37 Drawing Sheets

U.S. PATENT DOCUMENTS 5,323,091 A 6/1994 Morris
6,198,223 B1 * 3/2001 Scholz ..... 313/623
6,294,870 B1 9/2001 Kawashima et al.
6,563,267 B1 * 5/2003 Van Den Nieuwenhuizen et al. .. 313/594
6,965,202 B2 * 11/2005 Hataoka et al. ..... 313/623
2002/0047522 A1 * 4/2002 Horiuchi et al. ..... 313/623
2002/0047611 A1 * 4/2002 Kaneko et al. ..... 315/246
2002/0057058 A1 * 5/2002 Honda et al. ..... 313/578
2002/0190653 A1 * 12/2002 Takeji et al. ..... 313/623
2003/0189406 A1 * 10/2003 Huttinger et al. ..... 313/631

* cited by examiner

DISCHARGE LAMP, METHOD FOR FABRICATING THE SAME AND LAMP UNIT

TECHNICAL FIELD

The present invention relates to a discharge lamp, a lamp unit and a method for fabricating a discharge lamp, and more particularly to a discharge lamp and a lamp unit both employed as a light source for a liquid crystal projector and a light source for an image projection device such as a digital micromirror device (DMD) projector.

BACKGROUND ART

In recent years, image projection devices such as liquid crystal projectors and DMD projectors are broadly used as systems for realizing a large-screen picture. In general, these kinds of image projection devices broadly employ high-pressure discharge lamps each exhibiting a high intensity. The image projection device need focus light on an extremely small area such as a liquid crystal panel, and therefore the high-pressure discharge lamp is required to serve as an approximate point light source as well as have a high intensity. Such being the case, attention is being given as a promising light source to a short-arc-type super-high pressure mercury lamp that most approximates a point light source among high-pressure discharge lamps and that has the advantage of high intensity.

A known short arc super-high pressure mercury lamp 1000 will be described with reference to FIG. 1.

A lamp 1000 includes a generally spherical luminous bulb (bulb) 100 composed of silica glass, and a pair of sealing parts 101*a* and 101*b* similarly composed of silica glass and coupled to the luminous bulb 100. The inside of the luminous bulb 100 includes a discharge space, in which mercury (the amount of encapsulated mercury: 150 through 250 $mg/cm^3$ relative to the internal volume of the luminous bulb, for example) that is a luminous material, a rare gas (a-few-tens-of-kPa argon, for example) and a small amount of halogen are encapsulated.

In the discharge space, a pair of tungsten electrodes (W electrodes) 102 are arranged so as to be opposed to each other at a given interval, and a coil (not shown) may be wound around each of the tips of the electrodes 102. The W electrodes 102 are welded to molybdenum foils (Mo foils) 103 in the sealing parts 101*a* and 101*b*, respectively, so that the W electrodes 102 and the Mo foils 103 are electrically connected to each other.

Each of the sealing parts 101*a* and 101*b* includes a glass part 105 extending from the luminous bulb 100 and a Mo foil 103. The glass part 105 and the Mo foil 103 are crimped, thereby holding the hermeticity of the discharge space in the luminous bulb 100. Both of the glass part 105 and the Mo foil 103 cannot be integrated together because both of them have different coefficients of thermal expansion. However, the plastic deformation of the Mo foil 103 enables a gap produced between the Mo foil 103 and the glass part 105 to be filled in. That is, the sealing parts 101*a* and 101*b* seal the inside of the luminous bulb 100 using a so-called foil sealing technology.

Each of the Mo foils 103 includes an outer lead 104 composed of molybdenum at the side opposite to each of the W electrodes 102. The Mo foil 103 and the outer lead 104 are welded to each other so that both of them are electrically connected to each other. The outer lead 104 is to be electrically connected to a member arranged around the lamp 1000 (not shown).

Next, the operating principles of the lamp 1000 will be described briefly. When a starting voltage is applied via the outer leads 104 and the Mo foils 103 to the W electrodes 102, argon (Ar) discharges to increase the temperature in the discharge space of the luminous bulb 100, so that mercury is heated and vaporized. Thereafter, mercury atoms are excited in the middle of an arc between the W electrodes 102 to emit light. The higher the mercury vapor pressure of the lamp 1000, the more obtained the light output can be. Therefore, a lamp having a higher mercury vapor pressure is more suitable for a light source of the image projection device. However, the lamp 1000 is used under a mercury vapor pressure of 15 through 25 MPa in terms of the physical strength of the luminous bulb 100 against pressure.

With the widespread use of image projection devices, there has been an increasing demand, to high-pressure discharge lamps (more particularly, super-high pressure mercury lamps) as light sources for image projection devices, for excellent properties, and the development of high-pressure discharge lamps have actively been carried out so as to meet the demand.

Under these circumstances, a high-pressure discharge lamp was developed in which cavities containing a rare gas and a mercury vapor were provided in sealing parts to allow the lamp to be started at low voltage. This lamp is disclosed in International Publication WO00/77826. FIGS. 2, 3(*a*) and 3(*b*) show the structure of this lamp. FIGS. 3(*a*) and 3(*b*) are a plan view and a side view of the structure of the lamp shown in FIG. 2, respectively.

A lamp 2000 shown in FIG. 2 is provided with cavities 150 in the sealing parts 101*a* and 101*b*, and an antenna 120 is arranged around the cavity 150 of the sealing part 101*b*. The antenna 120 is connected through a lead 121 to an outer lead of the sealing part 101*a*. A second antenna is arranged around a neck part between the sealing part 101*b* and the luminous bulb 100. Coils 112 are wound around the tips of the W electrodes 102. Here, the same numerals as in FIG. 1 denote the same members, and the descriptions thereof are not given.

The lamp 2000 allows discharge to occur between a metal foil 103 located in the cavity 150 in which gas is encapsulated and the antenna 120, thereby achieving its start at low voltage. The same international publication discloses that at the start of the lamp from a state where the lamp is cold (cold start), the lamp can start at a voltage of 1 kV.

However, as shown in FIGS. 3(*a*) and 3(*b*), the lamp 2000 has edges of the Mo foil 103 exposed to the inside of the cavity 150. Thus, there occurs a new problem that the discharge produced in the cavity 150 causes the deterioration of the Mo foil 103. When the use of the lamp causes the Mo foil 103 to be deteriorated, this results in a short lamp life. The reason is that the lamp 2000 including the sealing parts 101*a* and 101*b* holds the hermeticity of the inside of the luminous bulb 100 by foil sealing, as described above. That is, the lamp 2000 including the cavities 150 in the sealing parts, unlike the lamp 1000 shown in FIG. 1 and including no cavity 150, is less likely to become a practical high-pressure discharge lamp unless it is given the function of starting at low voltage as well as its life can be prevented from being shortened.

The present invention is made in view of the above-described problems, and it is a main object thereof to provide a discharge lamp that can start at low voltage and also suppress the deterioration of foils to prevent its life from being shortened.

DISCLOSURE OF INVENTION

A first discharge lamp of the present invention comprises a luminous bulb in which a luminous material is encapsulated and a pair of electrodes are arranged so as to be opposed to each other, and sealing parts that are formed at both ends of the luminous bulb and in which metal foils electrically connected to the pair of electrodes, respectively, are sealed, wherein: an antenna is provided around the perimeter of at least one of the sealing parts; a cavity in which at least a rare gas is encapsulated is formed in the at least one of the sealing parts; and a discharge inducing part provided in the metal foil or electrically connected to the metal foil is exposed to the cavity to prevent discharge between the antenna and an outer edge of the metal foil.

The discharge inducing part is preferably a cutout obtained by cutting out the central part of the metal foil.

It is preferable that the discharge inducing part is a middle portion of the metal foil exposed to the cavity and that the outer edges of the metal foil are covered with glass constituting the sealing part and are not exposed to the cavity.

The metal inducing part is preferably a wavy part of the metal foil.

It is preferable that the discharge inducing part is a metal bar and that the metal foil consists of a first metal foil and a second metal foil both coupled through the metal bar to each other.

The discharge inducing part is preferably a coil wound around the metal foil or the metal bar.

A second discharge lamp of the present invention comprises a luminous bulb in which a luminous material is encapsulated and a pair of electrodes are arranged so as to be opposed to each other, and sealing parts that are formed at both ends of the luminous bulb and in which metal foil structures electrically connected to the pair of electrodes, respectively, are sealed, wherein: at least one of the metal foil structures is composed of a first metal foil, a second metal foil, and a metal bar through which both of the first and second metal foils are coupled to each other; at least one of the sealing parts includes a cavity around the position where in the sealing part the metal bar is located; and at least a rare gas is encapsulated in the cavity.

According to a preferred embodiment, the first metal foil and the second metal foil are composed of molybdenum, and the metal bar is composed of a material selected from the group consisting of thoriated tungsten, tungsten and molybdenum.

According to a preferred embodiment, at least a part of the metal bar is exposed to the cavity, and the first metal foil and the second metal foil are covered with glass constituting the sealing part and are not exposed to the cavity.

A third discharge lamp of the present invention comprises a luminous bulb in which a luminous material is encapsulated and a pair of electrodes are arranged so as to be opposed to each other, and sealing parts that are formed at both ends of the luminous bulb and in which metal foil structures electrically connected to the pair of electrodes, respectively, are sealed, wherein: at least one of the metal foil structures is composed of a first metal foil, a second metal foil, and a metal bar through which both of the first and second metal foils are coupled to each other; the sealing part sealing the at least one of the metal foil structures includes a cavity around the position where in the sealing part the metal bar is located; at least a rare gas is encapsulated in the cavity; a coil is wound around the metal bar; and at least a part of the coil is exposed to the inside of the cavity.

According to a preferred embodiment, the coil is composed of thoriated tungsten or tungsten.

A part of the coil may be connected to a part of the metal bar by welding and the remainder of the coil may be wound around the metal bar so as to be located apart from the surface of the metal bar.

A fourth discharge lamp of the present invention comprises a luminous bulb in which a luminous material is encapsulated and a pair of electrodes are arranged so as to be opposed to each other, and sealing parts that are formed at both ends of the luminous bulb and in which metal foils electrically connected to the pair of electrodes, respectively, are sealed, wherein: the metal foil located in at least one of the sealing parts includes a cutout at its central part; the at least one of the sealing parts includes a cavity around the position where in the sealing part the cutout is located; and at least a rare gas is encapsulated in the cavity.

It is preferable that outer edges of the metal foil including the cutout are covered with glass constituting the sealing part and are not exposed to the cavity.

According to a preferred embodiment, the edge of the cutout included in the metal foil is exposed to the cavity, the edge defining the contour of the cutout, and the edge does not reach the outer edges of the metal foil.

A fifth discharge lamp of the present invention comprises a luminous bulb in which a luminous material is encapsulated and a pair of electrodes are arranged so as to be opposed to each other, and sealing parts that are formed at both ends of the luminous bulb and in which metal foils electrically connected to the pair of electrodes, respectively, are sealed, wherein: at least one of the sealing parts includes a cavity on the central part of the metal foil of the sealing part; at least a rare gas is encapsulated in the cavity; and in a part of the sealing part including the cavity, outer edges of the metal foil are covered with glass constituting the sealing part and are not exposed to the cavity.

A sixth discharge lamp of the present invention comprises a luminous bulb in which a luminous material is encapsulated and a pair of electrodes are arranged so as to be opposed to each other, and sealing parts that are formed at both ends of the luminous bulb and in which metal foils electrically connected to the pair of electrodes, respectively, are sealed, wherein: a coil is wound around the metal foil located in at least one of the sealing parts; and a cavity in which at least a rare gas is encapsulated exists around the coil located in the sealing part.

According to a preferred embodiment, the longer edges of the metal foil located in the at least one of the sealing parts are covered with the coil by half or less.

A seventh discharge lamp of the present invention comprises a luminous bulb in which a luminous material is encapsulated and a pair of electrodes are arranged so as to be opposed to each other, and sealing parts that are formed at both ends of the luminous bulb and in which metal foils electrically connected to the pair of electrodes, respectively, are sealed, wherein: a coil is provided on the metal foil located in at least one of the sealing parts; and a cavity in which at least a rare gas is encapsulated exists around the position where in the sealing part the coil is provided.

According to a preferred embodiment, the coil is placed within the surface area of the metal foil and is connected to the metal foil by welding.

The coil is preferably composed of thoriated tungsten.

An eighth discharge lamp of the present invention comprises a luminous bulb in which a luminous material is encapsulated and a pair of electrodes are arranged so as to be opposed to each other, and sealing parts that are formed at both ends of the luminous bulb and in which metal foils electrically connected to the pair of electrodes, respectively, are sealed, wherein: the metal foil located in at least one of the sealing parts includes a wavy part becoming wavy such that the upper surface and the bottom surface of the metal foil appear from above and below the end surface of the metal foil when viewed the metal foil from the luminous bulb side of the discharge lamp; and a cavity in which at least a rare gas is encapsulated exists around the wavy part located in the sealing part.

According to a preferred embodiment, the discharge lamp is a high-pressure mercury lamp in which mercury of 150 $mg/cm^3$ or more relative to the internal volume of the luminous bulb is encapsulated as the luminous material.

An antenna is preferably provided around the perimeter of the sealing part in which the cavity is located.

A lamp unit of the present invention comprises the discharge lamp and a reflecting mirror for reflecting light emitted from the discharge lamp.

A first method for fabricating a discharge lamp of the present invention, comprises the steps of: (a) preparing an electrode assembly including a metal foil structure, an electrode connected to the metal foil structure, and an outer lead connected to one end of the metal foil structure opposite to the other end thereof to which the electrode is connected, the metal foil structure comprising a first metal foil, a second metal foil and a metal bar coupling the first and second metal foils, the electrode being connected to the first metal foil, and the outer lead being connected to the second metal foil; (b) inserting the electrode assembly into a side pipe section of a discharge-lamp pipe including a luminous bulb section and the side pipe section extending from the luminous bulb such that the tip of the electrode is located in the luminous bulb section; and (c) after the step (b), putting the inside of the discharge-lamp pipe under a reduced pressure and softening the side pipe section by heat, thereby bringing the side pipe section into tight contact with the metal foil structure, wherein the step (c) comprises the steps of: (c-1) bringing a part of the side pipe section corresponding to the first metal foil into tight contact with the first metal foil; (c-2) bringing a part of the side pipe section corresponding to the second metal foil into tight contact with the second metal foil; and forming a cavity around the metal bar located in the side pipe through the steps (c-1) and (c-2).

According to a preferred embodiment, a coil is wound around the metal bar of the electrode assembly prepared in the step (a).

A part of the coil may be connected to a part of the metal bar by welding and the remainder of the coil may be wound around the metal bar so as to be located apart from the surface of the metal bar.

A second method for fabricating a discharge lamp of the present invention, comprises the steps of: (r) preparing an electrode assembly including a metal foil, an electrode connected to the metal foil, and an outer lead connected to one end of the metal foil opposite to the other end thereof to which the electrode is connected; (s) inserting the electrode assembly into a side pipe section of a discharge-lamp pipe including a luminous bulb section and the side pipe section extending from the luminous bulb such that the tip of the electrode is located in the luminous bulb section; and (t) after the step (s), putting the inside of the discharge-lamp pipe under a reduced pressure and softening the side pipe section by heat, thereby bringing the side pipe section into tight contact with the metal foil, wherein the step (t) comprises the steps of: (t-1) bringing a part of the side pipe section located toward the luminous bulb section into tight contact with a part of the metal foil located toward the electrode; (t-2) bringing a part of the side pipe section opposite to the luminous bulb section into tight contact with a part of the metal foil located toward the outer lead; and (t-3) bringing outer edges of a part of the metal foil located between a part of the metal foil located toward the electrode and a part of the metal foil located toward the outer lead into tight contact with a part of the side pipe section corresponding to the outer edges, thereby forming a cavity at the central part of the metal foil.

According to a preferred embodiment, in the step (t-3), the outer edges of the metal foil are brought into tight contact with the side pipe section by laser irradiation.

According to a preferred embodiment, the step (t-3) is executed simultaneously with either of the steps (t-1) and (t-2).

According to a preferred embodiment, the metal foil of the electrode assembly prepared in the step (r) includes a cutout formed in a part of the metal foil located between a part thereof located toward the electrode and a part thereof located toward the outer lead; and the edge of the cutout defining the contour thereof does not reach the outer edges of the metal foil.

A third method for fabricating a discharge lamp of the present invention, comprises the steps of: (w) preparing a discharge-lamp pipe including a luminous bulb section and a side pipe section extending from the luminous bulb section; (x) inserting a coil or a metal pipe into the side pipe section; (y) inserting an electrode assembly, which includes a metal foil, an electrode connected to the metal foil, and an outer lead connected to one end of the metal foil opposite to the other end thereof to which the electrode is connected, into the side pipe section such that the tip of the electrode is located in the luminous bulb section; and (z) after the steps (x) and (y), putting the inside of the discharge-pipe lamp under a reduced pressure and softening the side pipe section by heat, thereby bringing the side pipe section into tight contact with the metal foil with the coil or the metal pipe interposed therebetween.

According to a preferred embodiment, the method for fabricating a discharge lamp further comprises the step of forming a salient for positioning the coil or the metal pipe in a portion of the inner surface of the side pipe section of the discharge-lamp pipe in the step (w), the portion being located closer to the luminous bulb section, wherein the step (y) is executed after the step (x) is executed.

A fourth method for fabricating a discharge lamp of the present invention comprises the steps of: (α) preparing an electrode assembly including a metal foil on which a coil is provided, an electrode connected to the metal foil, and an outer lead connected to one end of the metal foil opposite to the other end thereof to which the electrode is connected; (β) inserting the electrode assembly into a side pipe section of a discharge-lamp pipe including a luminous bulb section and the side pipe section extending from the luminous bulb section such that the tip of the electrode is located in the luminous bulb section; and (γ) after the step (β), putting the inside of the discharge-lamp pipe under a reduced pressure and softening the side pipe section by heat, thereby bringing the side pipe section into tight contact with the metal foil with the coil interposed therebetween.

BEST MODE FOR CARRYING OUT THE INVENTION

Figure 1:
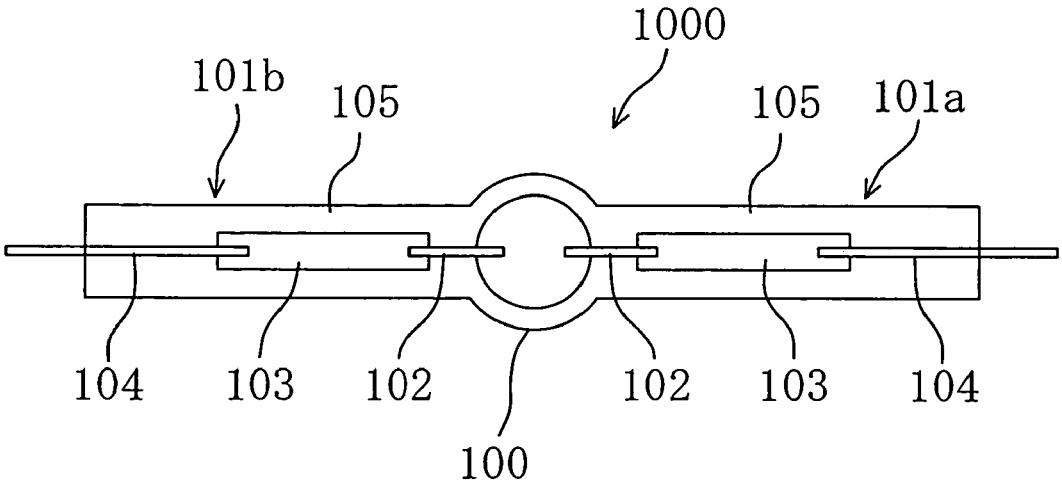
FIG. 1 PRIOR ART
FIG. 1 is a view schematically illustrating the structure of a known short-arc-type super-high pressure mercury lamp 1000.

Embodiments of the present invention will be described hereinafter with reference to the drawings. In the following drawings, for simplification of description, the same reference numerals denote components having substantially the same functions. Note that the present invention is not limited to the following embodiments.

Embodiment 1

Figure 4:
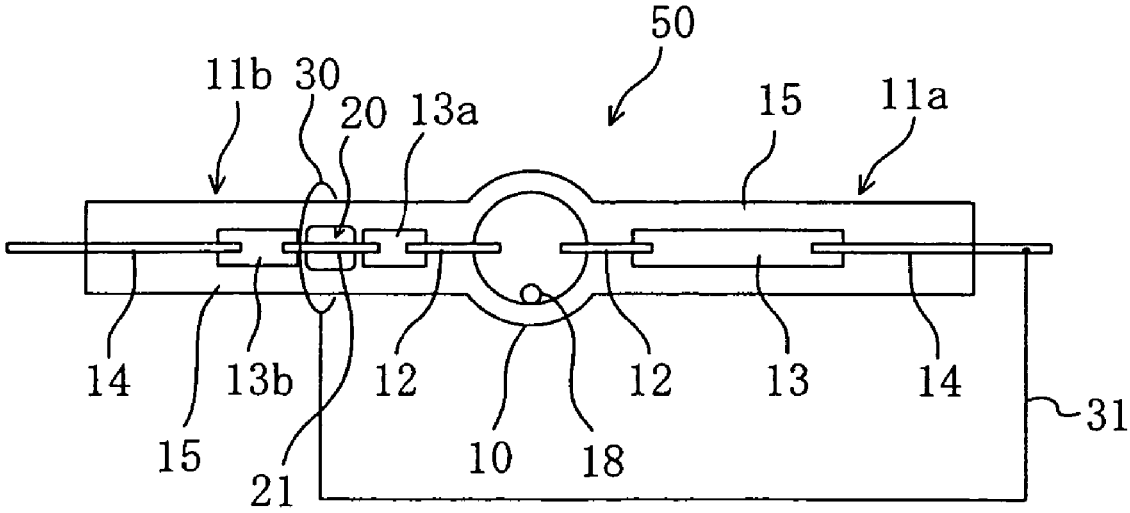
FIG. 4 is a view schematically illustrating the structure of a discharge lamp 50 according to a first embodiment of the present invention.

A discharge lamp 50 according to a first embodiment of the present invention will be described with reference to FIG. 4. FIG. 4 schematically illustrates the structure of the discharge lamp 50 according to this embodiment.

The discharge lamp 50 shown in FIG. 4 includes a luminous bulb (bulb) 10 and sealing parts 11*a* and 11*b* coupled to both ends of the luminous bulb 10. The sealing parts 11*a* and 11*b* are members for holding the hermiticity of the inside of the luminous bulb 10. The discharge lamp 50 is a double-ended lamp comprising two sealing parts. A luminous material 18 is encapsulated in the luminous bulb 10. A pair of electrodes 12 are arranged so as to be opposed to each other. Metal foil structures 13 are electrically connected to the pair of electrodes, respectively. The metal foil structure 13 located in the sealing part 11*a* consists of a metal foil (molybdenum foil). Outer leads 14 are electrically connected to parts of the metal foil structures 13 opposite to the electrodes 12, respectively, and are exposed from the ends of the sealing parts 11*a* and 11*b*, respectively. The outer leads 14 will be connected to ballast (not shown).

The metal foil structure 13 located in at least one sealing part 11*b* of the pair of sealing parts 11*a* and 11*b* is composed of a first metal foil 13*a*, a second metal foil 13*b* and a metal bar 21 coupling both of them (13*a* and 13*a*). A cavity 20 is formed around the position where in the sealing part 11*b* the metal bar 21 is located. The "metal foil structure" herein means a member including at least a metal foil, for example, a metal member composed of a metal bar and a metal foil or a metal member composed of only a metal foil. For simplification of description, the "metal foil structure" may simply be called a "metal foil".

At least a rare gas is encapsulated in the cavity 20, in which the same gas as in the luminous bulb 10 (for example, the rare gas and a mercury vapor) typically exists. An antenna 30 is provided around the perimeter of the sealing part 11*b* in which the cavity 20 is located. According to this embodiment, the antenna 30 is electrically connected through a lead 31 to the outer lead 14 exposed to the outside by extending from the end of the sealing part 11*a*. A second antenna serving as a so-called trigger line may be arranged around a neck part between the sealing part 11*b* and the luminous bulb 10 (approximately, the perimeter of the sealing part 11*b* in which the electrode 12 is embedded) as in the structure of the lamp shown in FIG. 2.

Figure 5A:
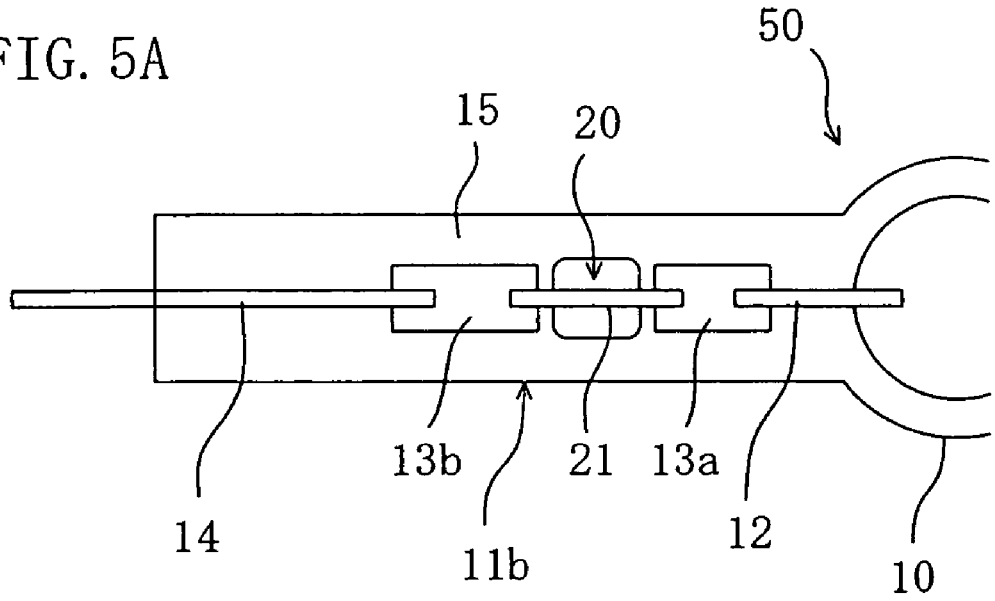
FIGS. 5(*a*) and 5(*b*) are a plan view and a side view illustrating a sealing part 11*b* of the discharge lamp 50, respectively.
Figure 5B:
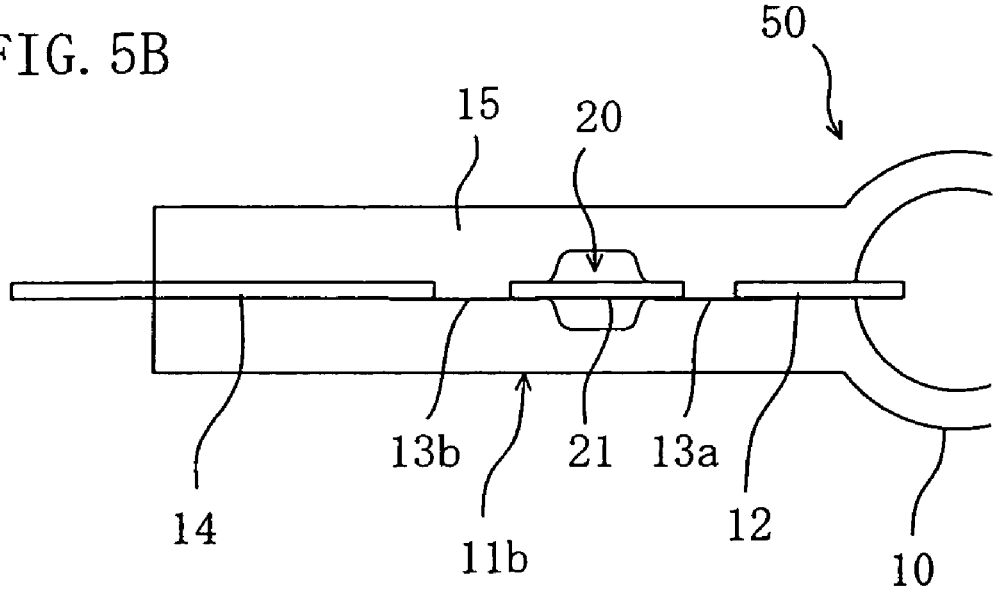

FIGS. 5(*a*) and 5(*b*) are partially enlarged views illustrating the sealing part 11*b* shown in FIG. 4. FIG. 5(*a*) schematically illustrates a plan structure, and FIG. 5(*b*) schematically illustrates a side structure.

As shown in FIGS. 5(*a*) and 5(*b*), according to the discharge lamp 50 of this embodiment, the cavity 20 is formed in the sealing part 11*b*. However, the first and second metal foils 13*a* and 13*b* are covered with a glass part 15, the metal bar 21 is exposed to the cavity 20, and thus the first and second metal foils 13*a* and 13*b* are not exposed to the cavity 20. Since the first and second metal foils 13*a* and 13*b* are not exposed to the cavity 20, the foils are not deteriorated even when an antenna (see numeral 30 in FIG. 4) is provided around the cavity 20 and the discharge occurs in the cavity 20. As a result, it can be prevented that the lamp life is shortened along with the deterioration of the foils. That is, the discharge is caused not by the metal foil and the antenna but by the metal bar (pin) 21 and the antenna so that the deterioration of the foils is not caused. Here, the metal bar 21 becomes a discharge inducing part.

The occurrence of a discharge in the cavity 20 causes ultraviolet radiation to be produced. This ultraviolet radiation flows into the luminous bulb 10 by a so-called optical-fiber effect and causes a material in the luminous bulb 10 (for example, a rare gas) to be optically pumped, thereby producing seed electrons. Consequently, it becomes possible that a dielectric breakdown between the electrodes 12 at the start is caused at lower voltage. That is, a discharge lamp starting at low voltage can be realized. In the case of the discharge lamp 50 according to this embodiment, at the start from the state where the lamp is cold (cold start), an open-circuit voltage of 940V (0-peak) is employed and a sine wave of 50 kHz is applied between lamp terminals (14) at 5.8 kV, using the ballast (ballast). Thus, the lamp can be started at a voltage of 2 kV or less (for example, 1 through 2 kV). This means that the lamp can be started at much lower voltage, as compared with the start voltage (for example, 10 through 15 kV) when no cavity 20 exists. Another effect can be obtained as follows: if the lamp can be started at a voltage of 2 kV or less (for example, 1 through 2 kV), the ballast (ballast) can be constituted without using a transformer. Since the lamp can be started at low voltage, noise produced at the start can also be reduced.

Conditions of the discharge lamp 50 according to this embodiment are described with an example as follows. The luminous bulb 10 of the lamp 50 has a generally spherical shape and is composed of silica glass. High purity silica glass with a low alkali-metal-impurity level (for example, 1 ppm or less) is preferably employed as the silica glass constituting the luminous bulb 10 in realizing a high-pressure mercury lamp (more particularly, a super-high pressure mercury lamp) showing excellent properties such as a long life. Certainly, silica glass with a normal alkali-metal-impurity level can also be employed. The outside diameter of the luminous bulb 10 is, for example, approximately 5 through 20 mm, and the glass thickness of the luminous bulb 10 is, for example, approximately I through 5 mm. The volume of the discharge space in the luminous bulb 10 is, for example, approximately 0.01 through 1 cc (0.01 through 1 $cm^3$). The luminous bulb 10 employed in this embodiment has an outside diameter of approximately 9 mm, an inside diameter of approximately 4 mm and a discharge space volume of approximately 0.06 cc.

The pair of electrodes (electrode bars) 12 are arranged in the luminous bulb 10 so as to be opposed to each other. The tips of the electrodes 12 are positioned in the luminous bulb 10 at an interval (arc length) D of approximately 0.2 through 5 mm (for example, 0.6 through 1.0 mm), and the pair of electrodes 12 are composed of tungsten (W). Coils (for example, coils made of tungsten) are preferably wound around the tips of the electrodes 12, respectively, for the purpose of reducing the temperatures of the electrode tips at lamp operation.

Mercury 18 is encapsulated as a luminous material in the luminous bulb 10. In the case of operating the lamp 50 as a super-high pressure mercury lamp, mercury 18 of approximately 150 mg/$cm^3$ or more (150 through 200 mg/$cm^3$ or more) relative to the internal volume of the luminous bulb 10, a rare gas (for example, argon) of 5 through 30 kPa and, as required, a small amount of halogen are encapsulated in the luminous bulb 10.

The halogen encapsulated in the luminous bulb 10 serves to perform a halogen cycle through which W (tungsten) evaporated from the electrodes 12 during the lamp operation is returned back to the electrodes 12, and the halogen is bromine, for example. The halogen to be encapsulated may have the form of a simple substance or but also the form of a halogen precursor (the form of a compound). According to this embodiment, halogen is introduced in the form of $CH_2Br_2$ into the luminous bulb 10. The amount of encapsulated $CH_2Br_2$ is approximately 0.0017 through 0.17 mg, which is equivalent to approximately 0.01 through 1 μmol/$cm^3$ when this amount is converted into the halogen atom density at the lamp operation. The strength of the lamp 50 against pressure (operating pressure) is 15 through 20 MPa or more. The bulb wall loading is approximately 60 W/$cm^2$ or more, for example, and an upper limit thereto is not especially set. For example, a lamp having a bulb wall loading ranging between approximately 60 W/$cm^2$ and 300 W/$cm^2$ (preferably, approximately 80 through 200 W/$cm^2$) can be achieved. The installation of cooling means enables a bulb wall loading of approximately 300 W/$cm^2$ or more to be achieved. The rated power is 150 W, for example (in this case, equivalent to a bulb wall loading of approximately 130 W/$cm^2$).

The volume of the cavity 20 in this embodiment is 0.01 through 0.05 $cm^3$, for example. At least a dischargeable gas is encapsulated in the cavity 20, and typically the same gas (rare gas, mercury vapor) as in the luminous bulb 10 is encapsulated therein. It is a feature of this fabricating process that the same gas as in the luminous bulb 10 is encapsulated in the cavity 20. Although the fabricating process becomes complicated, different gases can be encapsulated therein. A substance easily emitting electrons to facilitate the discharge, such as barium oxide and thoriated tungsten, can be placed in the cavity 20. In this embodiment, metal foils (13, 13*a* and 13*a*) and the edges thereof are not exposed to the inside of the cavity 20 at all. However, even when parts of the metal foils (13, 13*a* and 13*a*) are exposed, the other parts thereof are not exposed so that an effect of preventing foils from being deteriorated can be obtained, as compared with the structure of the lamp shown in FIG. 2 in which metal foils are exposed entirely to the inside of the cavity 20.

A metal bar (pin) 21 can be composed of, for example, tungsten or thoriated tungsten. It may be composed of molybdenum. In view of the cost thereof, a pin made of tungsien is preferably employed. However, when the discharge in the cavity 20 is to be caused more easily, a pin composed of thoriated tungsten easily emitting electrons is preferably employed. The structure of the lamp shown in FIG. 2 requires a molybdenum foil 103 to cause the discharge. However, even when the pin made of tungsten is employed as the metal bar 21, an action equivalent to that of the structure of the lamp shown in FIG. 2 can be performed.

The metal bar 21 is connected to the first and second metal foils 13*a* and 13*b* by welding, and the length and diameter of the metal bar 21 in this embodiment are 5.0 through 7.0 mm and 0.3 through 0.5 mm, respectively. The longitudinal length and width of each of the first and second metal foils 13*a* and 13*b* are 6.0 through 8.0 mm and 1.5 through 2.0 mm, respectively. The longitudinal length and width of the metal foil 13 are 15.0 through 20.0 mm and 1.5 through 2.0 mm, respectively. All of the first and second metal foils 13*a* and 13*b* and the metal foil 13 are composed of molybdenum.

Figure 6:
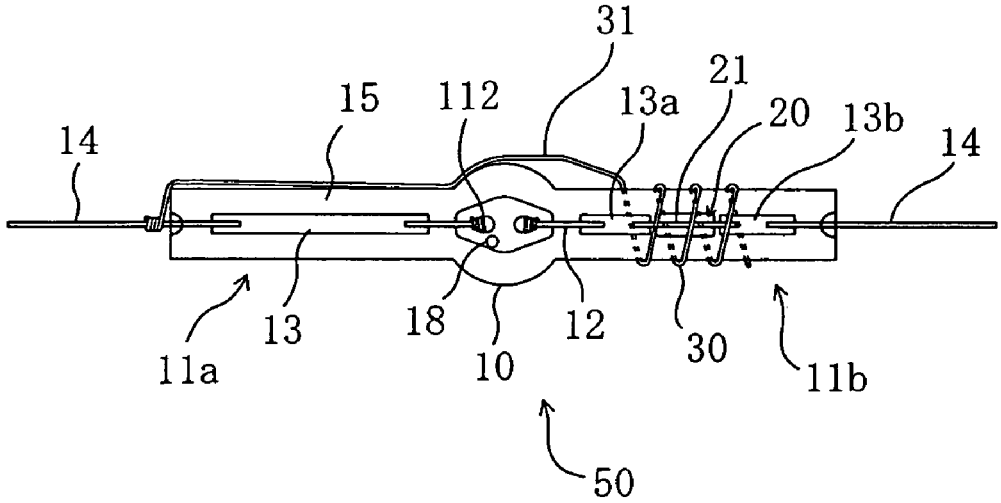
FIG. 6 is a view schematically illustrating the structure of the discharge lamp 50 according to the first embodiment.
Figure 7A:
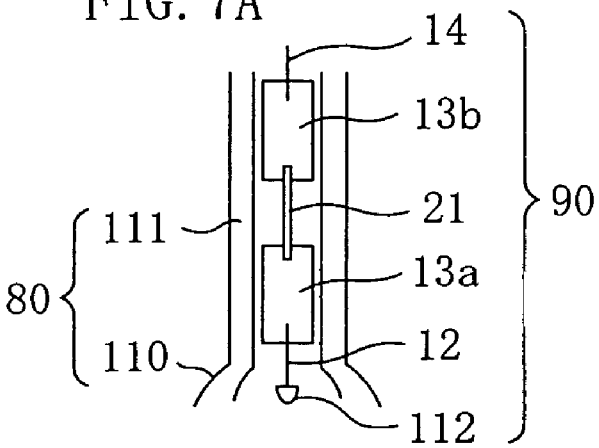
FIGS. 7(*a*) through 7(*d*) are diagrams of process steps for explaining a method for fabricating the discharge lamp 50 according to the first embodiment.
Figure 7B:
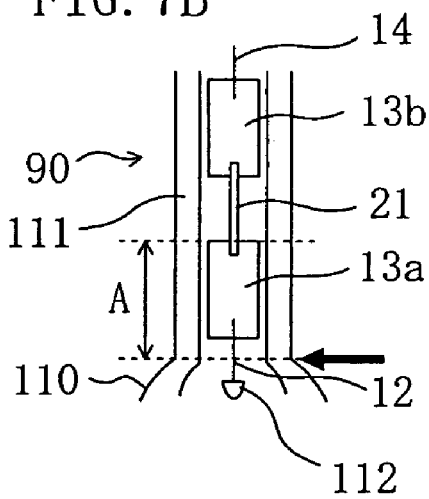
Figure 7C:
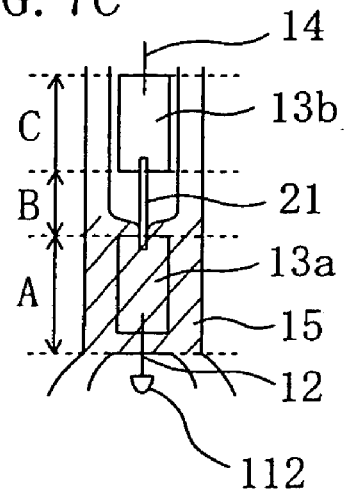
Figure 7D:
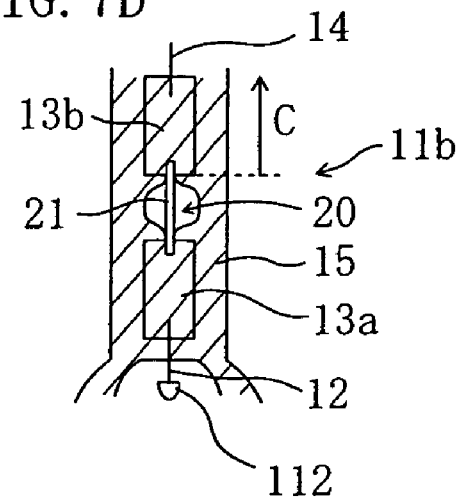
Figure 8A:
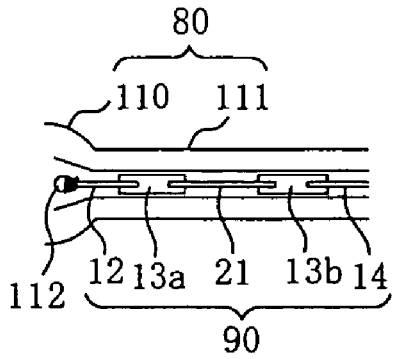
FIGS. 8(*a*) through 8(*e*) are diagrams of process steps for explaining the method for fabricating the discharge lamp 50 according to the first embodiment.
Figure 8B:
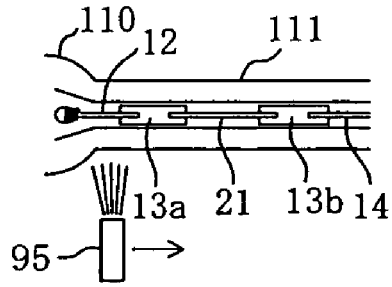
Figure 8C:
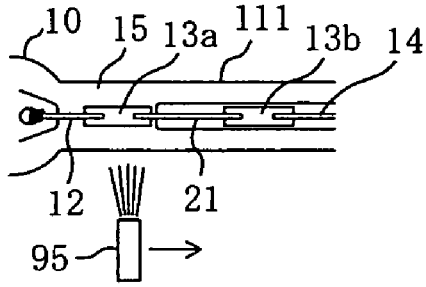
Figure 8D:
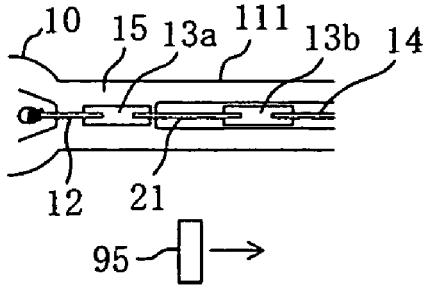
Figure 8E:
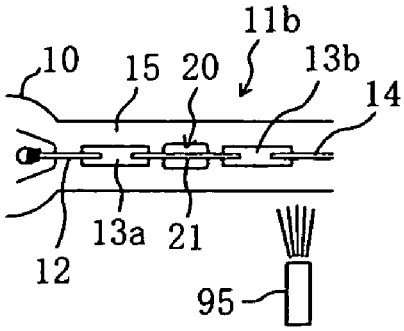

Although in the structure of the lamp shown in FIG. 4 the cavity 20 is provided only for the sealing part 11*b*, this is not restrictive. Cavities 20 may be provided for both of the sealing parts 11*a* and 11*b*. This results in achieving a lamp that can start at low voltage regardless of whether an antenna is provided for the sealing part 11*a* or the sealing part 11*b*. Although in the structure of the lamp shown in FIG. 4 a loop-shaped antenna 30 is provided, the lead 31 may be spirally wound around the sealing part 11*b* so as to become an antenna 30 as shown in FIG. 6. The spiral antenna 30 covers the whole cavity 20. Therefore, the discharge in the cavity 20 can also be performed more certainly.

Next, a method for fabricating a discharge lamp 50 according to this embodiment will be described with reference to FIGS. 7(*a*) through 7(*d*). FIGS. 7(*a*) through 7(*d*) are diagrams of process steps for explaining the fabricating method according to this embodiment.

First, as shown in FIG. 7(*a*), a discharge-lamp pipe (discharge-lamp glass pipe) 80 is prepared which includes a luminous bulb section 110 that becomes a luminous bulb (10) of a discharge lamp and a side pipe section 111 extending from the luminous bulb section 110, and thereafter an electrode assembly 90 is inserted into the side pipe section 111. The electrode assembly 90 is composed of an electrode 12, a first metal foil 13*a*, a metal bar 21, a second metal foil 13*b*, and an outer lead 14. The electrode 12 is connected to the first metal foil 13*a* by welding, and the outer lead 14 is connected to the second metal foil 13*b* by welding. The first and second metal foils 13*a* and 13*b* are coupled through the metal bar 21 to each other. A coil 112 is wound around the tip of the electrode 12.

The electrode assembly 90 is inserted into the side pipe section 111 and fixed such that the tip of the electrode 12 is located in the luminous bulb 10. The fixing of the electrode assembly 90 can be carried out by bringing a molybdenum tape or coil provided on a part of the outer lead 14 into tight contact with the inner wall of the side pipe section 111.

Next, as shown in FIGS. 7(*a*) through 7(*d*), the inside of the discharge-lamp pipe 80 is put under a reduced pressure and the side pipe section 111 is softened by heat, thereby bringing the first and second metal foils 13*a* and 13*b* of the electrode assembly 90 into contact with the side pipe section 111.

First, as shown in FIG. 7(*b*), a part of the side pipe section 111 corresponding to the first metal foil 13*a* (a region A) is brought into tight contact with the first metal foil 13*a*. Here, heating is performed from the vicinity of the border between the luminous bulb section 110 and the side pipe section 111 as shown by the arrow in this figure so that the part of the side pipe section 111 located in the region A is sealed up. Although in this embodiment the heating is carried out by a burner, the heating may be carried out by a laser (for example, a $CO_2$ variable laser). The burner and the laser can be used in combination.

When the part of the side pipe section 111 located in the region A is heated and sealed up, as shown in FIG. 7(*c*), the first metal foil 13*a* and the side pipe section 111 (in this figure, a glass part 15 shown by the diagonally shaded area) are brought into tight contact with each other. Thereafter, the burner is stopped over a part of the side pipe section 111 located in a region B, and next a part of the side pipe section 111 located in a region C is heated. The burner may also be moved, quickly within one second, past the part of the side pipe section 111 located in the region B, and thereafter the part of the side pipe section 111 located in the region C may be heated.

When the heating of the part of the side pipe section 111 located in the region C is completed, as shown in FIG. 7(*d*), the part of the side pipe section 111 corresponding to the second metal foil 13*b* (region C) and the second metal foil 13*b* are brought into tight contact with each other. Thus, the part of the side pipe section 111 located in the region B is not brought into tight contact with the metal bar 21, thereby forming a cavity 20 around the metal bar 21. In this way, a sealing part 11*b* including the cavity 20 can be obtained. When the cavities 20 are to be formed in both of the pair of sealing parts, the same process steps need be repeated. When the cavity 20 is to be formed only in one of the sealing parts, for example, a sealing part 11*a* including no cavity 20 is produced and thereafter a sealing part 11*b* including the cavity 20 is produced in the manner shown in FIGS. 7(*a*) through 7(*d*).

After a rare gas and mercury are introduced into the luminous bulb 10, the process steps shown in FIGS. 7(*a*) through 7(*d*) are undergone to form a cavity 20, resulting in the rare gas and the mercury vapor automatically encapsulated in the cavity 20. Although in the process steps shown in FIG. 7 sealing is performed from the luminous bulb section 110 side, the sealing can be performed from the opposite side thereto. A sealing part 11*b* including the cavity 20 may be initially produced before a sealing part 11*a* including no cavity 20 is produced.

According to the fabricating method of this embodiment, a sealing part formation step is carried out using the electrode assembly 90 including the first and second metal foils 13*a* and 13*b* whose lengths are both short. Therefore, the following other effect can be obtained: as compared with the case of using the one including a metal foil whose length is long, foil bending can be suppressed. Foil bending may lead to a variation in the distance between the electrodes. Therefore, this method has the huge advantage of being able to fabricate a discharge lamp while preventing foil bending.

FIGS. 8(*a*) through 8(*e*) more clearly illustrate the fabricating method of this embodiment by clearly showing a burner 95.

As shown in FIG. 8(*a*), the electrode assembly 90 is initially inserted into the side pipe section 111 of the discharge-lamp pipe 80, and thereafter, as shown in FIG. 8(*b*), the beating is performed from the luminous bulb section 110 side using the burner 95. Then, the burner 95 is moved in the arrow direction shown in this figure.

Next, when the sealing of the first metal foil 13*a* is completed as shown in FIG. 8(*c*), the heating of a part of the side pipe section 111 corresponding to the metal bar 21 is stopped, and then the burner 95 is moved as shown in FIG. 8(*d*).

Thereafter, as shown in FIG. 8(*e*), when the burner 95 reaches above a part of the side pipe section 111 corresponding to the second metal foil 13*b*, the heating is restarted to seal the second metal foil 13*b*.

Experiments of the present inventor has shown that it is preferable to determine the passing speed of the burner 95 by appropriately changing it in accordance with the ambient conditions (humidity, temperature, airflow or the like). This reason is as follows: even when the same lamp is produced, the favorable passing speed may be changed in accordance with the conditions of a place where it is produced (humidity, temperature, airflow or the like) and individual differences among fabricating devices.

Figure 9A:
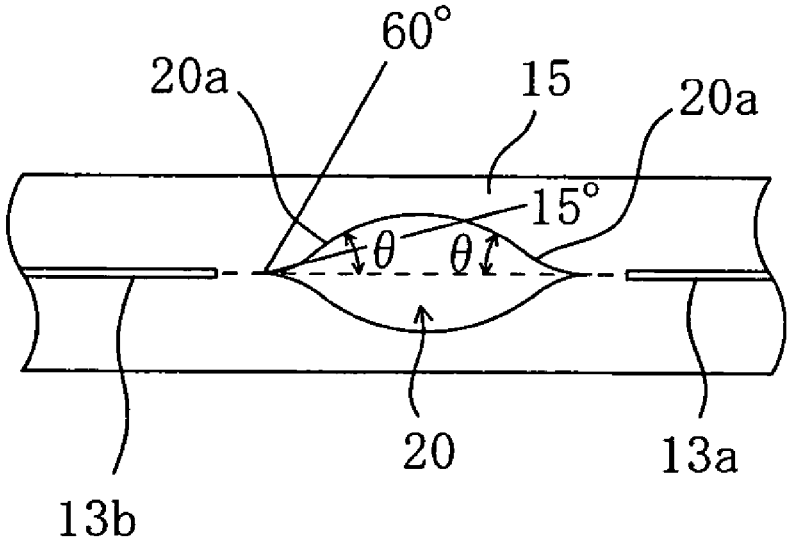
FIGS. 9(*a*) and 9(*b*) are views schematically illustrating the shape of a cavity 20.
Figure 9B:
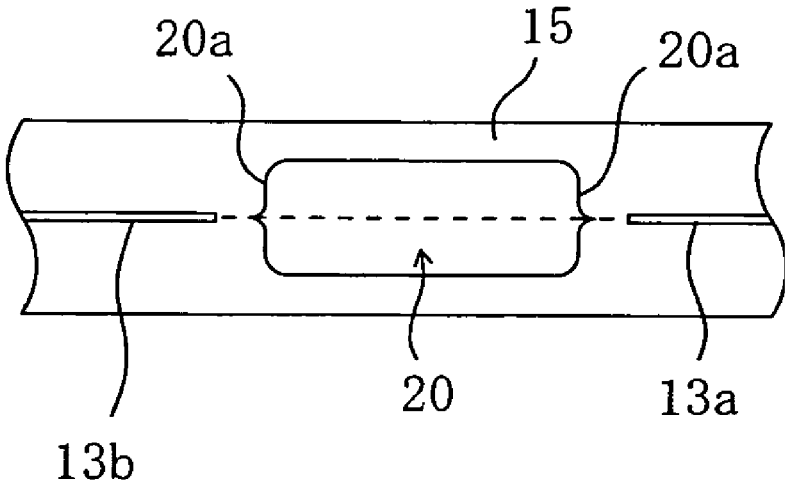

When the cavity 20 is formed using a burner, as shown in FIG. 9(*a*), the profile 20*a* of the cavity 20 (the contour of the glass part 15 defining the cavity 20) tends to extend diagonally relative to the longitudinal direction of the sealing part. In contrast, when the cavity 20 is formed using a laser, as shown in FIG. 9(*b*), the profile 20*a* tends to extend generally perpendicularly to the longitudinal direction of the sealing part so that a generally quadrangular (rectangular) cavity 20 is easily formed. Whether the cavity 20 is formed using the burner or the laser is appropriately selected in accordance with various conditions at fabrication. However, considering that the strength of the sealing part against external forces is to be maintained, it is preferable that the profile 20*a* extends diagonally. Considering that the strength thereof against external forces is to be maintained, it is desirable that the angle θ at which the profile 20*a* extends falls within the range of, for example, 15° to 60° (for example, approximately 30° or approximately 45°) with respect to the longitudinal direction of the sealing part (the direction along which the foil extends). FIG. 9 does not show the metal bar 21 so that the profile of the cavity 20 can be easily seen.

Embodiment 2

Figure 10:
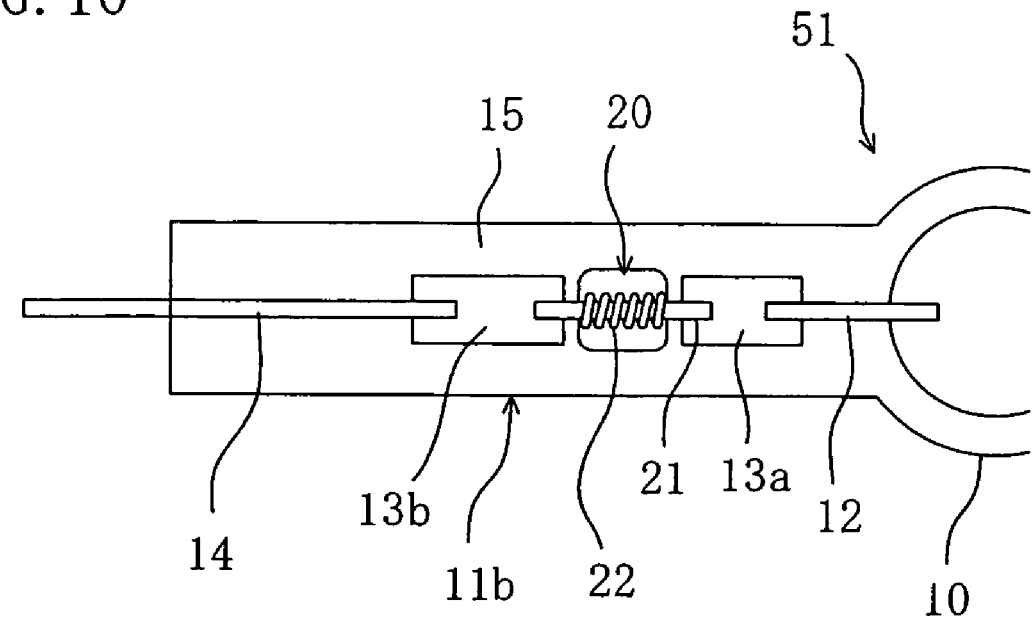
FIG. 10 is a partially enlarged view schematically illustrating the structure of a discharge lamp 51 according to a second embodiment.

Next, a discharge lamp according to a second embodiment of the present invention will be described with reference to FIG. 10. FIG. 10 schematically illustrates the structure of a sealing part 11*b* of a discharge lamp 51 according to the second embodiment.

The discharge lamp 51 shown in FIG. 10 is constructed such that a coil 22 is wound around a metal bar 21 of the discharge lamp 50 according to the above embodiment.

The other points are the same as in the structure of the above embodiment. Therefore, for the sake of simplicity, the descriptions are omitted or simplified with respect to the same contents.

With the structure of the lamp according to this embodiment, a coil 22 made of thoriated tungsten is wound around a metal bar 21, thereby facilitating the discharge between an antenna and the coil 22 or metal bar 21. The coil 22 may be made of tungsten. One obtained by applying thoriated tungsten to the coil made of tungsten may be used as the coil 22. In this embodiment, the coil 22 or metal bar 21 is a discharge inducing part.

Figure 11:
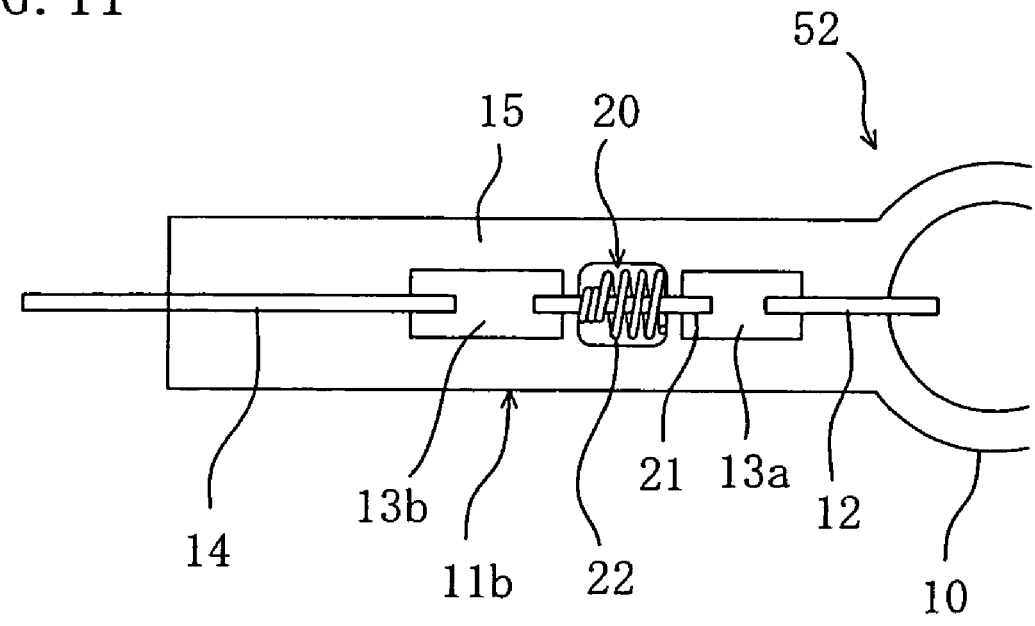
FIG. 11 is a partially enlarged view schematically illustrating the structure of a discharge lamp 52 according to the second embodiment.

In addition, as shown in FIG. 11, a part of the coil 22 may be welded to the metal bar 21, while the other part of the coil 22 may be wound around the metal bar 21 so as to be located apart from the metal bar 21. For a discharge lamp 52 shown in FIG. 11, the coil 22 can more effectively prevent an electrode from being displaced in a fabricating stage. More particularly, since the coil 22 comes into contact with the inside surface of the side pipe section, an electrode assembly (90) including an electrode (12) can be prevented from being displaced. Consequently, the arc length can be adjusted more simply and more accurately. Nowadays, the arc length of a super-high pressure mercury lamp has been shortened to an extremely short space of approximately 1 mm. Therefore, in regard to the adjustment thereof, as compared with the days when the arc length was relatively long, the effect of preventing the electrode displacement has become to have a significant meaning.

Figure 12A:
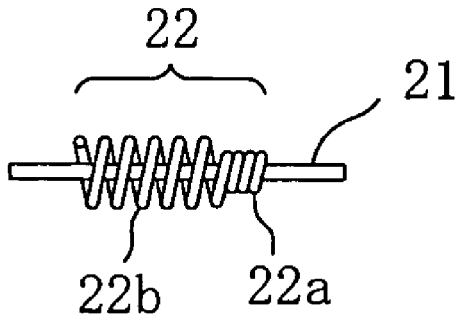
FIGS. 12(*a*) through 12(*c*) are diagrams of process steps for explaining a method for fabricating the discharge lamp 52 according to the second embodiment.
Figure 12B:
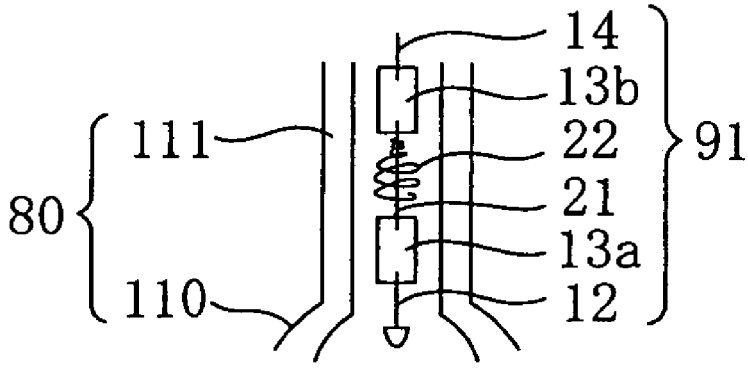
Figure 12C:
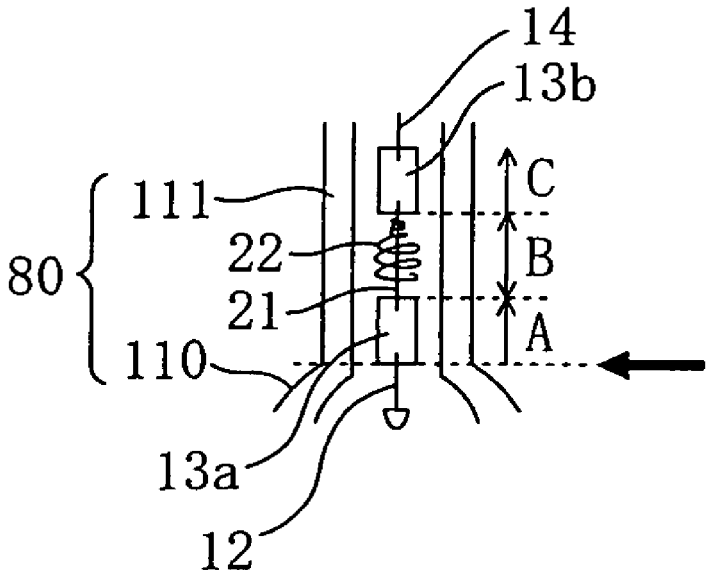
Figure 13A:
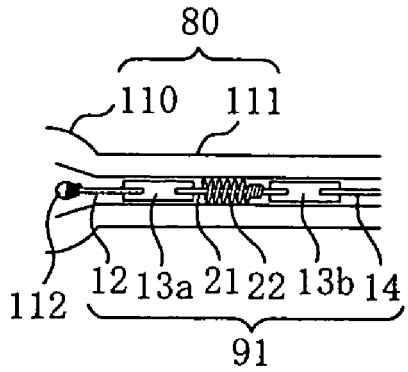
FIGS. 13(*a*) through 13(*e*) are diagrams of process steps for explaining the method for fabricating the discharge lamp 52 according to the second embodiment.
Figure 13B:
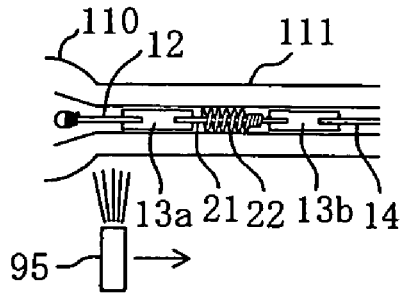
Figure 13C:
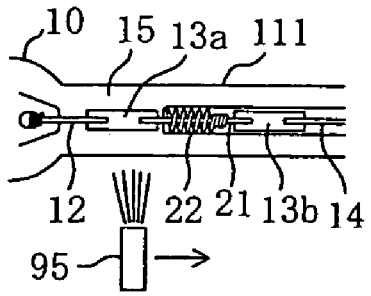
Figure 13D:
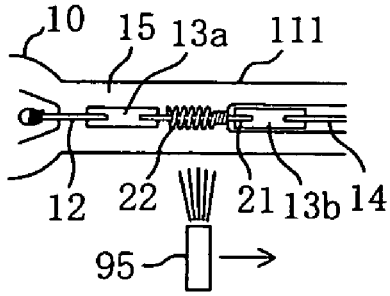
Figure 13E:
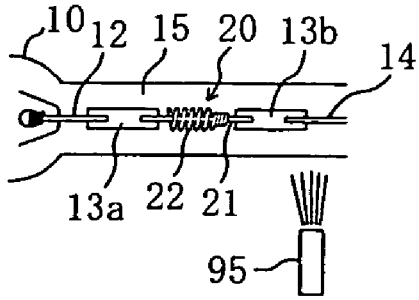

A method for fabricating the discharge lamp 51 is substantially similar to that of the above first embodiment except that a coil 22 is wound around a metal bar 21. Therefore, the method is not given herein. A method for fabricating the discharge lamp 52 will be described hereinafter. FIGS. 12(*a*) through 12(*c*) are diagrams of process steps for explaining the method for fabricating the discharge lamp 52 according to this embodiment.

First, as shown in FIG. 12(*a*), a coil 22 is welded to a metal bar 21 for coupling foils. The coil 22 is composed of thoriated tungsten or tungsten, and comprises a part 22*b* having a larger diameter than the part 22*a*. Here, the metal bar 21 having a diameter of 0.356 mm is used, and the part 22*b* of the coil has an inside diameter of approximately 1.9 mm. The diameter of the coil 22 is approximately 0.05 mm.

Next, an electrode assembly 91 including the metal bar 21 to which the coil 22 is welded, an electrode 12, an outer lead 14, first and second metal foils 13*a* and 13*b* is produced. Thereafter, as shown in FIG. 12(*b*), the electrode assembly 91 is inserted iflto a side pipe section 111 of a discharge-lamp glass pipe 80. The inside diameter of the side pipe section 111 is approximately 2.0 mm.

Next, as shown in FIG. 12(*c*), the side pipe section 111 is heated from a position shown by the arrow in this figure by a burner or a laser, thereby sealing regions A, B and C in this order. A glass part 15 constituting the side pipe section 111 cannot enter the inside of the coil 22 (more particularly, 22*b*) (i.e., closer to the metal bar 21). As a result, a cavity 20 is formed inside the coil 22. If a gap is to be provided between the coil 22 and the glass part 15 in consideration of a difference in coefficients of thermal expansion between the coil 22 and the glass part 15, this can be effected by allowing the burner (or the laser) to move past the region B without heating it or to move past the region B within one second.

FIGS. 13(*a*) through 13(*e*) more clearly illustrate a fabricating method of this embodiment by clearly showing a burner 95 as in FIG. 8.

As shown in FIG. 13(*a*), an electrode assembly 91 is initially inserted into a side pipe section 111 of a discharge-lamp glass pipe 80, and thereafter, as shown in FIG. 13(*b*), heating is performed from a luminous bulb section 110 side by using the burner 95. Then, the burner 95 is moved in the arrow direction shown in this figure.

Next, the sealing of a first metal foil 13*a* is completed as shown in FIG. 13(*c*). Thereafter, as shown in FIG. 13(*d*), while a part of the side pipe section 111 corresponding to a metal bar 21 around which a coil 22 is wound is being heated, the burner 95 is moved. The heating of the burner 95 may be stopped in the process step shown in FIG. 13(*d*).

Thereafter, as shown in FIG. 13(*e*), a part of the side pipe section 111 corresponding to a second metal foil 13*b* is heated, thereby sealing the second metal foil 13*b*. In this way, a sealing part 11*b* including a cavity 20 inside the coil 22 can be obtained.

Figure 14:
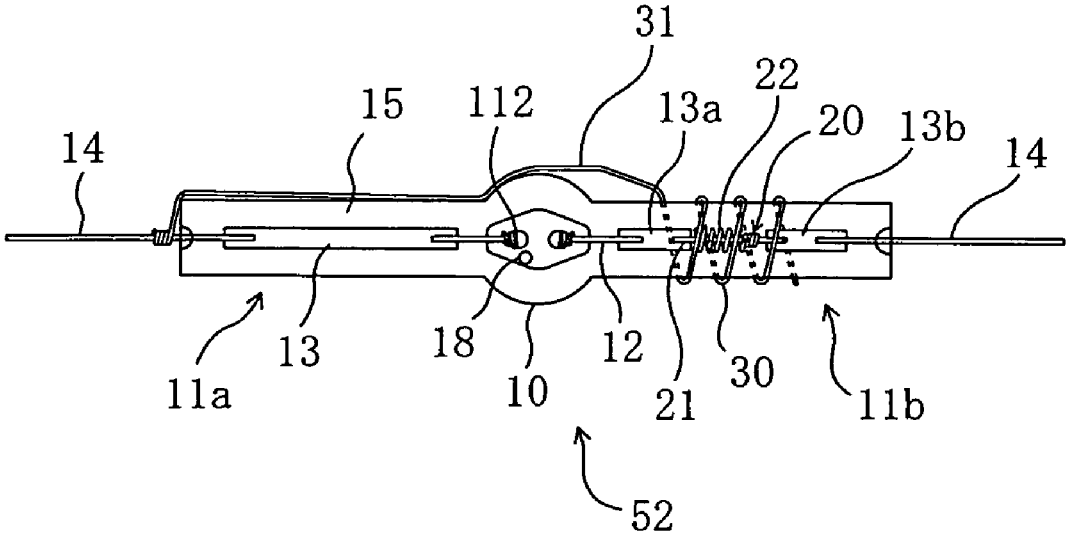
FIG. 14 is a view schematically illustrating the structure of the discharge lamp 52 according to the second embodiment.
Figure 15A:
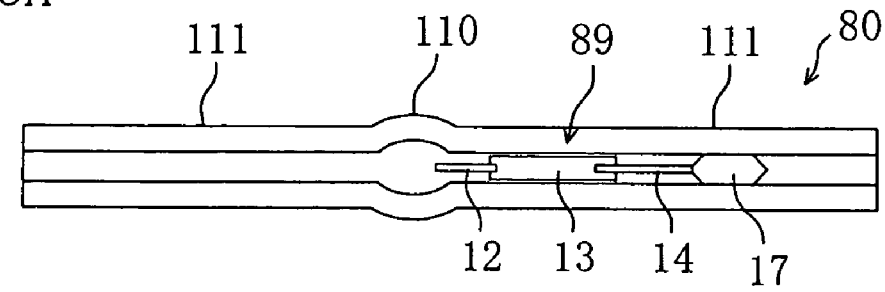
FIGS. 15(*a*) through 15(*d*) are diagrams of process steps for explaining the method for fabricating the discharge lamp 52 according to the second embodiment.
Figure 15B:
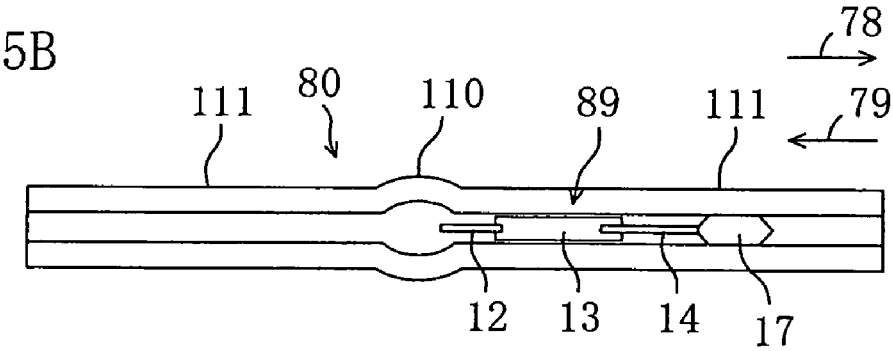
Figure 15C:
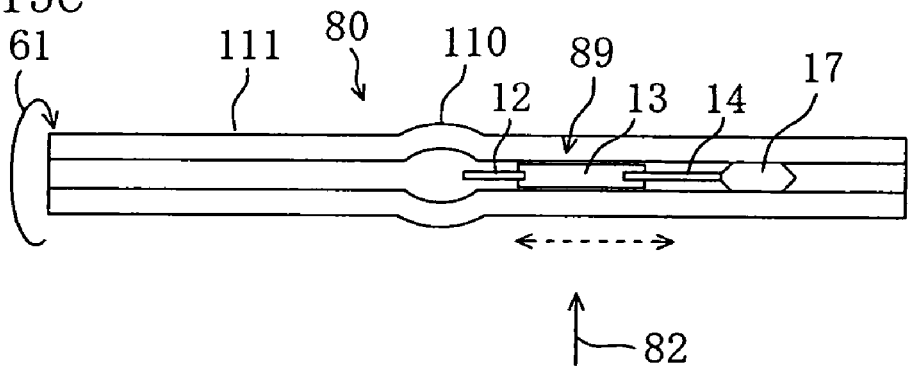
Figure 15D:
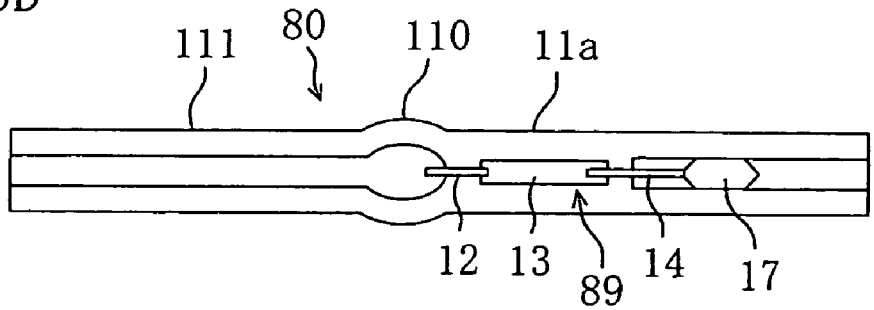
Figure 16A:
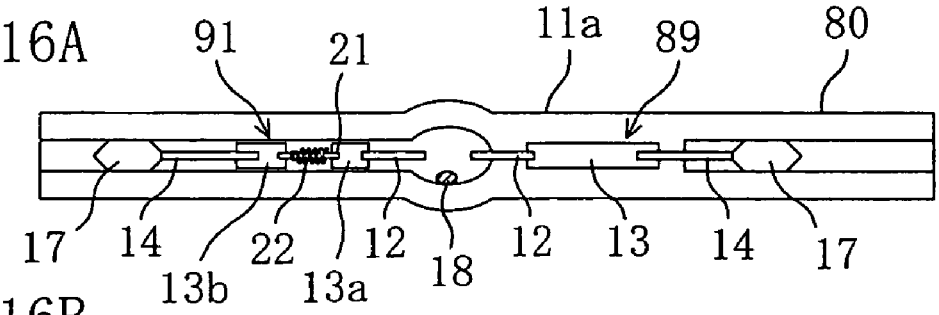
FIGS. 16(*a*) through 16(*e*) are diagrams of process steps for explaining the method for fabricating the discharge lamp 52 according to the second embodiment.
Figure 16B:
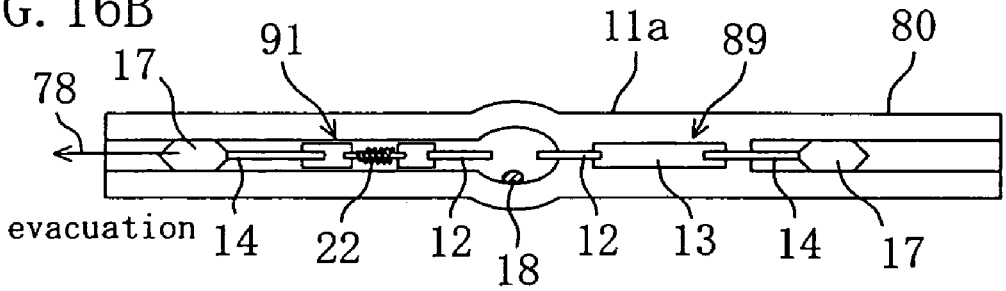
Figure 16C:
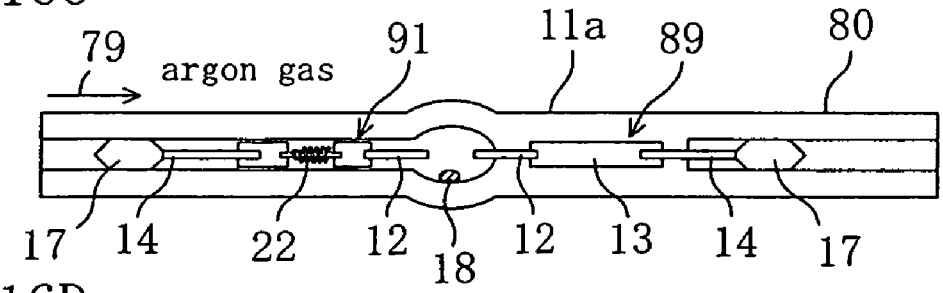
Figure 16D:
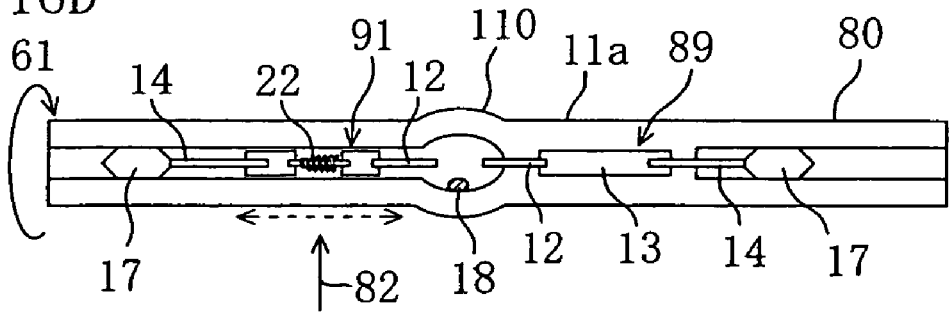
Figure 16E:
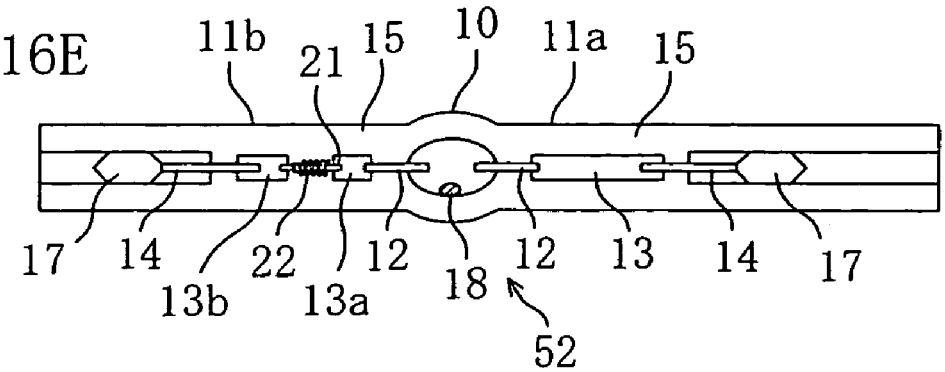

FIG. 14 shows a state where the resultant discharge lamp 52 is provided with an antenna. Referring to FIG. 14, an antenna 30 is obtained by spirally winding a lead 31 around the perimeter of the sealing part 11*b*. However, a loop-shaped antenna may be provided as shown in FIG. 4.

The method for fabricating the sealing part 11*b* was primarily described above. Now, a method for fabricating the whole discharge lamp (high-pressure mercury lamp) will be briefly described as follows. FIGS. 15 and 16 are diagrams of process steps for explaining a method for fabricating a discharge lamp according to an embodiment of the present invention.

First, as shown in FIG. 15(*a*), an electrode assembly 89 prepared by previously assembling an electrode 12, a molybdenum foil 13 and an outer lead 14 is inserted from one end of a side pipe section 111 of a discharge-lamp glass pipe 80 into the inside. This electrode assembly 89 is arranged such that the tip of the electrode 12 is located in a predetermined position in a section (luminous bulb section)

110 of the discharge-lamp glass pipe 80 that is to become a luminous bulb 10. A molybdenum tape 17 for fixing the electrode assembly 89 is provided at one end of the outer lead 14 of the electrode assembly 89. Thereby, the electrode assembly 89 can be fixed in an appropriate position.

After the state shown in FIG. 15(*a*) is obtained, as shown in FIG. 15(*b*), the inside of the glass pipe 80 is initially evacuated as generally shown by an arrow 78. Next, as generally shown by an arrow 79, a dry inert gas (for example, argon gas) having a subatmospheric pressure is introduced by approximately 50 mbr (about $5\times10^3$ Pa) or approximately 200 mbar (about $2\times10^4$ Pa).

Next, as shown in FIG. 15(*c*), while the glass pipe 80 is rotated as shown by an arrow 61, a section of the glass pipe 80 located in the vicinity of the electrode assembly 89 is heated. This heating is performed, for example, by a gas burner using oxyhydrogen, propane or the like, or by a laser using $CO_2$ or the like. This process step may be carried out in a state where the glass pipe 80 stands generally upright. In this case, it is preferably carried out in a state where the electrode assembly 89 is placed above the section (110) of the glass pipe 80 that is to become a light emitting part.

When the heating is accomplished to sufficiently keep the hermeticity of the molybdenum foil 13, the glass pipe 80 in which a sealing part 11*a* is formed is completed as shown in FIG. 15(*d*). The process step mainly shown in FIG. 15(*a*) is referred to as an electrode arrangement step (or an electrode assembly arrangement step), and the process step mainly shown in FIG. 15(*c*) is referred to as a sealing part formation step.

Subsequently, as shown in FIG. 16(*a*), mercury 18 that is a luminous material, and an electrode assembly 91 including a metal bar 21 around which a coil 22 is wound are inserted from an aperture end of a glass pipe (glass pipe in which the first electrode is sealed) 80 into the inside thereof The electrode assembly 91 is inserted and positioned in the glass pipe 80 such that one end of the electrode 12 of the inserted electrode assembly 91 is positioned about 1 mm apart from the tip of the sealing part 11*a* side electrode 12 in the section (110) of the glass pipe 80 that is to become the luminous bulb 10. A molybdenum tape 17 is provided also at one end of the outer lead 14 of the electrode assembly 91, thereby easily fixing the electrode assembly 91 in a predetermined position.

Next, as shown by an arrow 78 in FIG. 16(*b*), the inside of the glass pipe 80 is evacuated, and then a dry rare gas (for example, argon gas) is introduced by 200 mbr (about $2\times10^4$ Pa), for example, as shown by an arrow 79 in FIG. 16(*c*). At this time, a small amount of halogen gas (or a halogen precursor that will be decomposed into halogen) may be mixed with the rare gas.

Thereafter, in the same manner as shown in FIG. 15(*c*), as shown in FIG. 16(*d*), while the glass pipe 80 is rotated in an arrow 61 direction, a section of the glass pipe 80 located in the vicinity of the electrode assembly 91 is heated as generally shown by an arrow 82. This heating is performed, for example, by a gas burner using oxyhydrogen, propane or the like, or by a laser using $CO_2$ or the like. In the same manner as shown in FIG. 15(*c*), this process step may be carried out in a state where the glass pipe 80 stands generally upright. In this case, it is preferably carried out in a state where the electrode assembly 91 is placed above the section (110) of the glass pipe 80 that is to become a luminous bulb 10. In order to prevent the mercury 18 from evaporating, while the section 110 of the glass pipe 80 that is to become the luminous bulb 10 is cooled, for example, by liquid nitrogen, this heating process may be carried out. This sealing part formation step is as shown in FIGS. 13(*b*) through 13(*e*).

As shown in FIG. 16(*e*), a lamp 52 in which the luminous bulb 10 and the sealing parts 11*a* and 11*b* are formed is completed. Finally, unnecessary glass parts and the molybdenum tapes 17 are removed so as to expose the outer lead 14 to the outside and an antenna 30 is provided, thereby completing the lamp 52 as shown in FIG. 14.

Embodiment 3

Each of the high-pressure discharge lamps of the above first and second embodiments can become a mirror-mounted lamp or a lamp unit in combination with a reflecting mirror.

Figure 17:
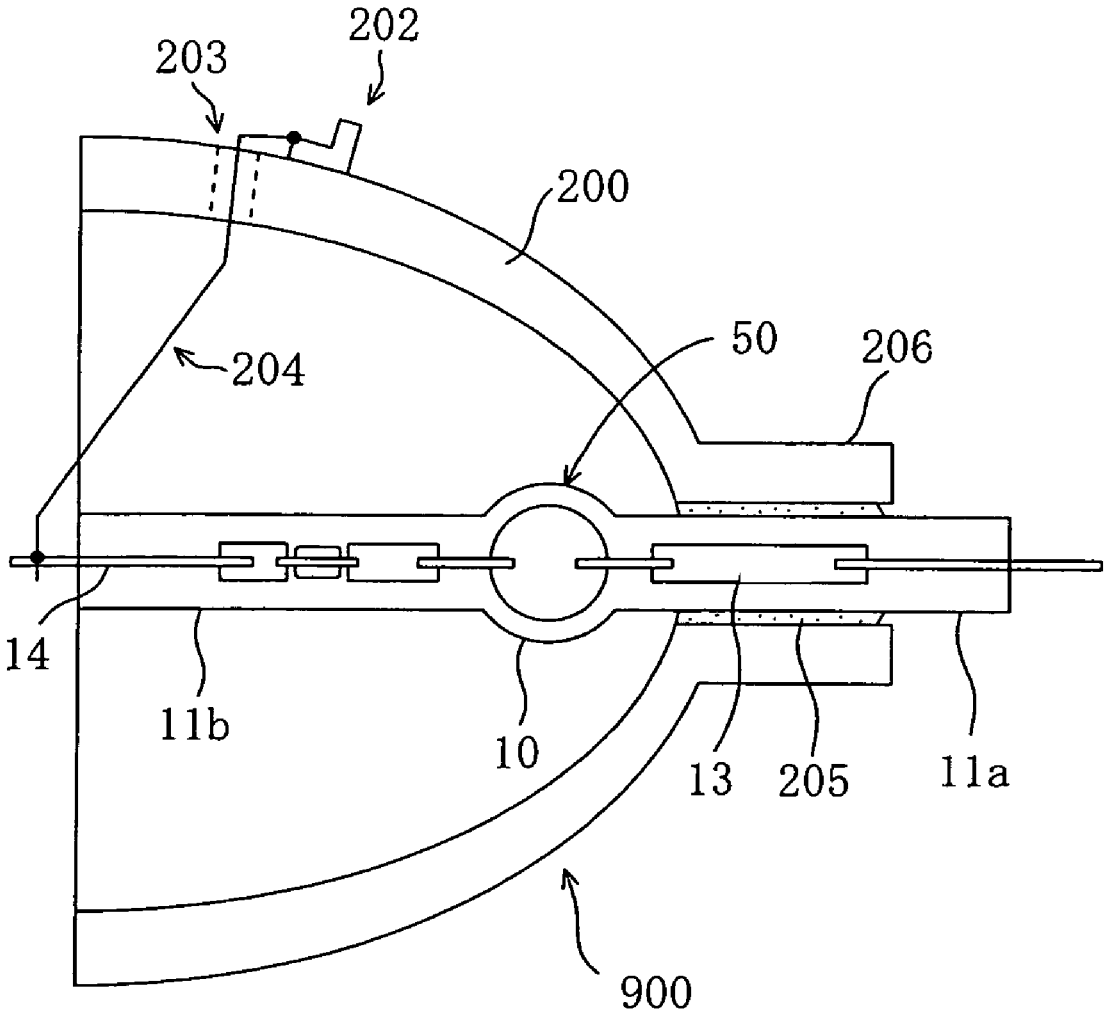
FIG. 17 is a view schematically illustrating a cross section of a mirror-mounted lamp (lamp unit) according to a third embodiment of the present invention.

FIG. 17 schematically illustrates the cross section of a mirror-mounted lamp 900 comprising the lamp 50 of the above first embodiment. The cross section is not hatched.

The mirror-mounted lamp 900 is composed of a lamp 50 and a reflecting mirror 200 for reflecting light emitted from the lamp 50. An antenna (not shown) is provided around the cavity 20 of the lamp 50. The lamp 50 is shown as an example, and thus the lamp 51 or 52 of the above embodiments may be used instead. The mirror-mounted lamp 900 may further comprise a lamphouse for holding a reflecting mirror 200. Here, the structure of the mirror-mounted lamp 900 comprising a lamphouse is included in a lamp unit.

The reflecting mirror 200 is made of heat-resistant glass whose inside surface is partly composed of a parabolic body, and a small hole 203 is provided at a part of the reflecting mirror 200 to draw a metal wire 204 therethrough. A fitting 202 made of stainless steel is mounted to the outside surface of the reflecting mirror 200. This fitting 202 is electrically connected with the conductive metal wire 204 that has been drawn through small hole 203 passing through the reflecting mirror 200 and has been electrically connected at one end thereof to the outer lead of the lamp 50.

The lamp 50 is fixed to the reflecting mirror 200 as shown in FIG. 17. If the reflecting mirror 200 is a parabolic mirror, the lamp 50 is fixed to the reflecting mirror 200 so that the most possible out of the light emitted by the lamp 50 can become light beams parallel to the virtual axis of rotation (also referred to as the optical axis) of the reflecting mirror 200 and can be output from an aperture. If the reflecting mirror 200 is an ellipsoidal mirror, the lamp 50 is fixed to the reflecting mirror 200 so that outgoing light can be brought to a focus on the optical axis. To be more specific about the structure, a sealing part 11*a* of the lamp 50 that does not include a cavity 20 is inserted into a neck part 206 of the reflecting mirror 200, and the lamp 50 is fixed to the reflecting mirror 200 with the sealing part 11*a* being fixed to the neck part 206 by heat-resistant cement 205. A front glass, for example, can be mounted to the front aperture of the reflecting mirror 200.

Although in this embodiment the sealing part 11*b* including the cavity 20 is provided in an aperture side of the reflecting mirror 200, the sealing part 11*b* can be provided in the neck part 206 side. However, when an antenna (30) is provided at the sealing part 11*b*, the sealing part 11*b* positioned in the neck part 206 may cause problems (for example, the sealing part 11*b* cannot be moved due to an antenna) in aligning (an illuminance-determining operation). Therefore, in consideration of the aligning, the sealing part 11*b* including the cavity 20 is preferably provided in the aperture side of the reflecting mirror 200.

As described above, the reflecting mirror 200 is constructed to reflect light emitted from the lamp 50 such that the light can become parallel beams, condensed beams converging to a predetermined small area, or divergent beams equivalent to those emitted from the predetermined small area. Recent projectors have been strongly required to be easily portable. Therefore, there has been a demand to develop and commercialize a thin projector having a small size close to the A5 size and the B5 size like a notebook-type personal computer. Under these circumstances, a smaller reflecting mirror the aperture diameter of which is smaller than 45 mm has been used for a high-pressure mercury lamp with a reflecting mirror. In addition, instead of a parabolic-mirror-type reflecting mirror emitting parallel light beams, use has been made, as a reflecting mirror 200, of an ellipsoidal-mirror-type reflecting mirror of short focal length in which the outgoing beams converge to a point (a focus). This is because the optical path length in a projector becomes short so as to further contribute to miniaturization of the projector.

Such a mirror-mounted lamp or a lamp unit can be mounted to, for example, an image projection device such as a projector using a liquid crystal and a DMD, and is employed as a light source for the image projection device. The image projection device can include, for example, a projector using a DMD (digital light processing (DLP) projector) and a liquid crystal projector (also including a reflection-type projector employing a LCOS (Liquid Crystal on Silicon) structure). Since the lamp according to this embodiment can start at low voltage, noise to be produced is also lessened accordingly.

Therefore, this lamp can be favorably applied also to an image projection device that is relatively noise-sensitive, such as a DLP projector.

The high-pressure discharge lamp and the mirror-mounted lamp or the lamp unit according to this embodiment can be used as not only a light source for an image projection device but also a light source for an ultraviolet stepper, a light source for a sports stadium, a light source for a headlight of an automobile, a light source for a spotlight for illuminating a road sign, or the like.

Embodiment 4

Figure 18:
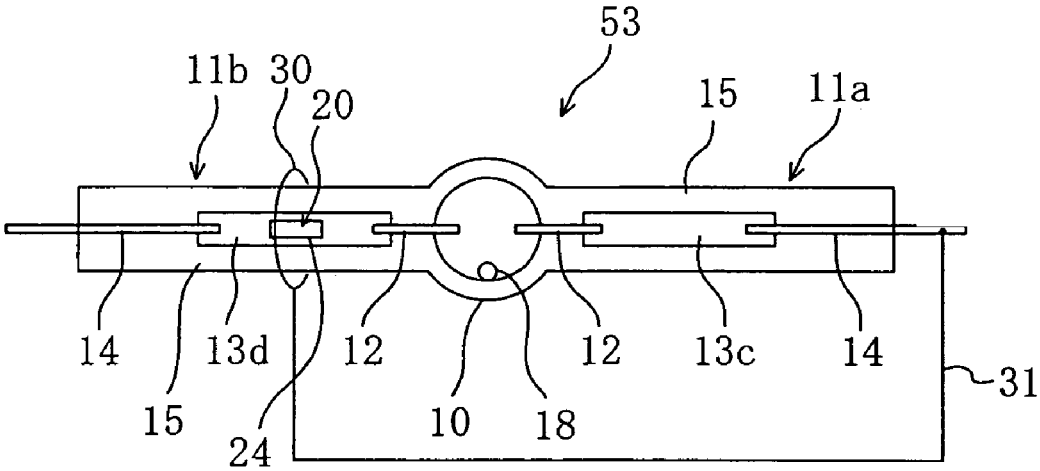
FIG. 18 is a view schematically illustrating the structure of a discharge lamp 53 according to a fourth embodiment of the present invention.

A discharge lamp according to this embodiment is distinct from the discharge lamp 50 according to the first embodiment in the constructions of their metal foil structures, and the other points are substantially the same. Thus, distinct points will be described with reference to FIG. 18. In this embodiment, the metal foil structures are metal foils 13*c* and 13*d*. FIG. 18 schematically shows the structure of a discharge lamp 53 according to this embodiment.

A metal foil 13*d* located in at least one sealing part 11*b* of a pair of sealing parts 11*a* and 11*b* includes a cutout (an aperture) 24 at its central part. A cavity 20 is formed around a part of the metal foil 13*d* in which the cutout 24 is located. At least a rare gas is encapsulated in the cavity 20, in which the same gas as in the luminous bulb 10 (for example, the rare gas and a mercury vapor) typically exists. An antenna 30 is provided around a section of the sealing part 11*b* in which the cavity 20 is located. According to this embodiment, the antenna 30 is electrically connected through a lead 31 to an outer lead 14 exposed by extending from one end of the sealing part 11*a*. A second antenna serving as a so-called trigger line may be arranged around a neck part between the sealing part 11*b* and the luminous bulb 10 (approximately, around a section of the sealing part 11*b* in which the electrode 12 is embedded) as in the structure of the lamp shown in FIG. 2.

Figure 19A:
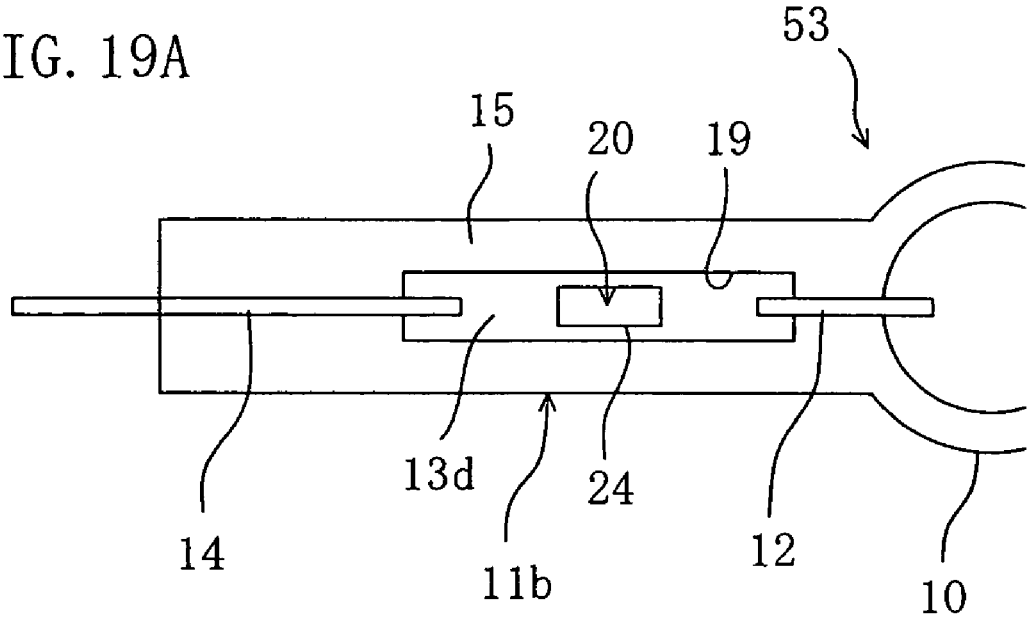
FIGS. 19(*a*) through 19(*b*) are a plan view and a side view illustrating a sealing part 11*b* of the discharge lamp 53, respectively.
Figure 19B:
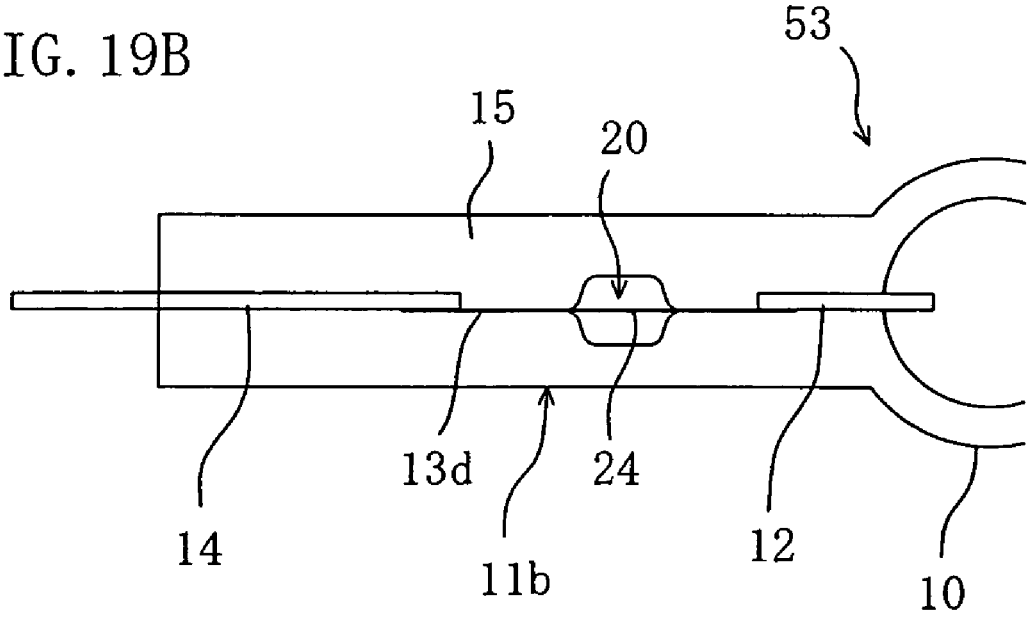

FIGS. 19(*a*) and 19(*b*) are partially enlarged views of the sealing part 11*b* shown in FIG. 18. FIG. 19(*a*) schematically shows the plan structure thereof, and FIG. 19(*b*) schematically shows the side structure thereof.

Although in the discharge lamp 53 of this embodiment a cavity 20 is formed in the sealing part 11*b* as shown in FIGS. 19(*a*) and 19(*b*), the outer edges 19 of the metal foil 13*d* including a cutout 24 are covered with a glass part 15 constituting the sealing part 11*b*. Therefore, the outer edges 19 of the metal foil 13*d* are not exposed to the cavity 20. Thus, even when an antenna (see numeral 30 in FIG. 18) is provided around the cavity 20 and the discharge occurs in the cavity 20, the deterioration in the foil due to the discharge can be suppressed as compared with the structure shown in FIGS. 2 and 3. This reason is that the outer edges (longer edges) 19 are not exposed to the cavity 20. That is, although according to the structure of the lamp shown in FIGS. 2 and 3 the outer edges of the metal foil 103 exposed to the inside of the cavity 150 primarily suffer damage due to the discharge, the sensitive outer edges 19 of the metal foil 13*d* are covered with the glass part 15 in the structure of the lamp of this embodiment. Therefore, the deterioration in the foil due to the discharge can be suppressed. Although according to the lamp 53 of this embodiment the discharge occurs between the antenna and the metal foil 13*d*, the outer edges 19 do not suffer damage as compared with the structure of a lamp in which the outer edges of a metal foil are exposed to the inside of a cavity (FIGS. 2 and 3), resulting in no loss of hermeticity. That is, the deterioration in the foil (more particularly, the deterioration in the outer edge thereof) can be suppressed, thereby restraining the lamp life from being shortened.

Also according to this embodiment, the occurrence of a discharge in the cavity 20 causes ultraviolet radiation to be produced. The energy caused by the discharge flows into the luminous bulb 10 by a so-called optical-fiber effect and causes a material in the luminous bulb 10 (for example, a rare gas) to be optically pumped, thereby producing seed electrons. Consequently, it becomes possible that a dielectric breakdown between the electrodes 12 at the start is caused at lower voltage. That is, a discharge lamp starting at low voltage can be realized. In the case of the discharge lamp 53 according to this embodiment, at the start from the state where the lamp is cold (cold start), an open-circuit voltage of 940V (0-peak) is employed and a sine wave of 50 kHz is applied between lamp terminals (14) at 5.8 kV, using the ballast (ballast). Thus, the lamp can be started at a voltage of 2 kV or less (for example, 1 through 2 kV). This means that the lamp can be started at much lower voltage, as compared with the start voltage (for example, 10 through 15 kV) when no cavity 20 exists. Another effect can be obtained as follows: if the lamp can be started at a voltage of 2 kV or less (for example, 1 through 2 kV), the ballast (ballast) can be constituted without using a transformer. Since the lamp can be started at low voltage, noise produced at the start can also be reduced.

According to the discharge lamp 53 of this embodiment, a substance easily emitting electrons to facilitate the discharge, such as barium oxide and thoriated tungsten, can be placed in the cavity 20. The placement of such a substance in the cavity 20 allows the damage of the metal foil 13*d* including the cutout 24 due to the discharge to be further reduced.

In this embodiment, metal foils 13*c* and 13*d* and the outer edges (19) thereof are not exposed to the cavity 20 at all except the edges of the cutout 24 of the metal foil 13*d*. However, even when in the structure of the lamp of this embodiment parts of the metal foils 13*c* and 13*d* are exposed except the edges of the cutout 24, the other parts thereof are not exposed so that an effect of preventing foils from being deteriorated can be obtained, as compared with the structure of the lamp shown in FIG. 2 in which metal foils are mostly exposed to the insides of cavity 150.

The shape of the cutout 24 in this embodiment is generally rectangular. However, unless the edges of the cutout 24 defining the contour thereof reach the outer edges 19 of the metal foil 13*d*, its shape is not particularly restricted. More specifically, the cutout 24 need only be formed at the central part of the metal foil 13*d* excluding a part of the metal foil 13*d* reaching the outer edges 19 thereof This shape may be, for example, a square, a rectangle, a rhombus, a circle, an ellipse, an oval, a triangle, or a polygon such as a pentagon and a hexagon. In the structure of the lamp of this embodiment, the edges of the cutout 24 are exposed to the cavity 20. However, as long as the cavity 20 is formed in the edges of the cutout 24 or around there, the edges of the cutout 24 may be at least partly covered with the glass part 15.

The cutout 24 in the structure of the lamp shown in FIG. 19 has, for example, an area of 3.0 through 8.0 $mm^2$ and a size of 1.0 through 1.4 mm×3.0 through 6.0 mm. The longitudinal length and width of each of the metal foils 13*c* and 13*d* are 15 through 40 mm and 1.5 through 2.0 mm, respectively. Both of the metal foils 13*c* and 13*d* are composed of molybdenum.

Although in the structure of the lamp shown in FIG. 18 the cutout 24 and the cavity 20 are provided only for the sealing part 11*b*, this is not restrictive. The cutouts 24 and the cavities 20 may be provided for both of the sealing parts 11*a* and 11*b*. This results in achieving a lamp that can start at low voltage regardless of whether an antenna is provided for the sealing part Ha or the sealing part 11*b*.

Figure 21A:
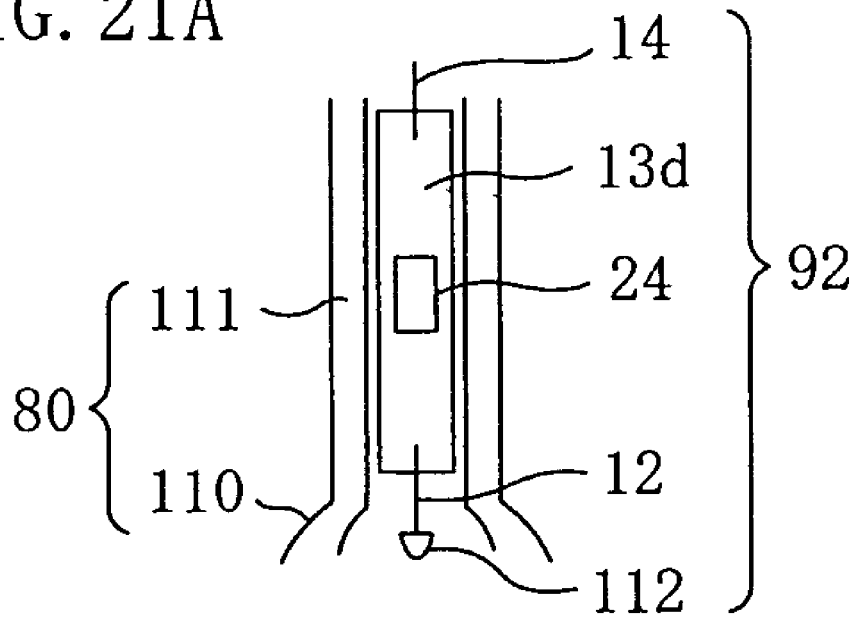
FIGS. 21(*a*) and 21(*b*) are diagrams of process steps for explaining a method for fabricating the discharge lamp 53 according to the fourth embodiment.
Figure 21B:
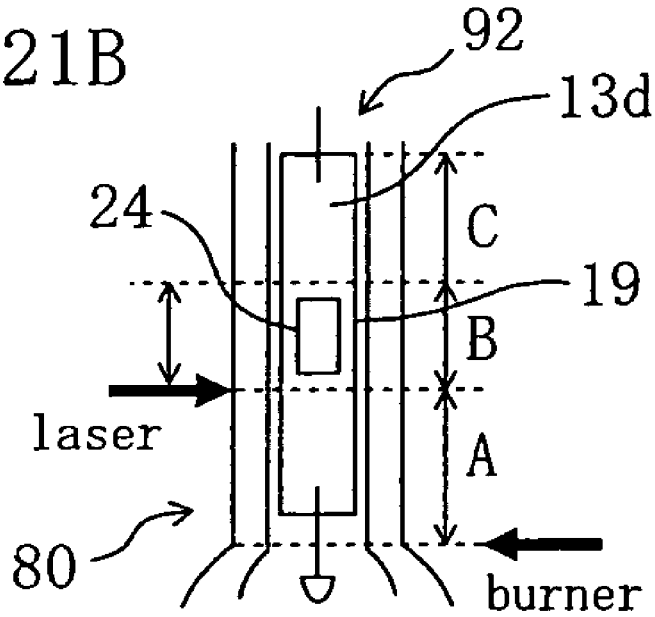
Figure 22A:
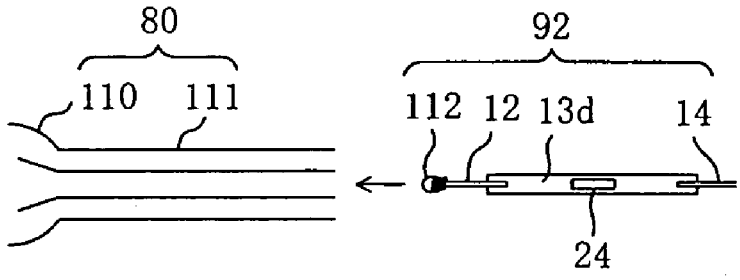
FIGS. 22(*a*) through 22(*e*) are diagrams of process steps for explaining the method for fabricating the discharge lamp 53 according to the fourth embodiment.
Figure 22B:
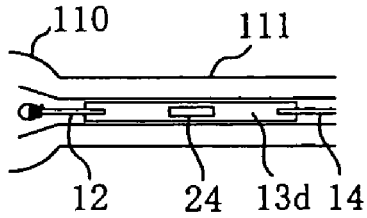
Figure 22C:
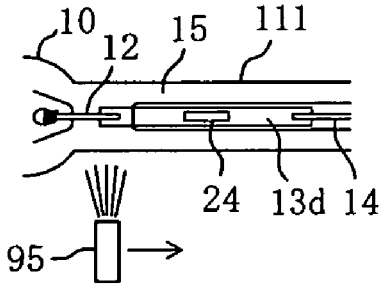
Figure 22D:
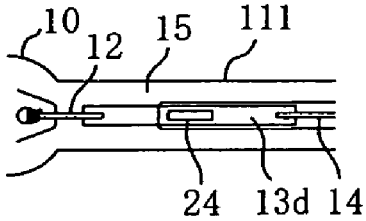
Figure 22E:
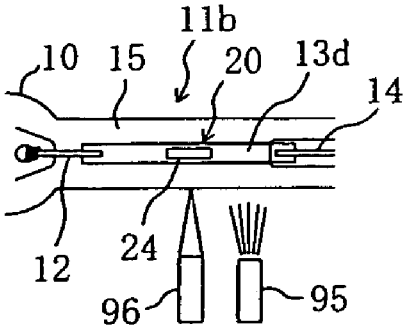

Next, a method for fabricating a discharge lamp 53 according to this embodiment will be described with reference to FIGS. 21(*a*) and 21(*b*). FIGS. 21(*a*) and 21(*b*) are diagrams of process steps for explaining the fabricating method of this embodiment.

First, as shown in FIG. 21(*a*), a discharge-lamp pipe (discharge-lamp glass pipe) 80 is prepared which includes a luminous bulb section 110 that becomes a luminous bulb (10) of a discharge lamp and a side pipe section 111 extending from the luminous bulb section 110, and thereafter an electrode assembly 92 is inserted into the side pipe section 111. The electrode assembly 92 is composed of an electrode 12, a metal foil 13*d* including a cutout 24, and an outer lead 14. The electrode 12 and the outer lead 14 are connected to one end and the other end of the metal foil 13*d* by welding, respectively. A coil 112 is wound around the tip of the electrode 12.

The electrode assembly 92 is inserted into the side pipe section 111 and fixed such that the tip of the electrode 12 is located in the luminous bulb 10. The fixing of the electrode assembly 92 can be carried out by bringing a molybdenum tape or a coil provided on a part of the outer lead 14 into contact with the inner wall of the side pipe 11.

Subsequently, the inside of the discharge-lamp pipe 80 is put under a reduced pressure and the side pipe section 111 is softened by heat, thereby bringing the metal foil 13*d* of the electrode assembly 92 into tight contact with the side pipe section 111.

Here, as shown in FIG. 21(*b*), there are carried out a process step for bringing a part (A) of the side pipe section 111 located toward the luminous bulb section 110 into tight contact with a part of the metal foil 13*d* located toward the electrode 12 and a process step for bringing a part (B) of the side pipe section 111 located opposite to the luminous bulb section 110 side part into tight contact with a part of the metal foil 13*d* located toward the outer lead 14. In addition, there is carried out a process step for bringing the outer edges 19 of a part of the metal foil 13*d* (a part of the metal foil 13*d* located around the cutout 24) located between the part of the metal foil 13*d* toward the electrode 12 and the part thereof toward the outer lead 14 into tight contact with a part (B) of the side pipe section 111 corresponding to the outer edges 19 of that part of the metal foil 13*d*. This results in the formation of a cavity 20 at the central part of the metal foil 13*d*.

As shown in FIG. 21(*b*), the part of the metal foil 13*d* located toward the electrode 12 represents a part of the metal foil 13*d* located closer to the electrode 12 than the edge of the cutout 24 located toward the electrode 12. The part of the metal foil 13*d* located toward the outer lead 14 represents a part of the metal foil 13*d* located closer to the outer lead 14 than the edge of the cutout 24 located toward the outer lead 14.

According to this embodiment, first, a part of the side pipe section 111 located in a region A is heated by a burner to complete the adhesion of the part of the side pipe section 111 located in the region A to the metal foil. Thereafter, a part of the side pipe section 111 located in a region C starts being heated by a burner. Simultaneously, a part of the side pipe section 111 located in a region B is heated by a laser. This heating process allows part of the outer edges 19 of the metal foil 13*d* corresponding to the region B to be covered with the part of the side pipe section 111 located in the region B. The reason why a laser is employed is that local heating is easily performed. The region B may be heated using the burner by selecting various conditions. However, when the region B, like the regions A and C, is heated by the burner, sealing might be completed to the extent that the cavity 20 is lost, and therefore caution is required.

The reason why the heating processes for the regions B and C are simultaneously carried out is that the time of the sealing part formation step can be shortened. These heating processes can separately be carried out instead of simultaneously carrying out the same. For example, the heating process for the region B may be carried out after the heating process for the region C. A laser can also be used for the heating of the regions A and C. A $CO_2$ variable laser, for example, can be used as the laser.

When the heating of the regions A, B and C is completed in the above-mentioned manner, a cavity (20) is formed in a position of the cutout 24 or around there. In this way, a sealing part 11*b* including the cavity 20 can be obtained. When cavities 20 are formed in both of the pair of sealing parts, the same process steps need be repeated. When a cavity 20 is formed only in one of the sealing parts, for example, a sealing part 11*a* including no cavity 20 is produced before the sealing part 11*b* including the cavity 20 is produced in the manner shown in FIGS. 21(*a*) and 21(*b*).

After a rare gas and mercury are introduced into the luminous bulb 10, the process steps shown in FIGS. 21(*a*) and 21(*b*) are undergone to form the cavity 20, resulting in the rare gas and the mercury vapor automatically encapsulated in the cavity 20. Although in the process steps shown in FIG. 21 the sealing is performed from the luminous bulb section 110 side, the sealing can be performed from the opposite side thereto. The sealing part 11*b* including the cavity 20 may initially be produced before the sealing part 11*a* including no cavity 20 is produced.

FIGS. 22(*a*) through 22(*e*) more clearly illustrate the fabricating method of this embodiment by clearly showing a burner 95.

As shown in FIG. 22(*a*), an electrode assembly 92 is initially inserted into a side pipe section 111 of a discharge-lamp pipe 80, and thereafter, as shown in FIG. 22(*b*), the electrode assembly 92 is fixed to the side pipe section 111. The inside diameter of the side pipe section 111 is approximately 2.0 mm.

Next, as shown in FIG. 22(*c*), heating is performed using a burner 95 from the luminous bulb section 110 side, and the burner 95 is moved in the arrow direction shown in this figure. When the sealing of a part of a metal foil 13*d* located toward the luminous bulb section 110 is completed, the state shown in FIG. 22(*d*) is obtained.

Thereafter, as shown in FIG. 22(*e*), a part of the metal foil 13*d* in which a cutout 24 is located is sealed by a laser 96, and a part of the metal foil 13*d* located toward an outer lead 14 is sealed by the burner 95. The heating conditions and passing speed of the burner 95 and the irradiation conditions of the laser 96 are preferably determined by being appropriately changed in accordance with the ambient conditions (humidity, temperature, airflow or the like). This reason is as follows: even when the same lamp is produced, the favorable conditions may be changed in accordance with the conditions of a place where it is produced (humidity, temperature, airflow or the like) and individual differences among fabricating devices.

After the lamp 53 is produced in the above-mentioned manner, an antenna 30 is provided around the cavity 20, thereby obtaining the structure of the lamp shown in FIG. 18. Although in the structure of the lamp shown in FIG. 18 a loop-shaped antenna 30 is provided, a lead 31 may be spirally wound around the sealing part 11*b* so as to become an antenna 30. The spiral antenna 30 covers the whole cavity 20. Therefore, this offers an advantage that the discharge in the cavity 20 can be performed more certainly.

In this embodiment, the metal foil 13*d* including the cutout 24 is employed. However, in the structure of the sealing part 11*b* covering the outer edges 19 of the metal foil 13*d*, a cavity 20 can also be formed in the sealing part 11*b* using a metal foil 13*d* including no cutout 24.

Figure 23:
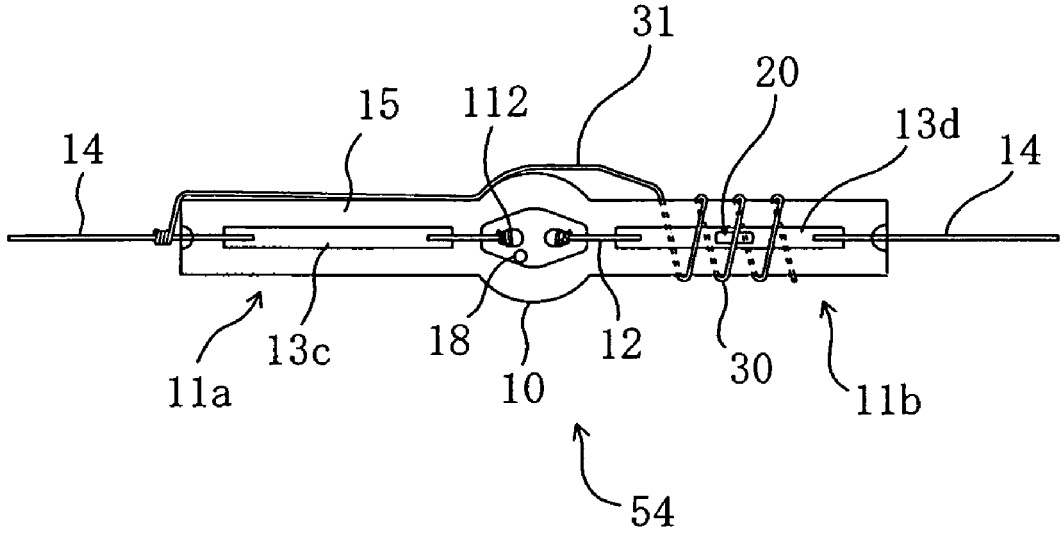
FIG. 23 is a view schematically illustrating the structure of a discharge lamp 54 according to the fourth embodiment.
Figure 24A:
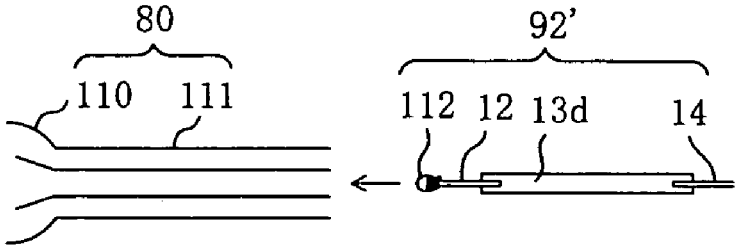
FIGS. 24(*a*) through 24(*e*) are diagrams of process steps for explaining a method for fabricating the discharge lamp 54 according to the fourth embodiment.
Figure 24B:
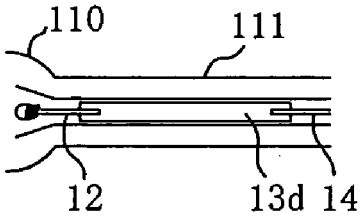
Figure 24C:
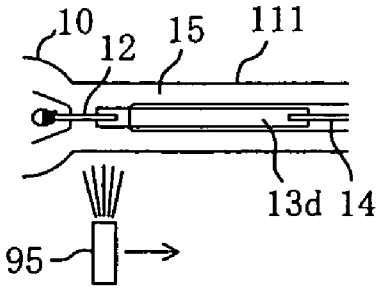
Figure 24D:
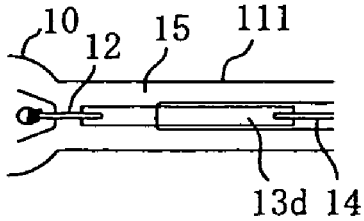
Figure 24E:
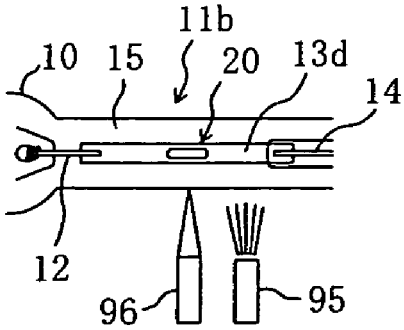
Figure 25A:
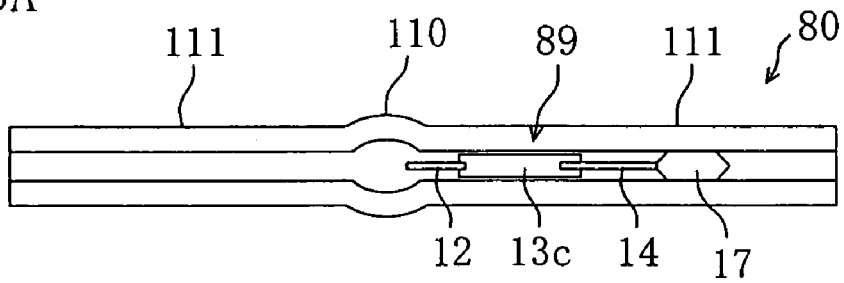
FIGS. 25(*a*) through 25(*d*) are diagrams of process steps for explaining a method for fabricating a discharge lamp according to the fourth embodiment.
Figure 25B:
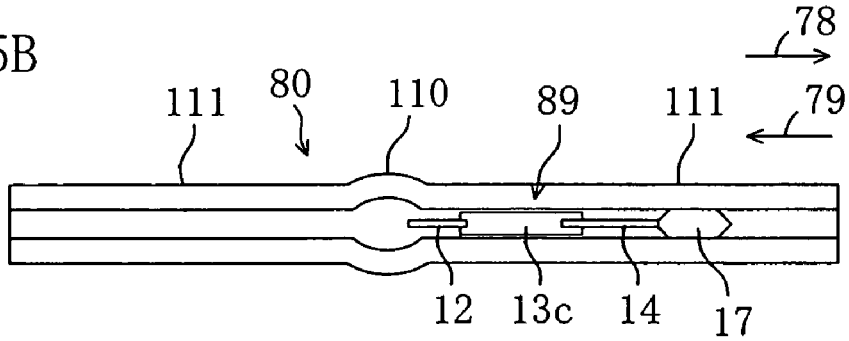
Figure 25C:
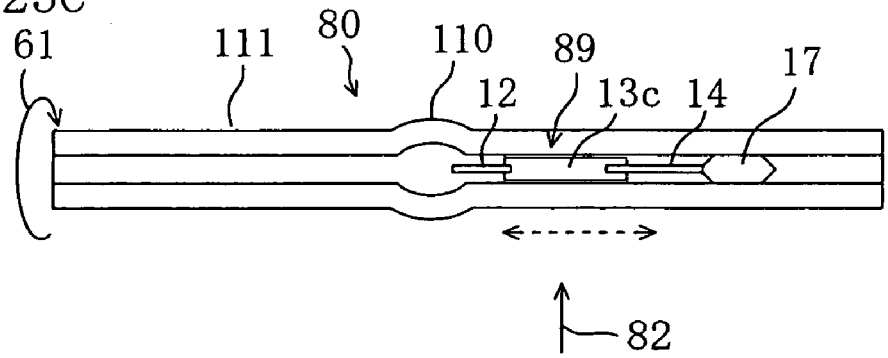
Figure 25D:
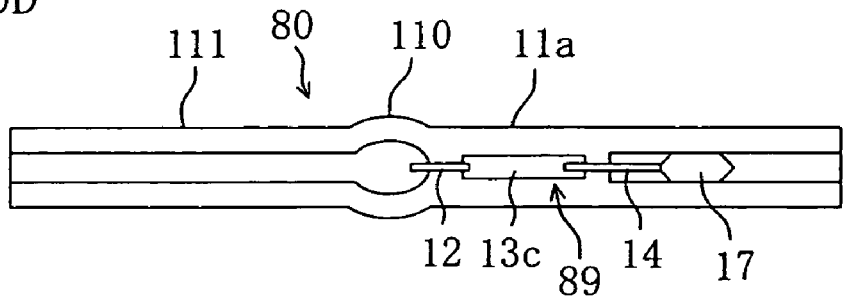
Figure 26A:
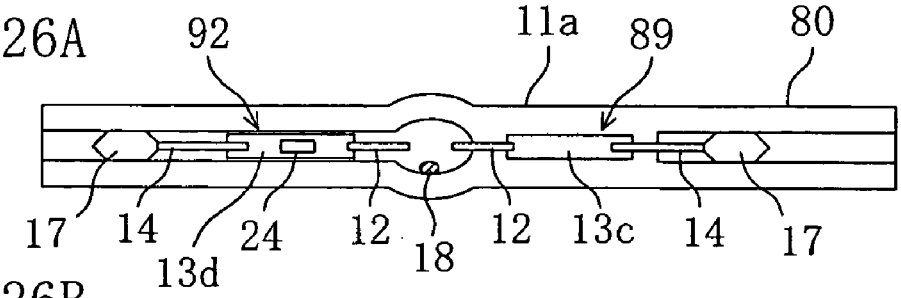
FIGS. 26(*a*) through 26(*e*) are diagrams of process steps for explaining the method for fabricating the discharge lamp according to the fourth embodiment.
Figure 26B:
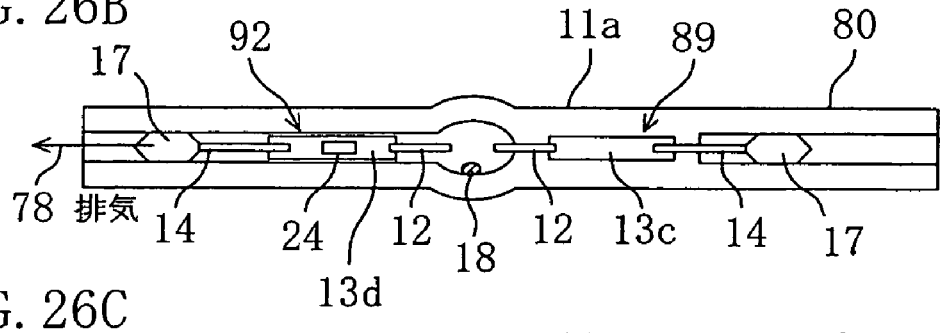
Figure 26C:
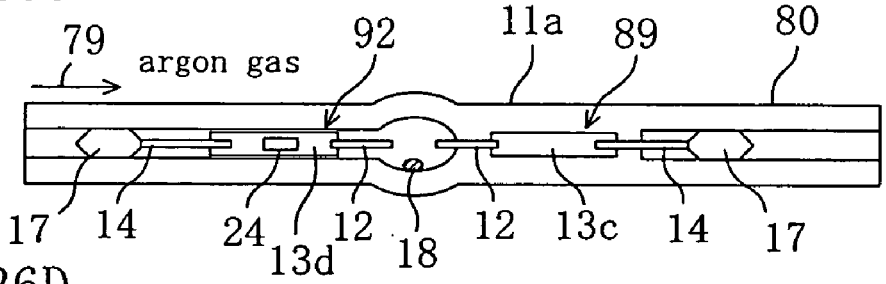
Figure 26D:
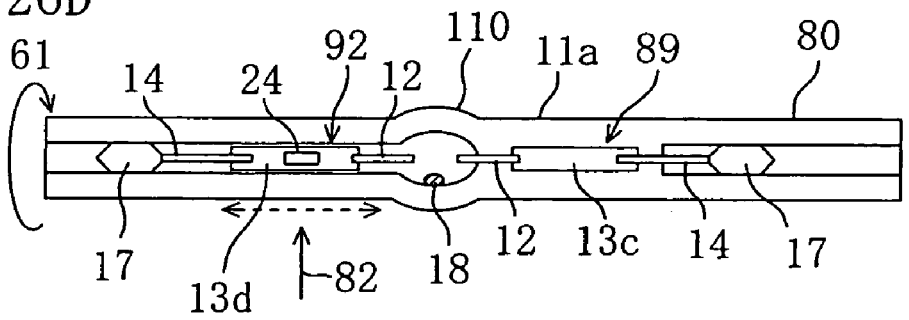
Figure 26E:
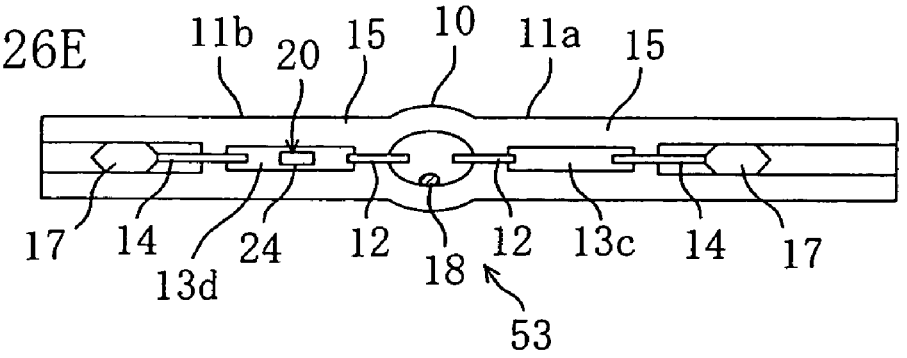

FIG. 23 schematically illustrates the structure of a discharge lamp 54 including a cavity 20 on the central part of a metal foil 13*d* located in a sealing part 11*b*. At least a rare gas is encapsulated in the cavity 20 like the lamp 53 shown in FIGS. 18 and 20. The outer edges of the metal foil 13*d* are covered with a glass part 15, and thus the outer edges are not exposed to the cavity 20. The lamp 54 shown in FIG. 23 is distinct from the lamp 53 in that a cutout 24 is not formed in the metal foil 13*d* of the sealing part 11*b*.

Figure 20:
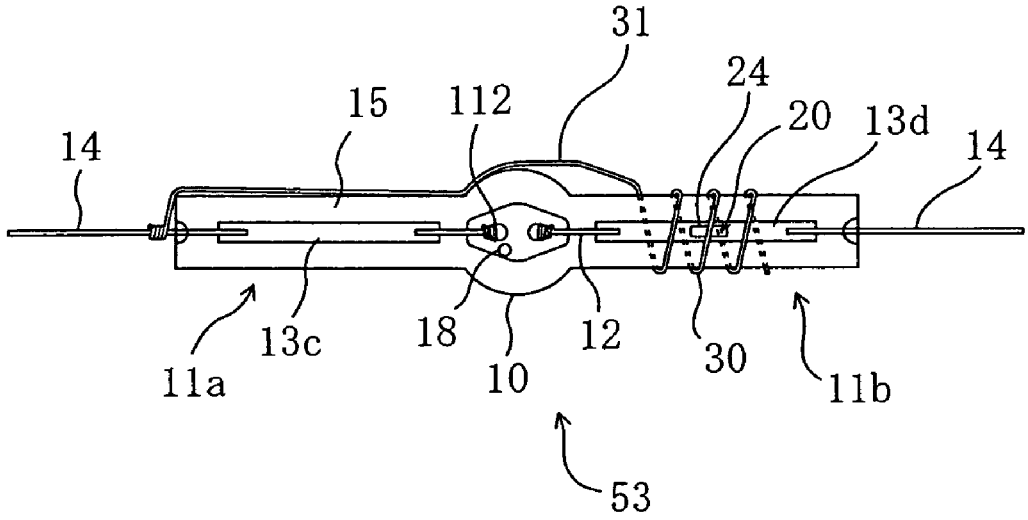
FIG. 20 is a view schematically illustrating the structure of the discharge lamp 53 according to the fourth embodiment.

In the lamp 54, a lead 31 is spirally wound around the sealing part 11*b* as in the lamp 53 shown in FIG. 20, thereby providing an antenna 30. Certainly, instead of the spirally wound antenna 30, a loop-shaped antenna as shown in FIG. 18 may be provided.

In the lamp 54 shown in FIG. 23, the metal foil 13*d* is exposed to the cavity 20, but the edges of the metal foil 13*d* are not exposed thereto. Therefore, the surface of the metal foil 13*d* and the antenna 30 cause discharge, and thus the degree of foil deterioration is small. That is, as compared with the structure of the lamp shown in FIG. 2 in which the edges of the metal foil are exposed to the cavity, foil deterioration can be suppressed and the shortening of the lamp life can be reduced. The central part of the metal foil 13 exposed to the inside of the cavity 20 is a discharge inducing part.

A method for fabricating the lamp 54 is substantially similar to the method for fabricating the lamp 53. Hereinafter, the method for fabricating the lamp 54 will be described with reference to FIGS. 24(*a*) through 24(*e*).

First, an electrode assembly 92' including a metal foil 13*d* in which no cutout 24 is formed is prepared, and thereafter the electrode assembly 92' is inserted into a side pipe section 111 of a discharge-lamp pipe 80 as shown in FIG. 24(*a*). Next, as shown in FIG. 24(*b*), the electrode assembly 92' is fixed to the side pipe section 111.

Next, as shown in FIG. 24(*c*), heating is performed from the luminous bulb section 110 side by using a burner 95, and the burner 95 is moved in the arrow direction in this figure. When the sealing of a part of a metal foil 13*d* toward the luminous bulb section 110 is completed, the state shown in FIG. 24(*d*) is obtained.

Thereafter, as shown in FIG. 24(*e*), a part of the metal foil 13*d* in which a cavity 20 is formed is sealed by a laser 96, and a part of the metal foil 13*d* toward the outer lead 14 is sealed using the burner 95. As described in the method for fabricating the lamp 53, the part of the metal foil 13*d* in which the cavity 20 is formed is sealed until the side pipe section 111 covers the outer edges of the metal foil 13*d*. In this way, a lamp 54 is obtained.

In the fabricating method of this embodiment of the present invention, the outer edges of the metal foil 13*d* are brought into tight contact with the side pipe section 111. Therefore, as compared with the structure of the lamp shown in FIG. 2 in which the outer edges do not partly come into contact with the side pipe, an electrode can more effectively be prevented from being displaced. More particularly, an electrode assembly (92 or 92') can be prevented from being displaced at a sealing part formation step. Consequently, the arc length can be adjusted more simply and more accurately. Nowadays, the arc length of a super-high pressure mercury lamp has been shortened to an extremely short space of approximately 1 mm. Therefore, in regard to the adjustment thereof, as compared with the days when the arc length was relatively long, the effect of preventing the electrode displacement has become to have a significant meaning.

The method for fabricating the sealing part 11*b* was primarily described above. Now, a method for fabricating the whole discharge lamp (high-pressure mercury lamp) will be briefly described as follows. FIGS. 25 and 26 are diagrams of process steps for explaining a method for fabricating a discharge lamp according to an embodiment of the present invention.

First, as shown in FIG. 25(*a*), an electrode assembly 89 prepared by previously assembling an electrode 12, a molybdenum foil 13*c* and an outer lead 14 is inserted from one end of a side pipe section 111 of a discharge-lamp glass pipe 80 into the inside. This electrode assembly 89 is arranged such that the tip of the electrode 12 is located in a predetermined position in a section (luminous bulb section) 110 of the discharge-lamp glass pipe 80 that is to become a luminous bulb 10. A molybdenum tape 17 for fixing the electrode assembly 89 is provided at one end of the outer lead 14 of the electrode assembly 89. Thereby, the electrode assembly 89 can be fixed in an appropriate position.

After the state shown in FIG. 25(*a*) is obtained, as shown in FIG. 25(*b*), the inside of the glass pipe 80 is initially evacuated as generally shown by an arrow 78. Next, as generally shown by an arrow 79, a dry inert gas (for example, argon gas) having a subatmospheric pressure is introduced by approximately 50 mbr (about $5\times10^3$ Pa) or approximately 200 mbar (about $2\times10^4$ Pa).

Next, as shown in FIG. 25(*c*), while the glass pipe 80 is rotated as shown by an arrow 61, a section of the glass pipe 80 located in the vicinity of the electrode assembly 89 is heated. This heating is performed, for example, by a gas burner using oxyhydrogen, propane or the like, or by a laser using $CO_2$ or the like, for example. This process step may be carried out in a state where the glass pipe 80 stands generally upright. In this case, it is preferably carried out in a state where the electrode assembly 89 is placed above the section (110) of the glass pipe 80 that is to become a light emitting part in the future.

When the heating is accomplished to sufficiently keep the hermeticity of the molybdenum foil 13*c*, the glass pipe 80 in which a sealing part 11*a* is formed is completed as shown in FIG. 25(*d*). The process step mainly shown in FIG. 25(*a*) is referred to as an electrode arrangement step (or an electrode assembly arrangement step), and the process step mainly shown in FIG. 25(*c*) is referred to as a sealing part formation step.

Subsequently, as shown in FIG. 26(*a*), mercury 18 that is a luminous material, and an electrode assembly 92 shown in FIG. 22(*a*) are inserted from an aperture end of a glass pipe 80 (glass pipe in which the first electrode is sealed) into the inside thereof The electrode assembly 92 is inserted and positioned in the glass pipe 80 such that one end of the electrode 12 of the inserted electrode assembly 92 is positioned about 1 mm apart from the tip of the sealing part 11*a* side electrode 12 in the section (110) of the glass pipe 80 that is to become the luminous bulb 10.

A molybdenum tape 17 is provided also at one end of the outer lead 14 of the electrode assembly 92, thereby easily fixing the electrode assembly 92 in a predetermined position. Here, as described above, the electrode assembly 92' shown in FIG. 24, instead of the electrode assembly 92, can be employed.

Next, as shown by an arrow 78 in FIG. 26(*b*), the inside of the glass pipe 80 is evacuated, and then a dry rare gas (for example, argon gas) is introduced by 200 mbr (about $2\times10^4$ Pa), for example, as shown by an arrow 79 in FIG. 26(*c*). At this time, a small amount of halogen gas (or a halogen precursor that will be decomposed into halogen) may be mixed with the rare gas.

Thereafter, in the same manner as shown in FIG. 25(*c*), as shown in FIG. 26(*d*), while the glass pipe 80 is rotated in an arrow 61 direction, a section of the glass pipe 80 located in the vicinity of where the electrode assembly 92 is located is heated as generally shown by an arrow 82. This heating is performed, for example, by a gas burner using oxyhydrogen, propane or the like, or by a laser using $CO_2$ or the like. In the same manner as shown in FIG. 25(*c*), this process step may be carried out in a state where the glass pipe 80 stands generally upright. In this case, it is preferably carried out in a state where the electrode assembly 92 is placed above the section (110) of the glass pipe 80 that is to become the luminous bulb 10 in the future. In order to prevent the mercury 18 from evaporating, while the section 110 of the glass pipe 80 that is to become the luminous bulb 10 in the future is cooled, for example, by liquid nitrogen, this heating process may be carried out. This sealing part formation step is as shown in FIGS. 22(*c*) through 22(*e*). When the electrode assembly 92' is employed, this process step is as shown in FIG. 24(*c*) through 24(*e*).

As shown in FIG. 26(*e*), a lamp 53 in which the luminous bulb 10 and the sealing parts 11*a* and 11*b* are formed is completed. Finally, unnecessary glass parts and the molybdenum tapes 17 are removed so as to expose the outer lead 14 to the outside and an antenna 30 is provided, thereby completing the lamp 53 as shown in FIG. 20. When the electrode assembly 92' is employed, a lamp 54 shown in FIG. 23 is completed.

Embodiment 5

The high-pressure discharge lamp of the above fourth embodiment can become a mirror-mounted lamp or a lamp unit in combination with a reflecting mirror.

Figure 27:
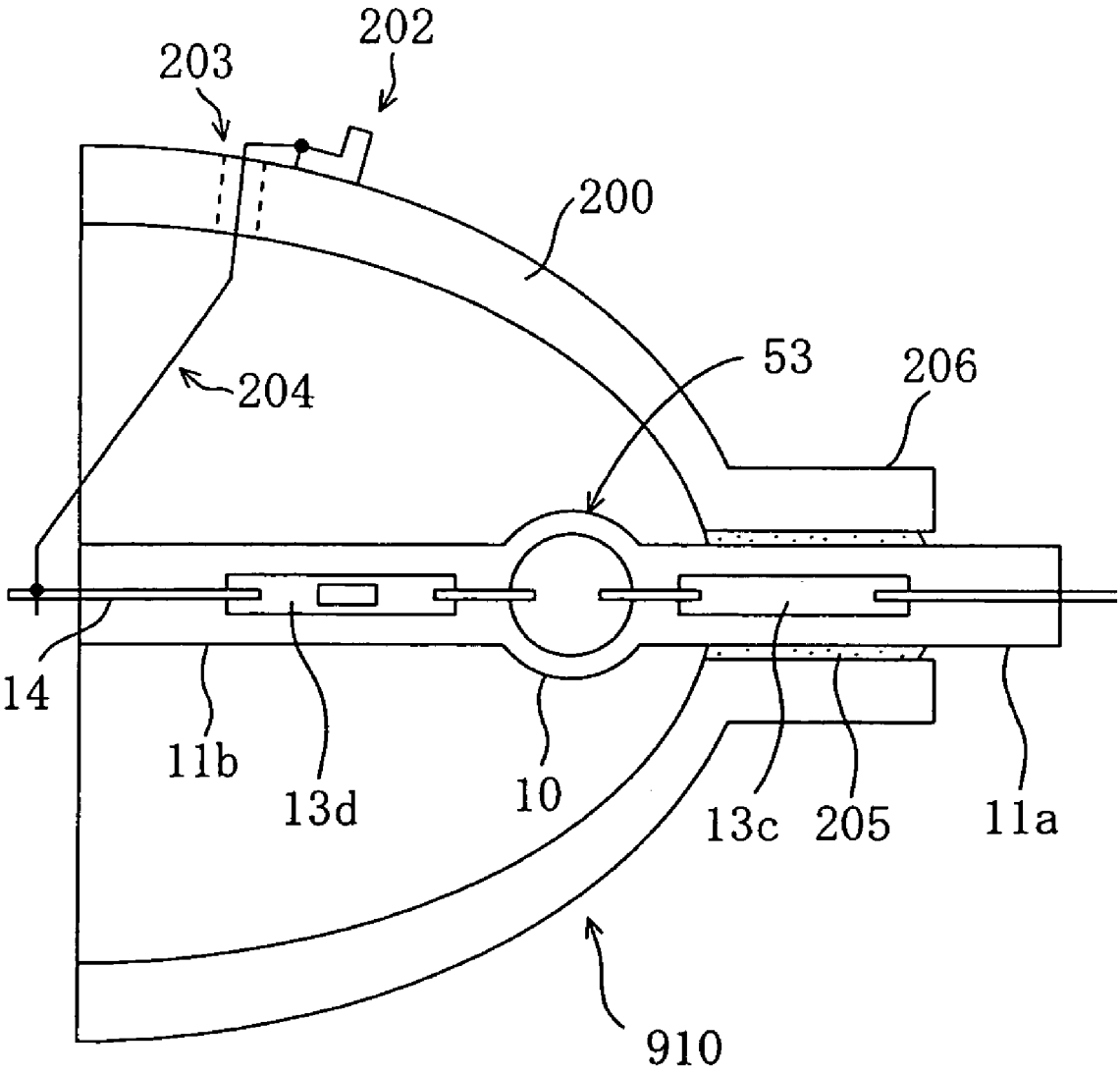
FIG. 27 is a view schematically illustrating a cross section of a mirror-mounted lamp (lamp unit) according to a fifth embodiment of the present invention.

FIG. 27 schematically illustrates the cross section of a mirror-mounted lamp 910 comprising the lamp 53 of the above fourth embodiment. The cross section is not hatched.

A mirror-mounted lamp 910 of this embodiment is the same as the mirror-mounted lamp 900 of the third embodiment in the points other than the lamp 53. Therefore, its structure and effects are the same as described in the third embodiment.

Embodiment 6

Figure 28:
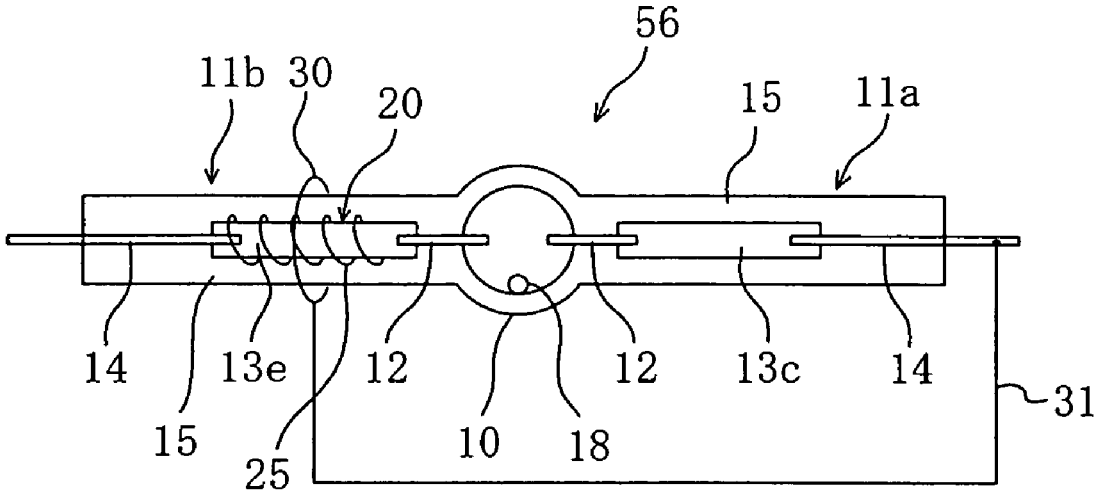
FIG. 28 is a view schematically illustrating the structure of a discharge lamp 56 according to a sixth embodiment of the present invention.

A discharge lamp according to this embodiment is distinct from the discharge lamp 50 according to the first embodiment in their metal foil structures. The other points are generally the same. Thus, distinct points will be described with reference to FIG. 28. In this embodiment, the metal foil structures are metal foils 13*c* and 13*e*. FIG. 28 schematically illustrates the structure of a discharge lamp 56 according to this embodiment.

The discharge lamp 56 according to a sixth embodiment of the present invention will be described with reference to FIG. 28. FIG. 28 schematically illustrates the structure of the discharge lamp 56 according to this embodiment.

A coil 25 is wound around a metal foil 13*e* located in at least one sealing part 11*b* of a pair of sealing parts 11*a* and 11*b*. A gap (or a cavity) 20 exists around the coil 25 located in the sealing part 11*b*. At least a rare gas is encapsulated in the cavity 20, in which the same gas as in the luminous bulb 10 (for example, the rare gas and mercury vapor) typically exists. An antenna 30 is provided around a section of the sealing part 11*b* in which the cavity 20 is located. That is, an antenna 30 is provided around a section of the sealing part 11*b* corresponding to a part of the metal foil 13*e* around which the coil 25 is wound.

In this embodiment, the antenna 30 is electrically connected through a lead 31 to an outer lead 14 exposed by extending from one end of the sealing part 11*a*. A second antenna serving as a so-called trigger line may be arranged around a neck part between the sealing part 11*b* and the luminous bulb 10 (approximately, around a section of the sealing part 11*b* in which the electrode 12 is embedded) as in the structure of the lamp shown in FIG. 2.

Figure 29A:
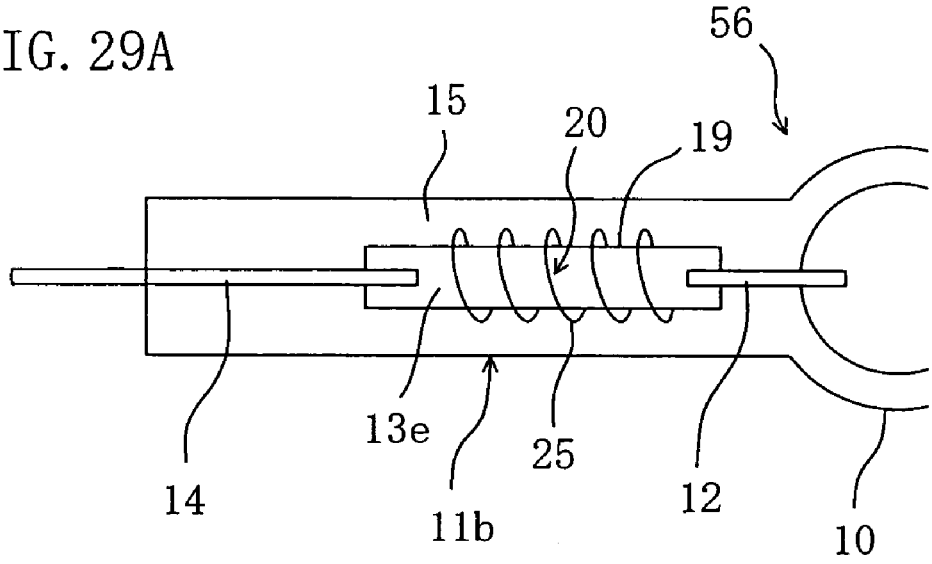
FIGS. 29(*a*) and 29(*b*) are a plan view and a side view illustrating a sealing part 11*b* of the discharge lamp 56, respectively.
Figure 29B:
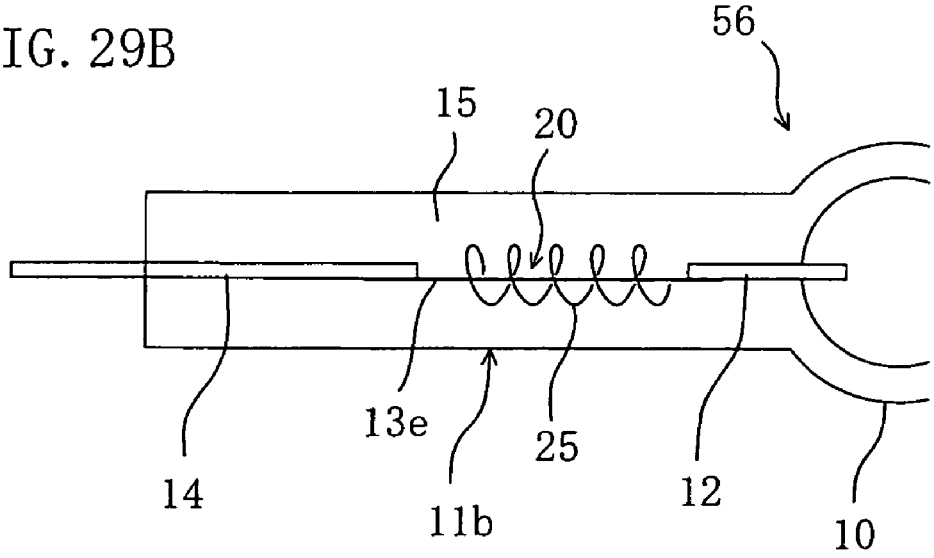

FIGS. 29(*a*) and 29(*b*) are partially enlarged views illustrating the sealing part 11*b* shown in FIG. 28. FIG. 29(*a*) schematically illustrates the plan structure thereof, and FIG. 29(*b*) schematically illustrates the side structure thereof.

As shown in FIGS. 29(*a*) and 29(*b*), in the discharge lamp 56 of this embodiment, the longer edges (outer edges or edge) 19 of the metal foil 13*e* of the sealing part 11*b* are covered with the coil 25. Therefore, even when an antenna (see numeral 30 in FIG. 28) is provided around the sealing part 11*b* and the discharge occurs in the sealing part 11*b*, the discharge occurs between the coil 25 and the antenna (30). As a result, as compared with the structure of the lamp shown in FIGS. 2 and 3, the deterioration in the foil due to the discharge can be suppressed.

Figure 2:
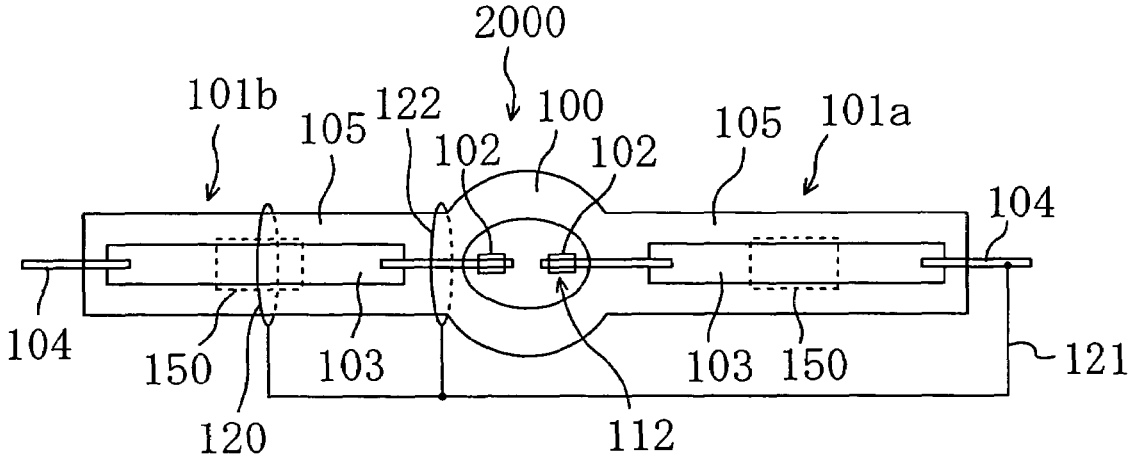
FIG. 2 PRIOR ART
FIG. 2 is a view illustrating the structure of a known low-voltage start lamp.
Figure 3A:
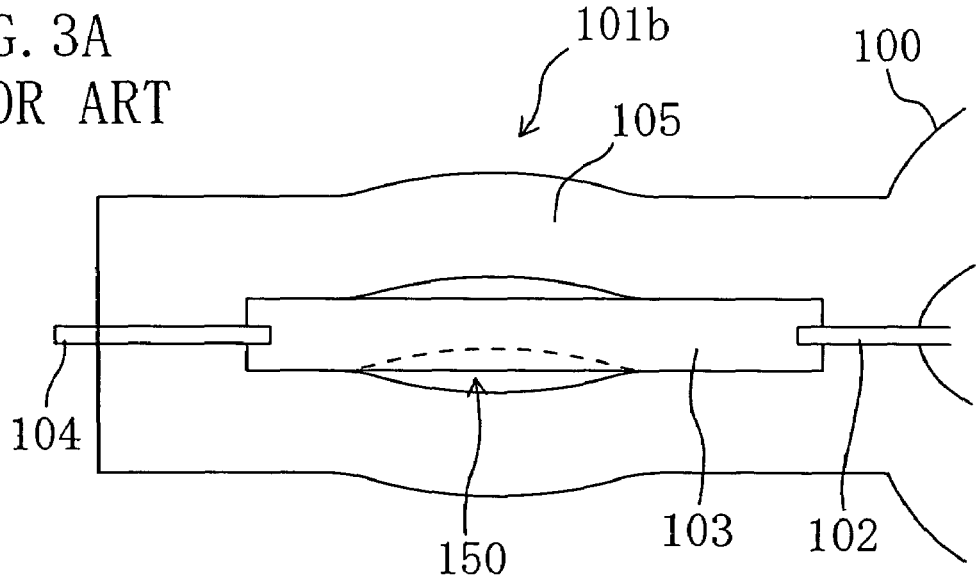
FIG. 3A PRIOR ART
FIGS. 3(*a*) and 3(*b*) are a plan view and a side view of the lamp shown in FIG. 2, respectively.
Figure 3B:
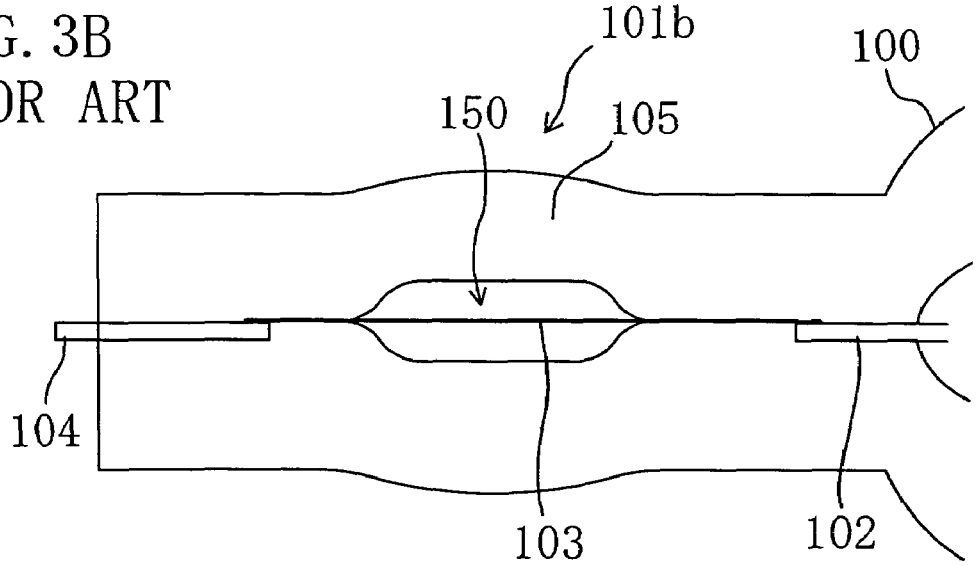
FIG. 3B PRIOR ART

That is, although according to the structure of the lamp shown in FIGS. 2 and 3 the outer edges (edge) of the metal foil 103 exposed to the inside of the cavity 150 primarily suffer damage due to the discharge, the sensitive edges 19 of the metal foil 13*e* are covered with the coil 25 in the structure of the lamp of this embodiment. In addition, the discharge occurs between the coil 25 and the antenna (30). Therefore, the deterioration in the foil due to the discharge can be suppressed. If the deterioration in the foil can be suppressed, the lamp life can be restrained from being shortened. The longer edge 19 of the metal foil 13*e* is preferably covered with the coil 25 by half or less. In this embodiment, approximately 30 through 50% thereof is covered with the coil 25. When the sealing part 11*b* is formed with the coil 25 being wound around the metal foil 13*e*, the coil 25 prevents a glass part 15 from coming into tight contact with the metal foil 13*e*, thereby producing a cavity 20 around the coil 25. A rare gas encapsulated in this cavity 20 enables discharge to occur in the sealing part 11*b*. Here, the coil 25 is a discharge inducing part.

The occurrence of a discharge in the sealing part 11*b* causes ultraviolet radiation to be produced. The energy caused by the discharge flows into the luminous bulb 10 by a so-called optical-fiber effect and causes a material in the luminous bulb 10 (for example, a rare gas) to be optically pumped, thereby producing seed electrons. Consequently, it becomes possible that a dielectric breakdown between the electrodes 12 at the start is caused at lower voltage. That is, a discharge lamp starting at low voltage can be realized. In the case of the discharge lamp 56 according to this embodiment, at the start from the state where the lamp is cold (cold start), an open-circuit voltage of 940V (0-peak) is employed and a sine wave of 50 kHz is applied between lamp terminals (14) at 5.8 kV, using the ballast (ballast). Thus, the lamp can be started at a voltage of 2 kV or less (for example, 1 through 2 kV). This means that the lamp can be started at much lower voltage, as compared with the start voltage (for example, 10 through 15 kV) when no cavity 20 exists. Another effect can be obtained as follows: if the lamp can be started at a voltage of 2 kV or less (for example, 1 through 2 kV), the ballast (ballast) can be constituted without using a transformer. Since the lamp can be started at low voltage, noise produced at the start can also be reduced.

The coil 25 in this embodiment is composed of thoriated tungsten that is a substance easily emitting electrons to facilitate the discharge. Instead of a coil made of thoriated tungsten, a coil made of tungsten may be used. A substance easily emitting electrons to facilitate the discharge, such as barium oxide and thoriated tungsten, may be given to the surface of the coil made of tungsten. Even when such a substance is not given thereto, the deterioration in the foil due to the discharge can also be suppressed using the coil 25 made of tungsten.

The diameter (thickness) of the coil 25 is, for example, 0.1 through 0.5 mm. The size of each of the metal foils 13*c* and 13*e* is, for example, 1.5 through 2.0 mm×16 through 40 mm. When a sealing effect of the luminous bulb 10 is to be enhanced, the degree of adhesion of the metal foil 13*e* to the glass part 15 may be enhanced without the coil 25 being wound around a section of the metal foil 11*b* located closer to the luminous bulb 10 (for example, a part of the metal foil 13*e* located within 5 mm from the border between the luminous bulb 10 and the sealing part 11*b*). At least a dischargeable gas is encapsulated in the cavity 20 existing around the coil 25, and typically the similar gas (rare gas, mercury vapor) as in the luminous bulb 10 is encapsulated therein. It is a feature of the fabricating process that the similar gas as in the luminous bulb 10 exists in the cavity 20. Although the fabricating process becomes complicated, different gases can be made to exist.

Figure 30:
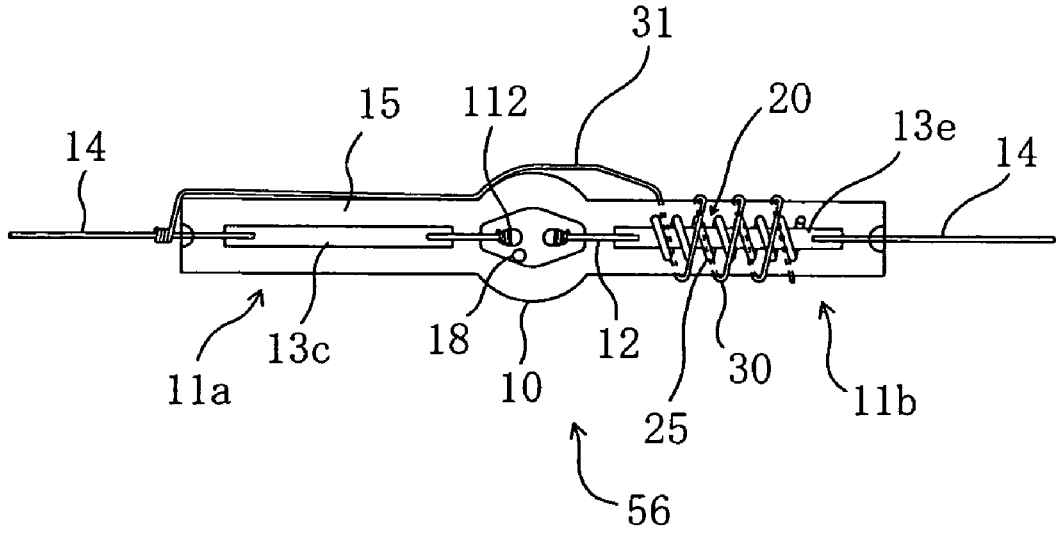
FIG. 30 is a view schematically illustrating the structure of the discharge lamp 56 according to the sixth embodiment.
Figure 31A:
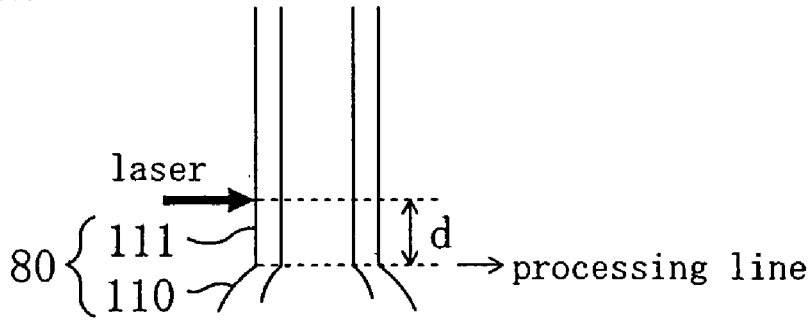
FIGS. 31(*a*) through 31(*d*) are diagrams of process steps for explaining a method for fabricating the discharge lamp 56 according to the sixth embodiment.
Figure 31B:
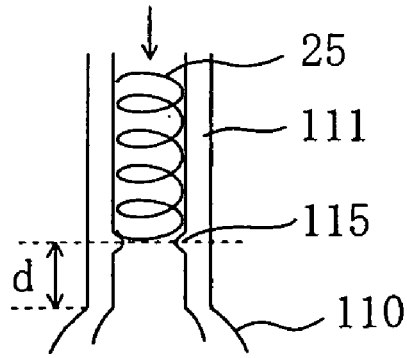
Figure 31C:
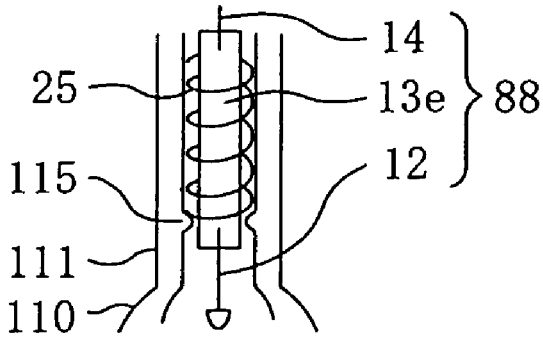
Figure 31D:
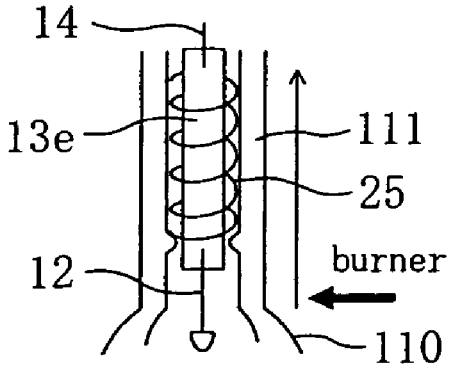
Figure 32A:
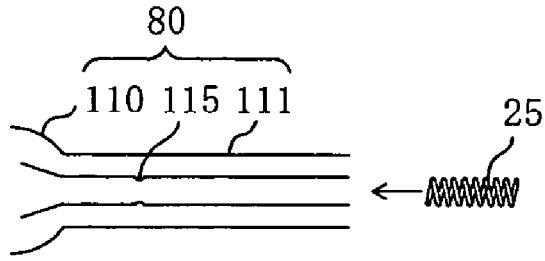
FIGS. 32(*a*) through 32(*e*) are diagrams of process steps for explaining the method for fabricating the discharge lamp 56 according to the sixth embodiment.
Figure 32B:
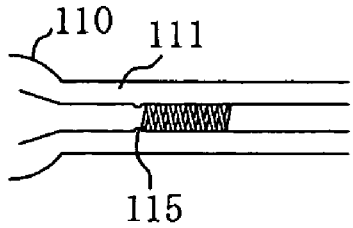
Figure 32C:
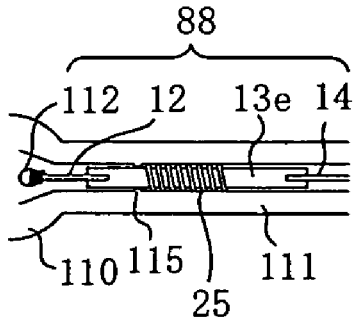
Figure 32D:
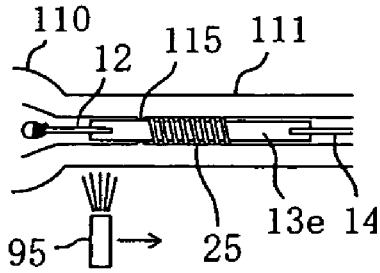
Figure 32E:
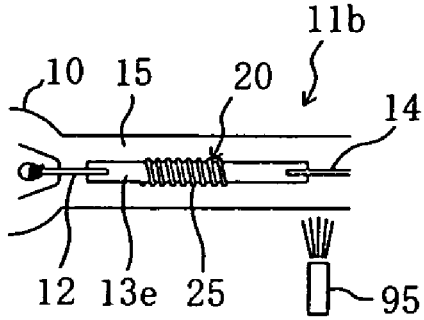

Although in the structure of the lamp shown in FIG. 28 a loop-shaped antenna 30 is provided, the lead 31 may be spiraly wound around the sealing part 11*b* so as to become an antenna 30 as shown in FIG. 30. The spiral antenna 30 covers the whole cavity 20. Therefore, the discharge in the cavity 20 can also be performed more certainly.

Although in the structure of the lamp shown in FIG. 28 the coil 25 is wound only around the metal foil 13*e* of the sealing part 11*b*, this is not restrictive. Coils 25 and cavities 20 may be provided for the metal foils 13*c* and 13*e* located in both of the sealing parts 11*a* and 11*b*. This results in achieving a lamp that can start at low voltage regardless of whether an antenna is provided for the sealing part 11*a* or the sealing part 11*b*.

Although in the structure of the lamp of this embodiment the coil 25 is used, the metal foil 13*e* may be covered with, instead of the coil 25, a metal tube having a shape that can surround the metal foil 13*e* (for example, a sleeve made of molybdenum). Even when the metal foil 13*e* is covered with the metal tube in this manner, the edge (19) of the metal foil 13*e* can be protected so as to reduce the deterioration in the foil. When a sealing part 11*b* is formed with the metal tube covering the metal foil 13*e*, a gap is similarly produced around it. Thus, the same effects as in the structure of the lamp shown in FIG. 28 or the like can be obtained.

Next, a method for fabricating a discharge lamp 56 according to this embodiment will be described with reference to FIGS. 31(*a*) through 31(*d*). FIGS. 31(*a*) through 31(*d*) are diagrams of process steps for explaining the fabricating method of this embodiment.

First, as shown in FIG. 31(*a*), a discharge-lamp pipe (discharge-lamp glass pipe) 80 is prepared which includes a luminous bulb section 110 that becomes a luminous bulb (10) of a discharge lamp and a side pipe section 111 extending from the luminous bulb section 110, and thereafter a position located a distance d (for example, 5 mm) apart from a processing line that is the border between the luminous bulb section 110 and the side pipe section 111 is irradiated with a laser. Thus, as shown in FIG. 31(*b*), a salient on which the position of the coil 25 to be inserted later depends is formed. Next, the coil 25 is inserted from one end of the side pipe section 111.

Next, as shown in FIG. 31(*c*), an electrode assembly 88 is inserted into the side pipe section 111. The electrode assembly 88 is composed of an electrode 12, a metal foil 13*e* and an outer lead 14. The electrode 12 and the outer lead 14 are connected to one end and the other end of the metal foil 13*e* by welding, respectively. A coil 112 is wound around the tip of the electrode 12.

The electrode assembly 88 is inserted into the side pipe section 111 and fixed such that the tip of the electrode 12 is located in the luminous bulb 10. The fixing of the electrode assembly 88 can be carried out by bringing a molybdenum tape or a coil provided on a part of the outer lead 14 into contact with the inner wall of the side pipe section 111.

Next, the inside of the discharge-lamp pipe 80 is put under a reduced pressure and the side pipe section 111 is softened by heat, thereby bringing the metal foil 13*e* of the electrode assembly 88 into tight contact with the side pipe section 111.

Here, as shown in FIG. 31(*d*), a burner is moved at a constant speed from a section of the side pipe section 111 located toward the luminous bulb section 110 (for example, the processing line in FIG. 31(*a*)) to the outer lead 14 to heat and seal the side pipe section 111. According to this fabricating method, the speed of the burner need not be changed. Therefore, a sealing formation step can be executed more simply. Although in this embodiment heating is carried out by a burner, the heating may be carried by a laser (for example, a $CO_2$ variable laser). The burner and the laser can be used in combination.

When the heating is completed in the above manner, a sealing part 11*b* can be obtained in which the coil 25 is provided around the metal foil 13*e* with the side pipe section 111 being brought into tight contact with the metal foil 13*e* through the coil 25. As described above, the cavity (20) exists in the vicinity of the coil 25. When both of the pair of sealing parts are to include the coils 25, respectively, the same process steps need be repeated. When one of the sealing parts is to include the coil 25, for example, a sealing part 11*a* including no coil 25 is produced before the sealing part 11*b* including the coil 25 is produced in the manner shown in FIGS. 31(*a*) through 31(*d*). When the metal tube, instead of the coil 25, is used, the metal tube need only be inserted into the side pipe section 111 in a stage shown in FIG. 31(*b*).

After a rare gas and mercury are introduced into the luminous bulb 10, the process steps shown in FIGS. 31(*a*) through 31(*d*) are undergone to form a cavity 20, resulting in the rare gas and the mercury vapor automatically encapsulated in the cavity 20. Although in the process steps shown in FIG. 31 sealing is performed from the luminous bulb section 110 side, the sealing can be performed from the opposite side thereto. The sealing part 11*b* including the coil 25 may be initially produced before the sealing part 11*a* including no coil 25 is produced.

FIGS. 32(*a*) through 32(*e*) more clearly illustrate the fabricating method of this embodiment by clearly showing a burner 95.

As shown in FIG. 32(*a*), a discharge-lamp pipe 80 is prepared which includes a side pipe section 111 in which a salient 115 is formed, and thereafter a coil 25 is inserted from one end of the side pipe section 111. The inside diameter of the side pipe section 111 is approximately 2.0 mm.

Next, as shown in FIG. 32(*b*), the coil 25 is arranged in a predetermined position, and thereafter, as shown in FIG. 32(*c*), an electrode assembly 88 is inserted and fixed to the side pipe section 111.

Next, as shown in FIG. 32(*d*), heating is performed from the luminous bulb section 110 side by using a burner 95, and the burner 95 is moved in the arrow direction in this figure. The burner 95 need only be moved at a constant speed.

Thereafter, as shown in FIG. 32(*e*), when the heating is completed to a part of the side pipe section 111 located around the outer lead 14, a sealing part 11*b* can be obtained. The heating conditions and passing speed of the burner 95 can employ generally the same as when the sealing part Ha including no coil 25 is formed. This means that the sealing part 11*b* can be simply fabricated.

After the sealing part 11*b* is formed in the above manner to complete the lamp 56, an antenna 30 is provided around a part of the sealing part 11*b* in which the coil 25 is located, thereby obtaining the structure of the lamp shown in FIG. 28 or 30.

Embodiment 7

Figure 33:
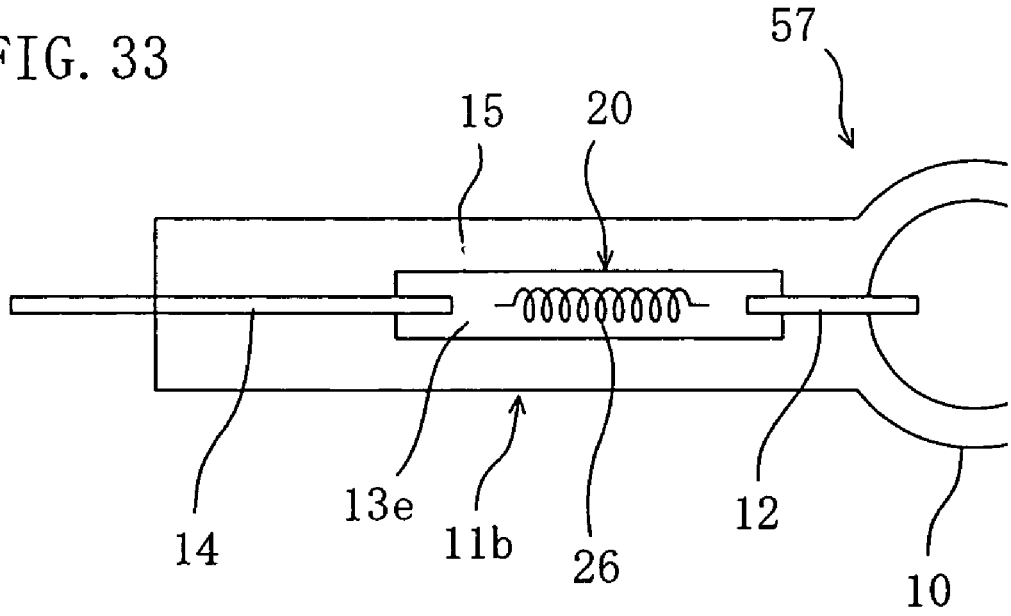
FIG. 33 is a partially enlarged view schematically illustrating the structure of a discharge lamp 57 according to a seventh embodiment.

Next, a discharge lamp according to a seventh embodiment of the present invention will be described with reference to FIG. 33. FIG. 33 schematically illustrates the structure of a sealing part 11*b* in a discharge lamp 57 of this embodiment.

A discharge lamp 57 shown in FIG. 33 is distinct from the lamp 56 of the above sixth embodiment in which the coil 25 is wound around the metal foil 13*e*, in that a coil 26 is provided on a metal foil 13*e*. The other points are the same as in the structure of the lamp according to the above embodiment. Thus, for the sake of simplicity, the descriptions are omitted or simplified with respect to the same contents.

With the structure of the lamp of this embodiment, the coil 26 is placed within the surface area of a metal foil 13*e*. The coil 26 is connected to the metal foil 13*e* by welding. Although the coil 26 is made of, for example, thoriated tungsten, it may be made of tungsten. One obtained by applying thorium to the surface of a coil made of tungsten may be used as the coil 26.

The coil 26 has a size in which it generally falls within the area of the metal foil 13*e*. With the dimensions of the coil 26 taken as an example, the longitudinal length thereof is 5 through 15 mm and the inside diameter (the size of the central cavity) and diameter of the coil 26 are 1 through 8 mm and 0.1 through 0.5 mm, respectively.

In this way, even when the structure of the lamp in which the coil 26 is arranged on the metal foil 13*e* is employed, the coil 26 prevents a glass part 15 from coming into tight contact with the metal foil 13*e*, resulting in a gap (cavity) 20 produced around the coil 26. Since a dischargeable gas (for example, a rare gas and a mercury vapor) exists in this cavity 20, the discharge can be excited in a sealing part 11*b*. Since the outer edges (edge) 19 of the metal foil 13*e* are covered with the glass part 15, the deterioration in the foil due to the discharge can be suppressed. Since a dominant discharge occurring in the sealing part 11*b* is caused by the coil 26 and an antenna (30), this also suppresses the foil deterioration. If the foil deterioration can be suppressed as described above, the lamp life can be restrained from being shortened.

Figure 34:
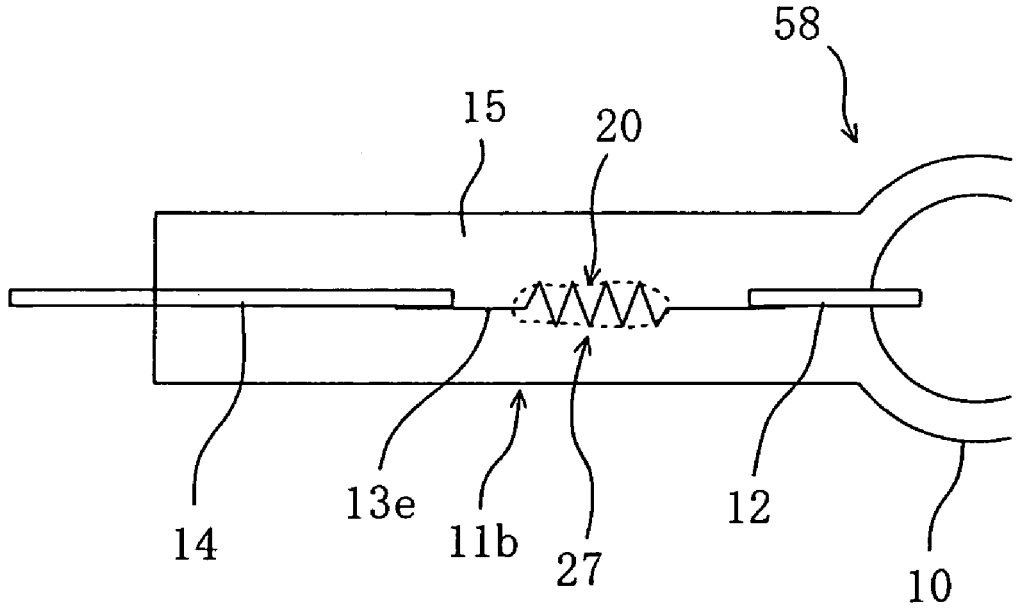
FIG. 34 is a partially enlarged view schematically illustrating the structure of a discharge lamp 58 according to the seventh embodiment.

Furthermore, a cavity 20 may be produced around the metal foil 13*e* in such a manner as shown in FIG. 34. That is, by providing wavy parts 27 in the metal foil 13*e*, a cavity 20 can be formed around the wavy parts 27. The wavy parts 27 are a part of the metal foil 13*e* becoming wavy such that the upper surface and the bottom surface of the metal foil 13*e* appear from above and below the end surface of the metal foil 13*e*. The formation of the wavy parts 27 in the metal foil 13*e* enables the cavity 20 to be provided between the wavy parts 27 and the glass part 15. The outer edges 19 of the metal foil 13*e* shown in FIG. 34 are covered with the glass part 15, thereby suppressing the foil deterioration due to the discharge. The discharge is easily caused between the antenna (30) and the wavy parts 27. Thus, the wavy parts 27 are a discharge inducing part.

In the structure of the lamp shown in FIG. 34, the metal foil 13*e* includes plural wavy parts 27, and the amplitude and curvature radius of each of the wavy parts 27 are, for example, 1 through 2 mm (amplitude) and 1 through 4 mm (curvature radius), respectively. When the metal foil 11*b* includes the wavy parts 27, the internal stress of the sealing part 11*b* can be spread out, thereby reducing the composite stress with which the metal foil would otherwise split the sealing part. As a result, the life of the foil structure of the sealing part can be prolonged. Wavy parts may be provided in the metal foil 13*c* of the sealing part 11*a*.

Also according to the lamps 57 and 58 of this embodiment, an antenna 30 can be provided by spirally winding a lead 31 around the sealing part 11*b* as in the lamp 56 shown in FIG. 30. Certainly, instead of the spirally wound antenna 30, a loop-shaped antenna as shown in FIG. 28 may be provided.

Next, a method for fabricating a lamp 57 according to this embodiment will be described with reference to FIGS. 35(*a*) through 35(*c*). The method for fabricating the lamp 57 is the same as the method for fabricating the lamp 56 according to the sixth embodiment.

Figure 35A:
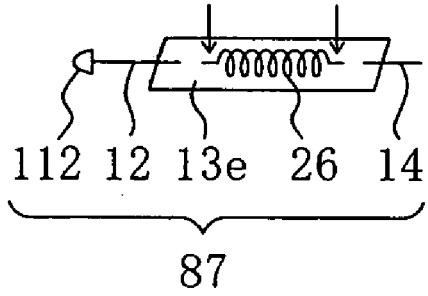
FIGS. 35(*a*) through 35(*c*) are diagrams of process steps for explaining a method for fabricating the discharge lamp 57 according to the seventh embodiment.
Figure 35B:
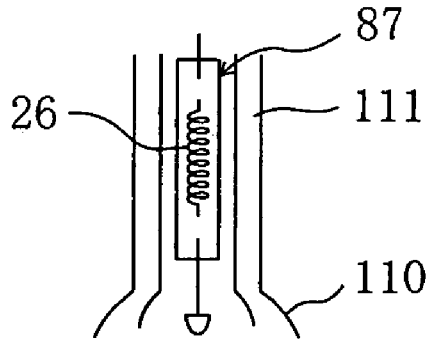
Figure 35C:
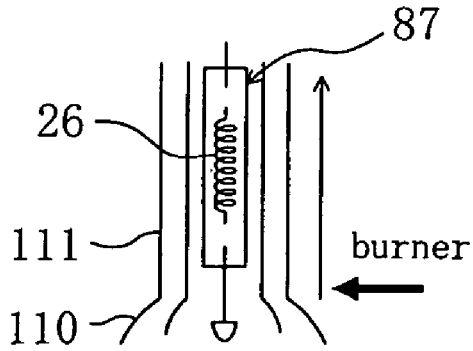

First, an electrode assembly 88 including a metal foil 13*e* as shown in FIG. 31(*c*) is prepared, and thereafter one end and the other end of a coil 26 are connected to the metal foil 13*e* by welding as shown in FIG. 35(*a*), thereby producing an electrode assembly 87.

Next, as shown in FIG. 35(*b*), the electrode assembly 87 is inserted into a side pipe section 111. The electrode assembly 87 is inserted into the side pipe section 111 and fixed such that the tip of an electrode 12 is located in a luminous bulb 10. The fixing of the electrode assembly 87 can be carried out by bringing a molybdenum tape or a coil provided on a part of an outer lead 14 into contact with the inner wall of the side pipe section 111.

Next, as shown in FIG. 35(*c*), the inside of the discharge-lamp pipe 80 is put under a reduced pressure and the side pipe section 111 is softened by heat, thereby bringing the metal foil 13*e* of the electrode assembly 87 into tight contact with the side pipe section 111.

Here, as in FIG. 31(*d*), a burner is moved at a constant speed from a section of the side pipe section 111 located toward the luminous bulb section 110 to the outer lead 14 to heat and seal the side pipe section 111. According to this fabricating method, the speed of the burner need not be changed. Therefore, a sealing part formation step can be executed more simply. Heating may be carried out not by a burner but by a laser (for example, a $CO_2$ variable laser). The burner and the laser may be used in combination.

When the heating is completed in the above manner, a sealing part 11*b* can be obtained in which the coil 26 is arranged on the metal foil 13*e* with the side pipe section 111 being brought into tight contact with the metal foil 13*e* through the coil 26. As described above, the cavity (20) exists in the vicinity of the coil 26. When both of the pair of sealing parts are to include the coils 26, respectively, the same process steps need be repeated. When only one of the sealing parts is to include the coil 26, for example, a sealing part 11*a* including no coil 26 is produced before the sealing part 11*b* including the coil 26 is produced in the manner shown in FIGS. 35(*a*) through 35(*c*).

Figure 36:
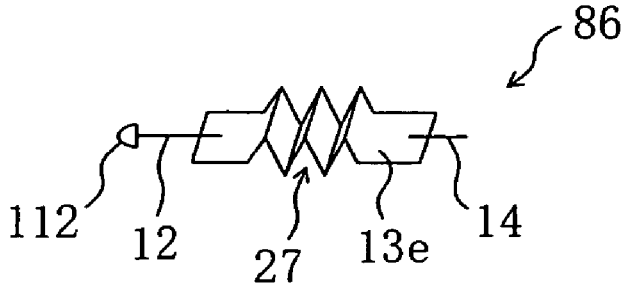
FIG. 36 is a perspective view schematically illustrating the structure of an electrode assembly 86.
Figure 37A:
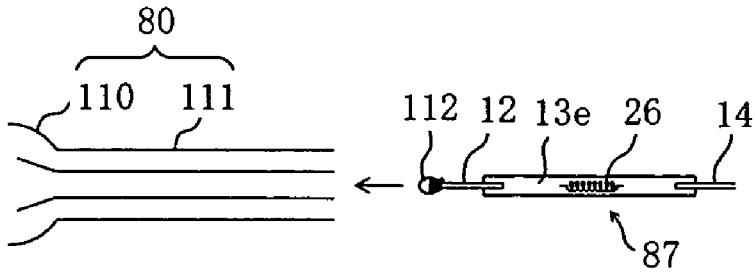
FIGS. 37(*a*) through 37(*d*) are diagrams of process steps for explaining the method for fabricating the discharge lamp 57 according to the seventh embodiment.
Figure 37B:
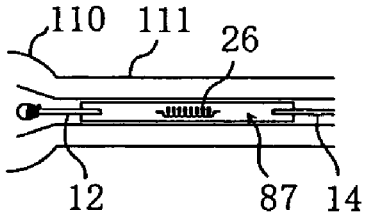
Figure 37C:
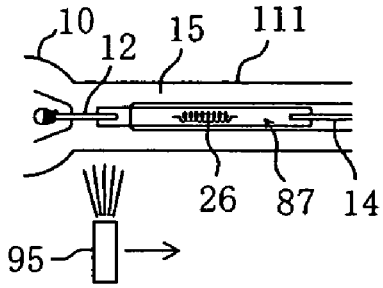
Figure 37D:
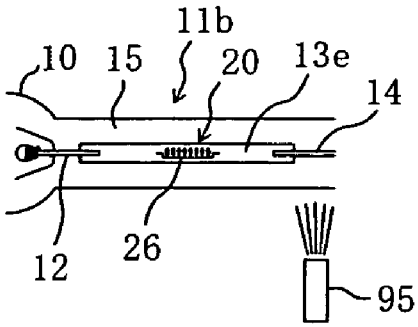
Figure 38A:
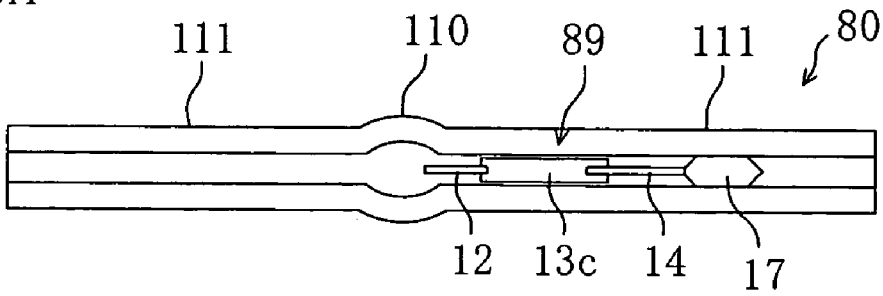
FIGS. 38(*a*) through 38(*d*) are diagrams of process steps for explaining a method for fabricating a discharge lamp according to the sixth and seventh embodiments.
Figure 38B:
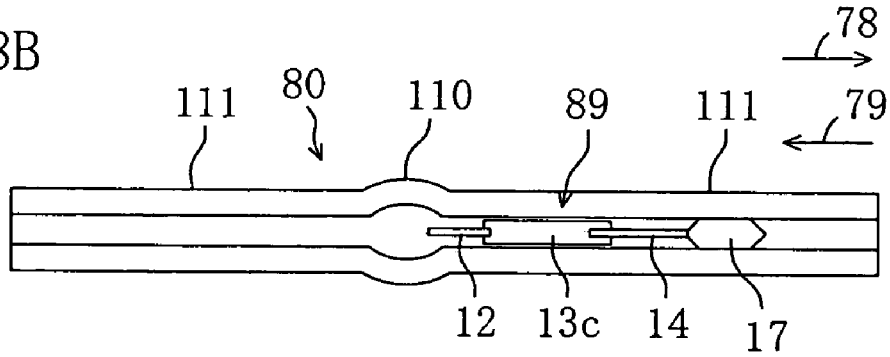
Figure 38C:
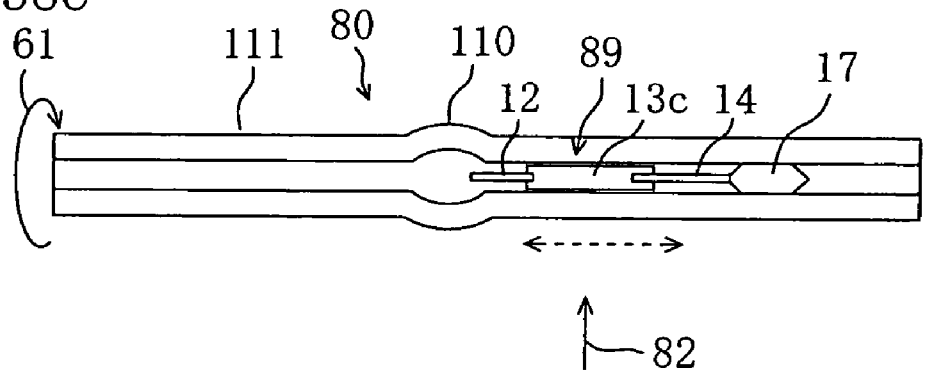
Figure 38D:
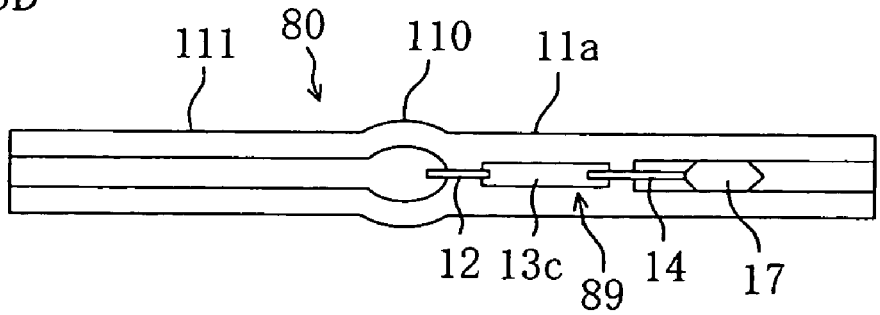
Figure 39A:
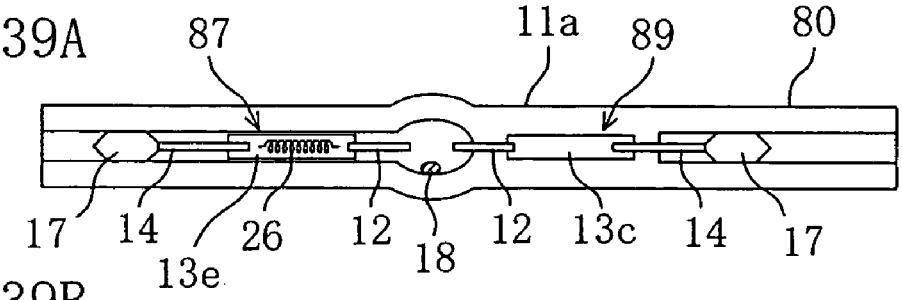
FIGS. 39(*a*) through 39(*e*) are diagrams of process steps for explaining the method for fabricating the discharge lamp according to the sixth and seventh embodiments.
Figure 39B:
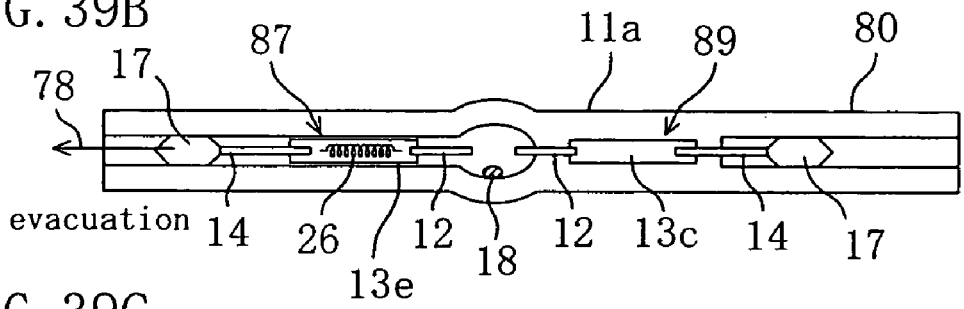
Figure 39C:
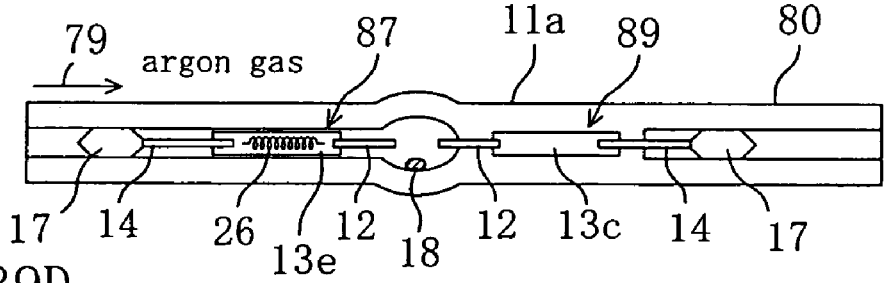
Figure 39D:
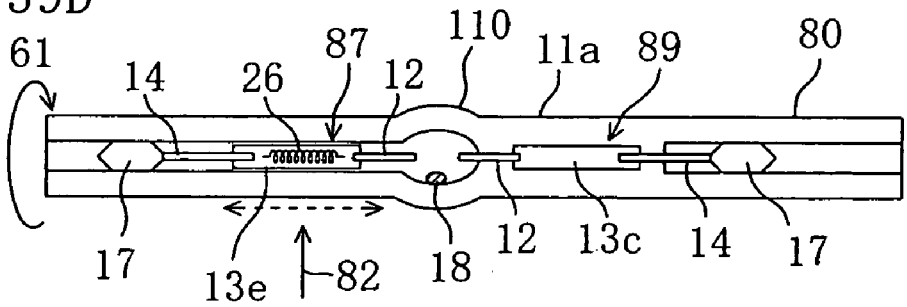
Figure 39E:
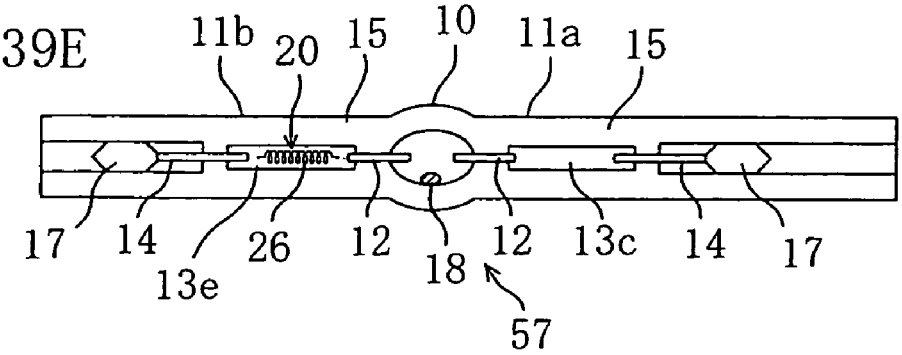

In order to obtain the sealing part 11*b* of the lamp 58 shown in FIG. 35, the following is necessary: an electrode assembly 86 shown in FIG. 36 is prepared, the electrode assembly 86 having the metal foil 13*e* including wavy parts 27, instead of the electrode assembly 87, is inserted into the side pipe section 111 at the stage shown in FIG. 35(*b*), and then the subsequent process step shown in FIG. 35(*c*) is executed.

FIGS. 37(*a*) through 37(*e*) more clearly illustrate the fabricating method of this embodiment by clearly showing a burner 95.

As shown in FIG. 37(*a*), the electrode assembly 87 is initially inserted into the side pipe section 111 of the discharge-lamp pipe 80. As shown in FIG. 37(*b*), the electrode assembly 87 is fixed to the side pipe section 111.

Next, as shown in FIG. 37(*c*), heating is performed from the luminous bulb section 110 side by using a burner 95, and the burner 95 is moved in the arrow direction in this figure. The burner 95 need only be moved at a constant speed.

Thereafter, as shown in FIG. 37(*d*), when the heating is completed to a part of the side pipe section 111 located around the outer lead 14, a sealing part 1 b can be obtained. The heating conditions and passing speed of the burner 95 can employ generally the same as when the sealing part 11*a* including no coil 26 is formed. Thus, the sealing part 11*b* can be simply fabricated.

In addition, according to the fabricating method shown in FIG. 37 (and FIG. 35), the coil 26 is arranged on the metal foil 13*e*. Therefore, there can be provided another advantage that an electrode can more effectively be prevented from being displaced in a sealing part formation step. More particularly, since the coil 26 comes into contact with the inside surface of the side pipe, an electrode assembly (87) including an electrode (12) can be prevented from being displaced. Consequently, the arc length can be adjusted more simply and more accurately. Nowadays, the arc length of a super-high pressure mercury lamp has been shortened to an extremely short space of approximately 1 mm. Therefore, in regard to the adjustment thereof, as compared with the days when the arc length was relatively long, the effect of preventing the electrode displacement has become to have a significant meaning.

The method for fabricating the sealing part 11*b* was primarily described above. Now, a method for fabricating the whole discharge lamp (high-pressure mercury lamp) will be briefly described as follows. FIGS. 38 and 39 are diagrams of process steps for explaining a method for fabricating a discharge lamp according to an embodiment of the present invention.

First, as shown in FIG. 38(*a*), an electrode assembly 89 prepared by previously assembling an electrode 12, a molybdenum foil 13 and an outer lead 14 is inserted from one end of a side pipe section 111 of a discharge-lamp glass pipe 80 into the inside. This electrode assembly 89 is arranged such that the tip of the electrode 12 is located in a predetermined position in a section (luminous bulb section) 110 of the discharge-lamp glass pipe 80 that is to become a luminous bulb 10 in the future. A molybdenum tape 17 for fixing the electrode assembly 89 is provided at one end of the outer lead 14 of the electrode assembly 89. Thereby, the electrode assembly 89 can be fixed in an appropriate position.

After the state shown in FIG. 38(*a*) is obtained, as shown in FIG. 38(*b*), the inside of the glass pipe 80 is initially evacuated as generally shown by an arrow 78. Next, as generally shown by an arrow 79, a dry inert gas (for example, argon gas) having a subatmospheric pressure is introduced by approximately 50 mbr (about $5\times10^3$Pa) or approximately 200 mbar (about $2\times10^4$ Pa).

Next, as shown in FIG. 38(*c*), while the glass pipe 80 is rotated as shown by an arrow 61, a section of the glass pipe 80 located in the vicinity of the electrode assembly 89 is heated. This heating is performed, for example, by a gas burner using oxyhydrogen, propane or the like, or by a laser using $CO_2$ or the like. This process step may be carried out in a state where the glass pipe 80 stands generally upright. In this case, it is preferably carried out in a state where the electrode assembly 89 is placed above the section (110) of the glass pipe 80 that is to become a light emitting part in the future.

When the heating is accomplished to sufficiently keep the hermeticity of the molybdenum foil 13*c*, the glass pipe 80 in which a sealing part 11*a* is formed is completed as shown in FIG. 38(*d*). The process step mainly shown in FIG. 38(*a*) is referred to as an electrode arrangement step (or an electrode assembly arrangement step), and the process step mainly shown in FIG. 35(*c*) is referred to as a sealing part formation step.

Subsequently, as shown in FIG. 39(*a*), mercury 18 that is a luminous material, and an electrode assembly 87 shown in FIG. 37(*a*) are inserted from an aperture end of a glass pipe 80 (a glass pipe in which the first electrode is sealed) into the inside thereof The electrode assembly 87 is inserted and positioned in the glass pipe 80 such that one end of the electrode 12 of the inserted electrode assembly 87 is positioned about 1 mm apart from the tip of the sealing part 11*a* side electrode 12 in the section (110) of the glass pipe 80 that is to become the luminous bulb 10 in the future.

A molybdenum tape 17 is provided also at one end of the outer lead 14 of the electrode assembly 87, thereby easily fixing the electrode assembly 87 in a predetermined position. If the electrode assembly 88 shown in FIG. 32(*c*), instead of the electrode assembly 87, is used, the lamp 56 can be produced. If the electrode assembly 86 shown in FIG. 36 is used, the lamp 58 can be produced.

Next, as shown by an arrow 78 in FIG. 39(*b*), the inside of the glass pipe 80 is evacuated, and then a dry rare gas (for example, argon gas) is introduced by 200 mbr (about $2\times10^4$ Pa), for example, as shown by an arrow 79 in FIG. 39(*c*). At this time, a small amount of halogen gas (or a halogen precursor that will be decomposed into halogen) may be mixed with the rare gas.

Thereafter, in the same manner as shown in FIG. 38(*c*), as shown in FIG. 39(*d*), while the glass pipe 80 is rotated in an arrow 61 direction, a section of the glass pipe 80 located in the vicinity of the electrode assembly 88 is heated as generally shown by an arrow 82. This heating is performed, for example, by a gas burner using oxyhydrogen, propane or the like, or by a laser using $CO_2$ or the like. In the same manner as shown in FIG. 35(*c*), this process step may be carried out in a state where the glass pipe 80 stands generally upright. In this case, it is preferably carried out in a state where the electrode assembly 87 is placed above the section (110) of the glass pipe 80 that is to become a luminous bulb 10 in the future. In order to prevent the mercury 18 from evaporating, while the section 110 of the glass pipe 80 that is to become the luminous bulb 10 in the future is cooled, for example, by liquid nitrogen, this heating process may be carried out. This sealing part formation step is as shown in FIGS. 37(*c*) and 37(*d*). When the electrode assembly 88 is used, this process step is as shown in FIGS. 32(*d*) and 32(*e*).

As shown in FIG. 39(*e*), a lamp 57 in which the luminous bulb 10 and the sealing parts 11*a* and 11*b* are formed is completed. Finally, unnecessary glass parts and the molybdenum tapes 17 are removed so as to expose the outer lead 14 to the outside and an antenna 30 is provided, thereby completing the lamp 56 that can start at low voltage. In the case where the electrode assembly 88 is employed, the lamp 56 shown in FIG. 28 or 30 is completed.

Embodiment 8

Each of the high-pressure discharge lamps of the above sixth and seventh embodiments can become a mirror-mounted lamp or a lamp unit in combination with a reflecting mirror.

Figure 40:
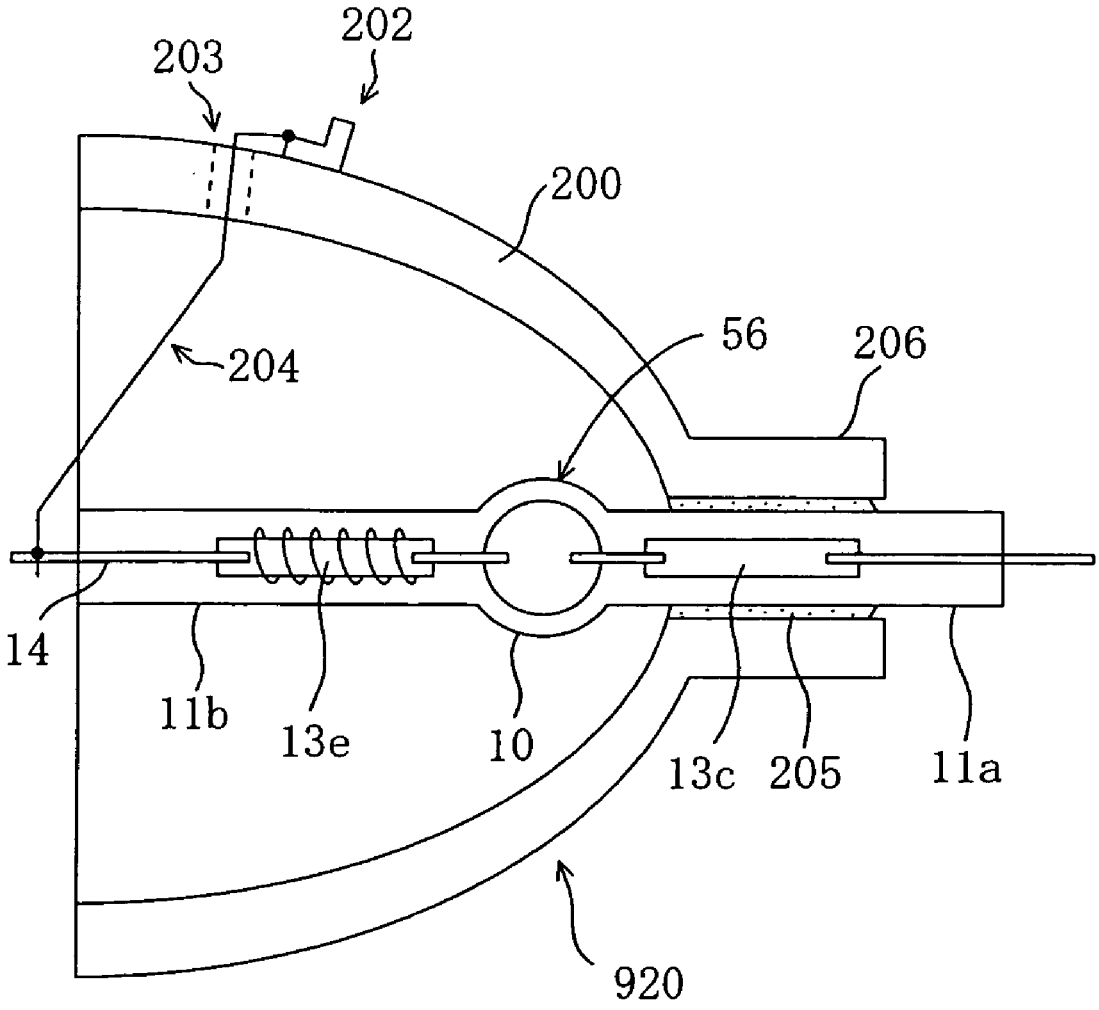
FIG. 40 is a view schematically illustrating a cross section of a mirror-mounted lamp (lamp unit) 920 according to an eighth embodiment of the present invention.

FIG. 40 schematically illustrates the cross section of a mirror-mounted lamp 920 comprising the lamp 56 of the above sixth embodiment. The cross section is not hatched.

The mirror-mounted lamp 920 of this embodiment is the same as the mirror-mounted lamp 900 of the third embodiment in the points other than the lamp 56. Therefore, its structure and effects are the same as described in the third embodiment. The same effects can also be obtained using the lamp 57 or 58 instead of the lamp 56.

Other Embodiments

Although in the above embodiments a mercury lamp using mercury as a luminous material is described as an example of a high-pressure discharge lamp, the present invention can be applied to any high-pressure discharge lamp having a structure that holds the hermeticity of a luminous bulb by a sealing part. For example, the present invention can also be applied to a high-pressure discharge lamp such as a metal halide lamp in which metal halide is encapsulated. The reason is that it is preferable also for the metal halide lamp to have an ability to start at low voltage. In recent years, the development of mercury-free metal halide lamps has been advanced. The present invention can also be applied to this kind of mercury-free metal halide lamps.

The mercury-free metal halide lamps to which the techniques of the above embodiments are applied include the structures of the lamps shown in FIGS. 4, 6, 14, 18, 20, 23, 28, 30, 33, 34 and the like in which substantially no mercury is encapsulated in the luminous bulb 10 and at least a first halide, a second halide and a rare gas are encapsulated therein. The metal included in the first halide is a luminous material. The second halide has a higher vapor pressure than the first halide and is one type or plural types of halide containing metal for which it is difficult to emit light in a visible range as compared with the metal contained in the first halide. For example, the first halide is one type or plural types of halide selected from the group consisting of sodium, scandium and rare-earth metal. The second halide has a relatively high vapor pressure and is one type or plural types of halide containing metal for which it is difficult to emit light in a visible range as compared with the metal contained in the first halide. The specific second halide is a halide containing at least one type of metal selected from the group consisting of Mg, Fe, Co, Cr, Zn, Ni, Mn, Al, Sb, Be, Re, Ga, Ti, Zr and Hf. The second halide more preferably includes at least Zn-halide.

The following other combination is taken as an example. $ScI_3$ (scandium iodide) and NaI (sodium iodide) that are luminous materials, $InI_3$ (indium iodide) and TlI (thallium iodide) that are alternative materials to mercury, and a rare gas (for example, Xe gas of 1.4 MPa) serving as a starting-support gas are encapsulated in a luminous bulb 10 of a mercury-free metal halide lamp comprising the translucent luminous bulb (hermetic container) 10, a pair of electrodes 12 provided in the luminous bulb 10, and a pair of sealing parts (13*a*, 13*a*) coupled to the luminous bulb 10. In this case, the first halide is equivalent to $ScI_3$ (scandium iodide) and NaI (sodium iodide), and the second halide is equivalent to $InI_3$ (indium iodide) and TlI (thallium iodide). The second halide need have a relatively high vapor pressure and take the place of mercury. Therefore, for example, Zn-iodide, instead of $InI_3$ (indium iodide) or the like, may be employed.

Furthermore, although in the above embodiments a description is given of the case where the mercury vapor pressure is approximately 20 MPa or more (the case of a so-called super-high pressure mercury lamp), it should not be excluded that the present invention is applied to a high-pressure mercury lamp whose mercury vapor pressure is approximately 1 MPa. That is, the present invention can be applied to all types of high-pressure discharge lamps including a super-high pressure mercury lamp and a high-pressure mercury lamp. Although a sealing part located in each of the lamps of the above embodiments is produced by a shrink method, one produced by a pinching method should not be excluded.

In addition, the space (arc length) between a pair of electrodes 12 may be that of a short-arc-type or be longer than that of the short-arc-type. The lamps of the above embodiments can be used for both of an alternating-current lighting type and a direct-current lighting type. The structures of the lamps of the above embodiments can be employed in combination with one another.

Although the preferable examples of the present invention are described above, these descriptions are not restrictive of the present invention. Certainly, various kinds of variants are possible.

According to the discharge lamp of the present invention, since a cavity in which at least a rare gas is encapsulated is provided around a part of a sealing part in which a metal bar is located, there can be provided a discharge lamp that can start at low voltage and suppress foil deterioration to prevent its life from being shortened.

Since a metal foil located in a sealing part includes a cutout at its central part and a cavity is formed around a part of the metal foil in which a cutout is located, there can be provided a discharge lamp that can start at low voltage and suppress foil deterioration to prevent its life from being shortened. Also when a cavity is formed on the central part of the metal foil located in the sealing part, the lamp can also start at low voltage and suppress foil deterioration.

Furthermore, since a coil is wound around a metal foil located in at least one of the sealing parts and a cavity in which at least a rare gas is encapsulated exists around the coil, there can be provided a discharge lamp that can start at low voltage and suppress foil deterioration to prevent its life from being shortened. Also when a coil is provided on the metal foil located in at least one of the sealing parts, there can be provided a lamp that can start at low voltage and suppress foil deterioration.

INDUSTRIAL APPLICABILITY

A discharge lamp, a method for fabricating the same, and a lamp unit of the present invention are useful when they are used for a light source of an image projection device such as a liquid crystal projector and a DMD projector. The present invention has a high industrial applicability, particularly in that the deterioration of a metal foil located in a sealing part of the discharge lamp can be suppressed to prevent the life of the discharge lamp from being shortened and the discharge lamp can start at low voltage.

The invention claimed is:

1. A discharge lamp comprising a luminous bulb in which a luminous material is encapsulated and a pair of electrodes are arranged so as to be opposed to each other, and sealing parts that are formed at both ends of the luminous bulb and in which metal foil structures electrically connected to the pair of electrodes, respectively, are sealed, wherein:

at least one of the metal foil structures is composed of a first metal foil, a second metal foil, and a metal bar through which both of the first and second metal foils are coupled to each other;

the sealing part sealing the at least one of the metal foil structures includes a cavity around the position where in the sealing part the metal bar is located;

at least a rare gas is encapsulated in the cavity;

a coil is wound around the metal bar; and at least a part of the coil is exposed to the inside of the cavity.

2. The discharge lamp of claim 1, wherein the coil is composed of thoriated tungsten or tungsten.

3. The discharge lamp of claim 1, wherein a part of the coil is connected to a part of the metal bar by welding, and the remainder of the coil is wound around the metal bar so as to be located apart from the surface of the metal bar.

4. The discharge lamp of claim 1, wherein the discharge lamp is a high-pressure mercury lamp in which mercury of 150 mg/cm$^3$ or more relative to the internal volume of the luminous bulb is encapsulated as the luminous material.

5. The discharge lamp of claim 1, wherein an antenna is provided around a section of the sealing part in which the cavity is located.

6. A lamp unit comprising the discharge lamp of claim 1 and a reflecting mirror for reflecting light emitted from the discharge lamp.

7. A discharge lamp comprising a luminous bulb in which a luminous material is encapsulated and a pair of electrodes are arranged so as to be opposed to each other, and sealing parts that are formed at both ends of the luminous bulb and in which metal foils electrically connected to the pair of electrodes, respectively, are sealed, wherein:

at least one of the sealing parts includes a cavity on the central part of the metal foil of the sealing part, wherein an antenna is provided around a section of the sealing part in which the cavity is located;

at least a rare gas is encapsulated in the cavity;

in a part of the sealing part including the cavity, all parts of outer edges of the metal foil are covered with glass constituting the sealing part and are not exposed to the cavity; and a central part of the metal foil is exposed to the cavity.

8. The discharge lamp of claim 7, wherein the discharge lamp is a high-pressure mercury lamp in which mercury of 150 mg/cm$^3$ or more relative to the internal volume of the luminous bulb is encapsulated as the luminous material.

9. A lamp unit comprising the discharge lamp of claim 7 and a reflecting mirror for reflecting light emitted from the discharge lamp.

10. An image projection device comprising the lamp unit of claim 9.

11. A discharge lamp comprising a luminous bulb in which a luminous material is encapsulated and a pair of electrodes are arranged so as to be opposed to each other. and sealing parts that are formed at both ends of the luminous bulb and in which metal foils electrically connected to the pair of electrodes, respectively, are sealed, wherein:

a coil is encircling the metal foil located in at least one of the sealing parts, wherein a surface of the coil is contacting the metal foil;

a cavity in which at least a rare gas is encapsulated exists enclosing the coil located in the sealing part, wherein an antenna is provided around a section of the sealing part in which the cavity is located; and a space of the cavity and a space of the luminous bulb are separated each other by a structure material that constitutes the sealing parts and are not communicated with each other.

12. The discharge lamp of claim 11, wherein the longer edges of the metal foil located in the at least one of the sealing parts are covered with the coil by half or less.

13. The discharge lamp of claim 11, wherein the coil is composed of thoriated tungsten.

14. The discharge lamp of claim 11, wherein the discharge lamp is a high-pressure mercury lamp in which mercury of 150 mg/cm$^3$ or more relative to the internal volume of the luminous bulb is encapsulated as the luminous material.

15. A lamp unit comprising the discharge lamp of claim 11 and a reflecting mirror for reflecting light emitted from the discharge lamp.

16. An image projection device comprising the lamp unit of claim 15.

17. A discharge lamp comprising a luminous bulb in which a luminous material is encapsulated and a pair of electrodes are arranged so as to be opposed to each other, and sealing parts that are formed at both ends of the luminous bulb and in which metal foils electrically connected to the pair of electrodes, respectively, are sealed, wherein:

a coil is encircling the metal foil located in at least one of the sealing parts, wherein a surface of the coil is contacting the metal foil;

a cavity in which at least a rare gas is encapsulated exists enclosing to the position where in the sealing part the coil is provided, wherein an antenna is provided around a section of the sealing part in which the cavity is located; and a space of the cavity and a space of the luminous bulb are separated by each other by a structure material that constitutes the sealing part and are not communicated with each other.

18. The discharge lamp of claim 17, wherein the coil is placed within the surface area of the metal foil and is connected to the metal foil by welding.

19. The discharge lamp of claim 17, wherein the coil is composed of thoriated tungsten.

20. The discharge lamp of claim 17, wherein the discharge lamp is a high-pressure mercury lamp in which mercury of 150 mg/cm$^3$ or more relative to the internal volume of the luminous bulb is encapsulated as the luminous material.

21. A lamp unit comprising the discharge lamp of claim 17 and a reflecting mirror for reflecting light emitted from the discharge lamp.

22. An image projection device comprising the lamp unit of claim 21.

23. A method for fabricating a discharge lamp, comprising the steps of:

(a) preparing an electrode assembly including a metal foil structure, an electrode connected to the metal foil structure, and an outer lead connected to one end of the metal foil structure opposite to the other end thereof to which the electrode is connected, the metal foil structure comprising a first metal foil, a second metal foil and a metal bar coupling the first and second metal foils, the electrode being connected to the first metal foil, and the outer lead being connected to the second metal foil;

(b) inserting the electrode assembly into a side pipe section of a discharge-lamp pipe including a luminous bulb section and the side pipe section extending from the luminous bulb such that the tip of the electrode is located in the luminous bulb section; and (c) after the step (b), putting the inside of the discharge-lamp pipe under a reduced pressure and softening the side pipe section by heat, thereby bringing the side pipe section into tight contact with the melal foil structure by a shrink-sealing method without pressing from outside, wherein the step (c) comprises the steps of:

(c-1) bringing a part of the side pipe section corresponding to the first metal foil into tight contact with the first metal foil;

(c-2) bringing a part of the side pipe section corresponding to the second metal foil into tight contact with the second metal foil: and forming a cavity around the metal bar located in the side pipe through the steps (c-1) and (c-2).

24. The method for fabricating a discharge lamp of claim 23, wherein a coil is wound around the metal bar of the electrode assembly prepared in the step (a).

25. The method for fabricating a discharge lamp of claim 24, wherein a part of the coil is connected to a part of the metal bar by welding, and the remainder of the coil is wound around the metal bar so as to be located apart from the surface of the metal bar.

26. A method for fabricating a discharge lamp, comprising the steps of:

(r) preparing an electrode assembly including a metal foil, an electrode connected to the metal foil, and an outer lead connected to one end of the metal foil opposite to the other end thereof to which the electrode is connected;

(s) inserting the electrode assembly into a side pipe section of a discharge-lamp pipe including a luminous bulb section and the side pipe section extending from the luminous bulb such that the tip of the electrode is located in the luminous bulb section; and (t) after the step (s), putting the inside of the discharge-lamp pipe under a reduced pressure and softening the side pipe section by heat, thereby bringing the side pipe section into tight contact with the metal foil, wherein the step (t) comprises the steps of:

(t-1) bringing a part of the side pipe section located toward the luminous bulb section into tight contact with a part of the metal foil located toward the electrode;

(t-2) bringing a part of the side pipe section opposite to the luminous bulb section into tight contact with a part of the metal foil located toward the outer lead; and (t-3) bringing outer edges of a part of the metal foil located between a part of the metal foil located toward the electrode and a part of the metal foil located toward the outer lead into tight contact with a part of the side pipe section corresponding to the outer edges, wherein a central part of the metal foil is disposed in a cavity and all parts of the outer edges are in tight contact with the side pipe section.

27. The method for fabricating a discharge lamp of claim 26, wherein in the step (t-3), the outer edges of the metal foil are brought into tight contact with the side pipe section by laser irradiation.

28. The method for fabricating a discharge lamp of claim 26, wherein the step (t-3) is executed simultaneously with either of the steps (t-1) and (t-2).

29. The method for fabricating a discharge lamp of claim 26, wherein:

the metal foil of the electrode assembly prepared in the step (r) includes a cutout formed in a part of the metal foil located between a part thereof located toward the electrode and a part thereof located toward the outer lead; and the edge of the cutout defining the contour thereof does not reach the outer edges of the metal foil.

30. A method for fabricating a discharge lamp, comprising the steps of:

(α) preparing an electrode assembly including a metal foil having a surface on which a coil is provided, an electrode connected to the metal foil, and an outer lead connected to one end of the metal foil opposite to the other end thereof to which the electrode is connected;

(β) inserting the electrode assembly into a side pipe section of a discharge-lamp pipe including a luminous bulb section and the side pipe section extending from the luminous bulb section such that the tip of the electrode is located in the luminous bulb section; and (γ) after the step (β), putting the inside of the discharge-lamp pipe under a reduced pressure and softening the side pipe section by heat, thereby bringing the side pipe section into tight contact with the metal foil with the coil interposed therebetween by a shrink-sealing method without pressing from outside.

* * * * *

UNITED STATES PATENT AND TRADEMARK OFFICE

CERTIFICATE OF CORRECTION

PATENT NO. : 7,329,992 B2
APPLICATION NO. : 10/491250
DATED : February 12, 2008
INVENTOR(S) : Ryo Minamihata et al.

It is certified that error appears in the above-identified patent and that said Letters Patent is hereby corrected as shown below:

Col. 33, Line 56, Claim 11 “other.” should be -- other, --

Signed and Sealed this

Twenty-ninth Day of July, 2008

JON W. DUDAS
*Director of the United States Patent and Trademark Office*